US011611138B2

(12) United States Patent
Ogawa et al.

(10) Patent No.: US 11,611,138 B2
(45) Date of Patent: Mar. 21, 2023

(54) METHOD OF PRODUCING A RADIO FREQUENCY MEMBER

(71) Applicants: Nidec Corporation, Kyoto (JP); WGR Co., Ltd., Kyoto (JP)

(72) Inventors: Takao Ogawa, Kyoto (JP); Yoshitomo Tatematsu, Kyoto (JP); Daishi Nagatsu, Kyoto (JP); Hideki Kirino, Kyoto (JP); Hiroyuki Kamo, Kyoto (JP)

(73) Assignees: NIDEC CORPORATION, Kyoto (JP); WGR CO., LTD., Kyoto (JP)

( * ) Notice: Subject to any disclaimer, the term of this patent is extended or adjusted under 35 U.S.C. 154(b) by 614 days.

(21) Appl. No.: 16/599,267

(22) Filed: Oct. 11, 2019

(65) Prior Publication Data

US 2020/0052361 A1 Feb. 13, 2020

Related U.S. Application Data

(63) Continuation of application No. PCT/JP2018/014456, filed on Apr. 4, 2018.

(30) Foreign Application Priority Data

Apr. 12, 2017 (JP) ..... JP2017-078673
Feb. 9, 2018 (JP) ..... JP2018-021765

(51) Int. Cl.
*H01P 11/00* (2006.01)
*H01P 3/123* (2006.01)

(52) U.S. Cl.
CPC ..... *H01P 11/002* (2013.01); *H01P 3/123* (2013.01)

(58) Field of Classification Search
CPC ..... H01P 11/002; H01P 11/003; H01P 3/123
See application file for complete search history.

(56) References Cited

U.S. PATENT DOCUMENTS 2,826,524 A * 3/1958 Molloy ..... H01P 11/002 138/146
3,940,718 A * 2/1976 Vilkaitis ..... H01P 11/002 333/241

(Continued)

FOREIGN PATENT DOCUMENTS

EP 0 385 165 A1 9/1990
EP 1 331 688 A1 7/2003

(Continued)

OTHER PUBLICATIONS

Schlesinger et al., Modern Electroplating, copyright 2010, Wiley, 5th edition, pp. 1-2 (Year: 2010).*

(Continued)

*Primary Examiner* — Jeffrey T Carley
(74) *Attorney, Agent, or Firm* — Keating & Bennett

(57) ABSTRACT

A method of producing a radio frequency member to construct a radio frequency confinement device based on a waffle iron structure includes providing an intermediate work of a plate shape or a block shape, the intermediate work including a main surface which is shaped as a plane or a curved surface and a plurality of rods extending away from the main surface. An interval between a side surface of one of the plurality of rods and a side surface of another rod that is adjacent to the one rod monotonically increases in a direction away from the main surface. The method also includes forming an electrically-conductive plating layer on the main surface and at least the side surface of the plurality of rods by immersing at least a portion of the intermediate work in plating solution.

14 Claims, 32 Drawing Sheets

(56) References Cited

U.S. PATENT DOCUMENTS

| | | | | |
|---|---|---|---|---|
| 4,532,015 | A | 7/1985 | Boultinghouse et al. | |
| 6,191,704 | B1 | 2/2001 | Takenaga et al. | |
| 6,339,395 | B1 | 1/2002 | Hazumi et al. | |
| 6,403,942 | B1 | 6/2002 | Stam | |
| 6,611,610 | B1 | 8/2003 | Stam et al. | |
| 6,628,299 | B2 | 9/2003 | Kitayama | |
| 6,630,876 | B1 * | 10/2003 | Noyes | H01P 11/002 333/248 |
| 6,661,367 | B2 | 12/2003 | Sugiyama et al. | |
| 6,703,967 | B1 | 3/2004 | Kuroda et al. | |
| 6,903,677 | B2 | 6/2005 | Takashima et al. | |
| 6,943,726 | B2 | 9/2005 | Schneider | |
| 7,161,561 | B2 | 1/2007 | Kitayama | |
| 7,355,524 | B2 | 4/2008 | Schofield | |
| 7,358,889 | B2 | 4/2008 | Abe et al. | |
| 7,417,580 | B2 | 8/2008 | Abe et al. | |
| 7,420,159 | B2 | 9/2008 | Heslin et al. | |
| 7,425,983 | B2 | 9/2008 | Izumi et al. | |
| 7,570,198 | B2 | 8/2009 | Tokoro | |
| 7,978,122 | B2 | 7/2011 | Schmidlin | |
| 8,068,134 | B2 | 11/2011 | Yoshizawa | |
| 8,446,312 | B2 | 5/2013 | Kanamoto et al. | |
| 8,543,277 | B2 | 9/2013 | Higgins-Luthman | |
| 8,593,521 | B2 | 11/2013 | Schofield et al. | |
| 8,604,968 | B2 | 12/2013 | Alland et al. | |
| 8,610,620 | B2 | 12/2013 | Katoh | |
| 8,614,640 | B2 | 12/2013 | Lynam | |
| 8,636,393 | B2 | 1/2014 | Schofield | |
| 8,730,096 | B2 | 5/2014 | Kanamoto et al. | |
| 8,730,099 | B2 | 5/2014 | Kanamoto et al. | |
| 8,779,995 | B2 | 7/2014 | Kirino et al. | |
| 8,803,638 | B2 | 8/2014 | Kildal | |
| 8,861,842 | B2 | 10/2014 | Jung et al. | |
| 9,286,524 | B1 | 3/2016 | Mei et al. | |
| 9,786,995 | B2 | 10/2017 | Kirino et al. | |
| 10,027,032 | B2 * | 7/2018 | Kirino | H01Q 21/0006 |
| 10,042,045 | B2 | 8/2018 | Kirino et al. | |
| 10,090,600 | B2 | 10/2018 | Kirino et al. | |
| 10,158,158 | B2 | 12/2018 | Kirino et al. | |
| 10,263,310 | B2 * | 4/2019 | Kildal | H01P 1/2005 |
| 10,396,422 | B1 * | 8/2019 | Rojas | H01P 1/207 |
| 2001/0052832 | A1 * | 12/2001 | Gotoh | H01P 11/007 333/202 |
| 2002/0135444 | A1 * | 9/2002 | Ida | H01P 1/20363 333/204 |
| 2011/0181373 | A1 * | 7/2011 | Kildal | H01P 1/2005 333/239 |
| 2011/0187614 | A1 | 8/2011 | Kirino et al. | |
| 2012/0092224 | A1 | 4/2012 | Sauleau et al. | |
| 2013/0033404 | A1 | 2/2013 | Abe | |
| 2013/0141190 | A1 * | 6/2013 | Kitaoka | C23C 14/225 156/60 |
| 2015/0194718 | A1 * | 7/2015 | Kildal | H01P 11/002 427/78 |
| 2015/0264230 | A1 | 9/2015 | Takeda | |
| 2016/0140424 | A1 | 5/2016 | Wang et al. | |
| 2016/0264065 | A1 | 9/2016 | Takeda | |
| 2017/0033468 | A1 * | 2/2017 | Wong | H01P 1/2005 |
| 2017/0084971 | A1 | 3/2017 | Kildal et al. | |
| 2017/0086288 | A1 * | 3/2017 | Ouyang | H01P 3/04 |
| 2017/0110802 | A1 * | 4/2017 | Kirino | H01P 3/00 |
| 2017/0317427 | A1 | 11/2017 | Kirino et al. | |
| 2018/0040963 | A1 | 2/2018 | Kirino et al. | |
| 2018/0113187 | A1 | 4/2018 | Vassilev et al. | |
| 2018/0301817 | A1 | 10/2018 | Ichinose et al. | |
| 2018/0351261 | A1 | 12/2018 | Kamo et al. | |
| 2018/0375219 | A1 | 12/2018 | Kirino et al. | |
| 2019/0006743 | A1 | 1/2019 | Kirino et al. | |
| 2019/0067780 | A1 | 2/2019 | Kirino et al. | |
| 2019/0074569 | A1 | 3/2019 | Kamo et al. | |
| 2019/0123411 | A1 | 4/2019 | Carlred et al. | |
| 2019/0139914 | A1 | 5/2019 | Kirino et al. | |
| 2019/0140344 | A1 | 5/2019 | Kirino et al. | |

FOREIGN PATENT DOCUMENTS

| | | | | |
|---|---|---|---|---|
| JP | 2001-267838 | A | 9/2001 | |
| JP | 2003-304106 | A | 10/2003 | |
| JP | 2004-257848 | A | 9/2004 | |
| JP | 2007-259047 | A | 10/2007 | |
| JP | 2010-021828 | A | 1/2010 | |
| JP | 2012-004700 | A | 1/2012 | |
| JP | 2012-523149 | A | 9/2012 | |
| JP | 2013-032979 | A | 2/2013 | |
| WO | 01/67540 | A1 | 9/2001 | |
| WO | 2008/081807 | A1 | 7/2008 | |
| WO | 2010/050122 | A1 | 5/2010 | |
| WO | 2013/189919 | A1 | 12/2013 | |
| WO | 2015/172948 | A2 | 11/2015 | |
| WO | 2016/116126 | A1 | 7/2016 | |
| WO | 2016/163932 | A1 | 10/2016 | |
| WO | WO-2017149423 | A1 * | 9/2017 | B33Y 10/00 |
| WO | 2018/105513 | A1 | 6/2018 | |
| WO | 2018/207796 | A1 | 11/2018 | |
| WO | 2018/207838 | A1 | 11/2018 | |

OTHER PUBLICATIONS

Official Communication issued in corresponding German Patent Application No. 112018001317.0, dated Sep. 17, 2021.

Kirino et al., "A 76 GHz Multi-Layered Phased Array Antenna Using a Non-Metal Contact Metamaterial Waveguide", IEEE Transactions on Antennas and Propagation, vol. 60, No. 2, Feb. 2012, pp. 840-853.

Zaman et al., "Ku Band Linear Slot-Array in Ridge Gapwaveguide Technolgy", 7th European Conference on Antennas and Propagation (EUCAP 2013)—Convened Sessions, 2013, pp. 2968-2971.

Kildal et al., "Local Metamaterial-Based Waveguides in Gaps Between Parallel Metal Plates", IEEE Antennas and Wireless Propagation Letters, vol. 8, 2009, pp. 84-87.

Pucci et al., "Design of a Dual-Mode Horn Element for Microstrip Gap Waveguide Fed Array", 7th European Conference on Antennas and Propagation (EUCAP 2013)—Convened Sessions, 2013, pp. 2976-2979.

Kildal, "Metasurfing Since 1987—A Personal Story Involving Soft and Hard Surfaces, EBG Surfaces, Cloaking, Gap Waveguides and Mass Production", 2014 IEEE Antennas and Propagation Society International Symposium, 2014, pp. 529-530.

Sehm et al., "A High-Gain 58-GHz Box-Horn Array Antenna with Suppressed Grating Lobes", IEEE Transactions on Antennas and Propagation, vol. 47, No. 7, Jul. 1999, pp. 1125-1130.

Zaman et al., "Slot Antenna in Ridge Gap Waveguide Technology", 6th European Conference on Antennas and Propagation, Mar. 2012, pp. 3243 & 3244.

Zarifi et al., "Design and Fabrication of a High-Gain 60-GHz Corrugated Slot Antenna Array With Ridge Gap Waveguide Distribution Layer", IEEE Transactions on Antennas and Propagation, vol. 64, No. 7, Jul. 2016, pp. 2905-2913.

Mustafa, "Hybrid Analog-Digital Beam-Steered Slot Antenna Array for mm-Wave Applications in Gap Waveguide Technology", Department of Electronics and Telecommunications Master of Science in Telecommunications Engineering Master's Thesis, Oct. 2015, 67 pages.

Kirino et al., "Simplified Wavelength Calculations for Fast and Slow Wave Metamaterial Ridged Waveguides and their Application to Array Antenna Design", Proceedings of the International Symposium on Antennas & Propagation, Oct. 25, 2013, 4 pages.

Ahmadi et al., "Direct Coupled Resonator Filters Realized by Gap Waveguide Technology", IEEE Transactions on Microwave Theory and Techniques, vol. 63, No. 10, Oct. 2015, pp. 3445-3452.

Zaman et al., "Gap Waveguide PMC Packaging for Improved Isolation of Circuit Components in High-Frequency Microwave Modules", IEEE Transactions on Components, Packaging and Manufacturing Technology, vol. 4, No. 1, Jan. 2014, 11 pages.

Rajo-Iglesias et al., "Numerical studies of bandwidth of parallel plate cut-off realized by bed of nails, corrugations and mushroom-type EBG for use in gap waveguides", IET Microwaves, Antennas & Propagation, vol. 5(3), Feb. 2011, 9 pages.

(56) References Cited

OTHER PUBLICATIONS

Nikkei Electronics Nov. 2017, "Millimeter-wave radar installable inside the car, applicable to "LIDAR" with beam forming", Oct. 19, 2017, 2 pages.
Nikkei Technology Online, "Millimeter-wave radar installable inside the car, applicable to "LIDAR" with a phased array", Oct. 10, 2017, 5 pages.
Official Communication issued in International Patent Application No. PCT/JP2018/014456, dated Jul. 3, 2018.

* cited by examiner

METHOD OF PRODUCING A RADIO FREQUENCY MEMBER

CROSS REFERENCE TO RELATED APPLICATIONS

This is a continuation of PCT Application No. PCT/JP2018/014456, filed on Apr. 4, 2018, and priority under 35 U.S.C. § 119(a) and 35 U.S.C. § 365(b) is claimed from Japanese Application No. 2017-078673, filed Apr. 12, 2017 and Japanese Application No. 2018-021765, filed on Feb. 9, 2018; the entire contents of which are hereby incorporated herein by reference.

FIELD OF THE INVENTION

The present disclosure relates to a method of producing a radio frequency member.

BACKGROUND

Examples of waveguiding structures including an artificial magnetic conductor are disclosed in the specification of U.S. Pat. No. 8,779,995, the specification of U.S. Pat. No. 8,803,638, the specification of European Patent Application Publication No. 1331688 and H. Kirino and K. Ogawa, "A 76 GHz Multi-Layered Phased Array Antenna using a Non-Metal Contact Metamaterial Waveguide", IEEE Transaction on Antenna and Propagation, Vol. 60, No. 2, pp. 840-853, February, 2012, and A. Uz. Zaman and P.-S. Kildal, "Ku Band Linear Slot-Array in Ridge Gap waveguide Technology", EUCAP 2013, 7th European Conference on Antenna and Propagation. An artificial magnetic conductor is a structure which artificially realizes the properties of a perfect magnetic conductor (PMC), which does not exist in nature. One property of a perfect magnetic conductor is that "a magnetic field on its surface has zero tangential component". This property is the opposite of the property of a perfect electric conductor (PEC), i.e., "an electric field on its surface has zero tangential component". Although no perfect magnetic conductor exists in nature, it can be embodied by an artificial periodic structure. An artificial magnetic conductor functions as a perfect magnetic conductor in a specific frequency band which is defined by its periodic structure. An artificial magnetic conductor restrains or prevents an electromagnetic wave of any frequency that is contained in the specific frequency band (propagation-restricted band) from propagating along the surface of the artificial magnetic conductor. For this reason, the surface of an artificial magnetic conductor may be referred to as a high impedance surface.

In the waveguide devices disclosed in the specification of U.S. Pat. No. 8,779,995, the specification of U.S. Pat. No. 8,803,638, the specification of European Patent Application Publication No. 1331688 and H. Kirino and K. Ogawa, "A 76 GHz Multi-Layered Phased Array Antenna using a Non-Metal Contact Metamaterial Waveguide", IEEE Transaction on Antenna and Propagation, Vol. 60, No. 2, pp. 840-853, February, 2012, and A. Uz. Zaman and P.-S. Kildal, "Ku Band Linear Slot-Array in Ridge Gap waveguide Technology", EUCAP 2013, 7th European Conference on Antenna and Propagation, an artificial magnetic conductor is realized by a plurality of electrically conductive rods which are arrayed along row and column directions. Such rods are projections which may also be referred to as posts or pins. Each of these waveguide devices includes, as a whole, a pair of opposing electrically conductive plates. One conductive plate has a ridge protruding toward the other conductive plate, and stretches of an artificial magnetic conductor extending on both sides of the ridge. An upper face (i.e., its electrically conductive face) of the ridge opposes, via a gap, an electrically conductive surface of the other conductive plate. An electromagnetic wave of a wavelength which is contained in the propagation-restricted band of the artificial magnetic conductor propagates along the ridge, in the space (gap) between this conductive surface and the upper face of the ridge. In the present specification, such a waveguide will be referred to as a WRG (Waffle-iron Ridge waveGuide) or a WRG waveguide.

Ashraf Uz Zaman, Mats Alexanderson, Tin Vukusic, and Per-Simon Kildal, "Gap Waveguide PMC Packaging for Improved Isolation of Circuit Components in High-Frequency Microwave Modules", IEEE TRANSACTIONS ON COMPONENTS, PACKAGING AND MANUFACTURING TECHNOLOGY, VOL. 4, NO. 1, pp. 16-25, January 2014 proposes a packaging technique for a radio frequency element that utilizes an artificial magnetic conductor which is implemented as a plurality of electrically conductive rods.

In order to realize an artificial magnetic conductor, a production method that subjects a metal plate to a cutting process has conventionally been used as a method for making a work which is structured so that a plurality of electrically conductive rods are arrayed thereon. However, cutting processes are not suitable for mass production, and they result in a high production cost. A method is therefore needed that mass-produces such a structure in an inexpensive manner.

SUMMARY

A method of producing a radio frequency member to construct a radio frequency confinement device based on a waffle iron structure according to an example embodiment of the present disclosure includes providing an intermediate work of a plate shape or a block shape, the intermediate work including a main surface which is shaped as a plane or a curved surface and a plurality of rods extending away from the main surface, and forming an electrically-conductive plating layer on the main surface and at least the side surface of the plurality of rods by immersing at least a portion of the intermediate work in a plating solution. In the intermediate work, an interval between the side surface of one of the plurality of rods and the side surface of another rod that is adjacent to the one rod monotonically increases in a direction away from the main surface.

A method of producing a radio frequency member to construct a radio frequency confinement device based on a waffle iron structure according to another example embodiment of the present disclosure includes providing an intermediate work of a plate shape or a block shape, the intermediate work including a main surface which is shaped as a plane or a curved surface and a plurality of rods extending away from the main surface, and forming an electrically-conductive plating layer on the main surface and the surface of the plurality of rods by immersing at least a portion of the intermediate work in a plating solution. At least one of the plurality of rods has a prismatic shape with disedged corners or a cylindrical shape.

According to example embodiments of the present disclosure, radio frequency members for use in a WRG, or members each including an artificial magnetic conductor thereon, can be obtained with a low production cost.

The above and other elements, features, steps, characteristics and advantages of the present disclosure will become more apparent from the following detailed description of the example embodiments with reference to the attached drawings.

DETAILED DESCRIPTION

Prior to describing example embodiments of the present disclosure, the fundamental example construction and operation of a waveguide device to be constructed by using a radio frequency member which is produced by a production method according to the present disclosure will be described.

Note that any structure appearing in a figure of the present application is shown in an orientation that is selected for ease of explanation, which in no way should limit its orientation when an example embodiment of the present disclosure is actually practiced. Moreover, the shape and size of a whole or a part of any structure that is shown in a figure should not limit its actual shape and size.

1. Method of Producing a Radio Frequency Member

<Construction of Waveguide Device and Shape of Radio Frequency Member>

Figure 1A:
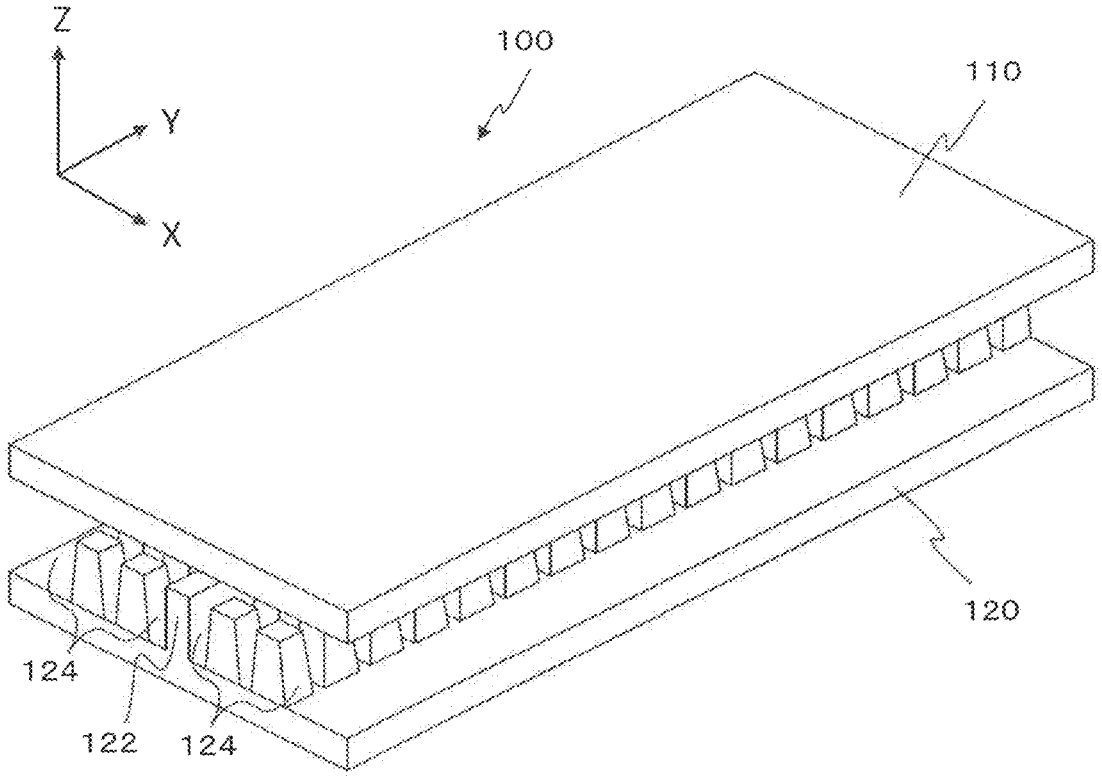
FIG. 1A is a perspective view schematically showing an example general construction of an example waveguide device which is constructed by using a radio frequency member according to an example embodiment of the present disclosure.

FIG. 1A is a perspective view schematically a non-limiting example of the fundamental construction of such a waveguide device. FIG. 1A shows XYZ coordinates that are indicative of the X, Y, and Z directions which are orthogonal to one another. The waveguide device 100 shown in the figure includes a plate-like first electrically conductive member 110 and a plate-like second electrically conductive member 120 which are opposed and in parallel to each other. A plurality of conductive rods 124 are arrayed on the second conductive member 120. The second conductive member 120 is an example of a radio frequency member to be produced by a production method according to an example embodiment of the present disclosure. Hereinafter, the second conductive member 120 may be referred to as the radio frequency member 120.

In the present specification, a "radio frequency member" is meant as a member to be used mainly in applications which deal with radio-frequency electromagnetic waves. In the present specification, a "radio frequency" means a frequency of approximately from 3 kHz to 300 GHz. A radio frequency member for use in a WRG may be used to propagate an electromagnetic wave of e.g. the millimeter wave band (i.e., approximately from 30 GHz to 300 GHz). In the present disclosure, the radio frequency member may deal with a frequency band which is lower in frequency than the millimeter wave band, or which is higher in frequency than the millimeter wave band. The radio frequency member may be used to propagate an electromagnetic wave of the terahertz wave band (i.e., approximately from 300 GHz to 3 THz), for example. Without being limited to WRG applications, the radio frequency member may be broadly used in applications where an artificial magnetic conductor is utilized which is structured so that a plurality of electrically conductive rods are arrayed therein. In the present specification, "Waffle Iron structure" means a structure in which a plurality of electronically conductive rods are arrayed on an electrically conductive member and which has a radio frequency confinement function.

Figure 1B:
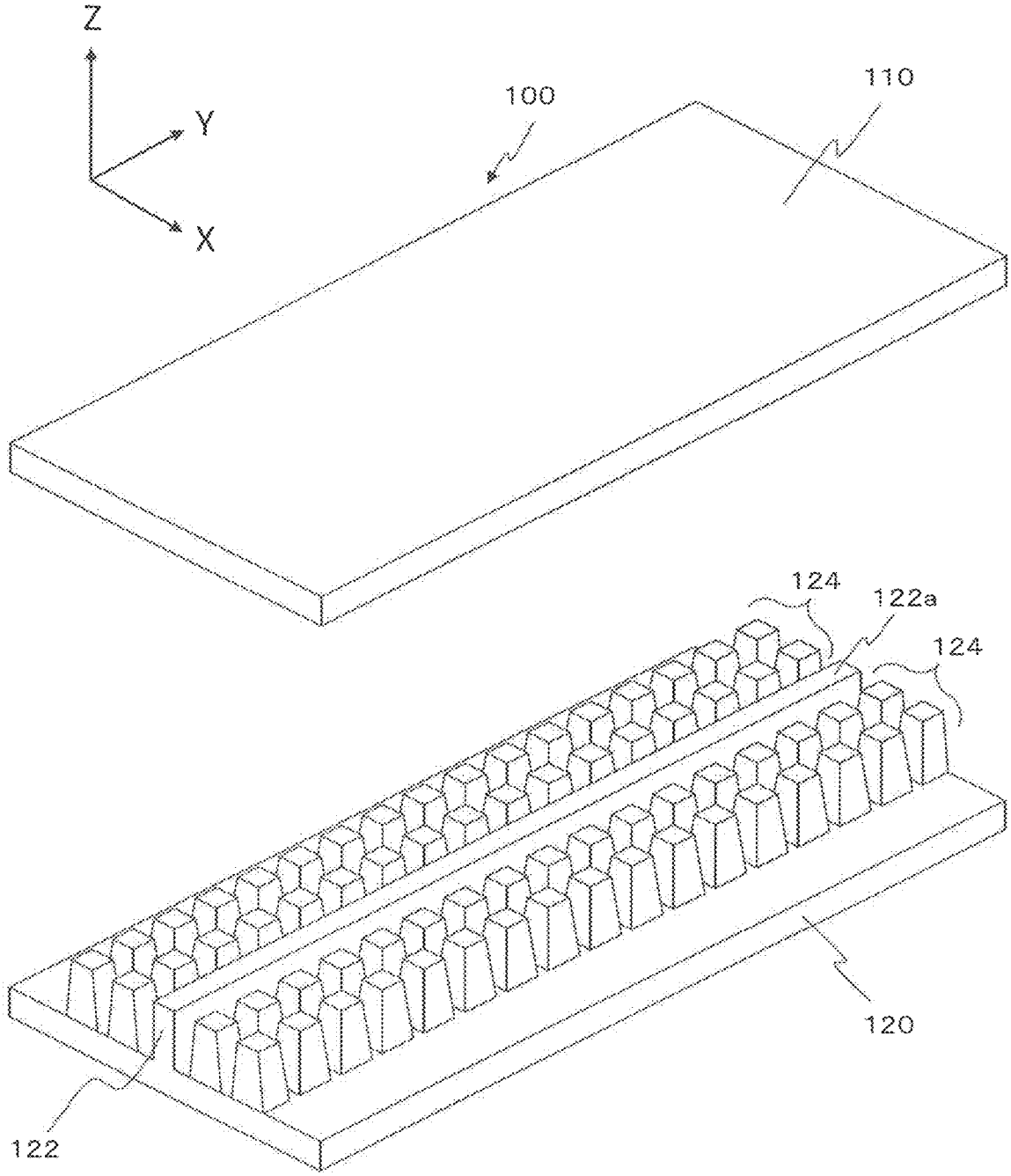
FIG. 1B is another perspective view schematically showing the construction of the waveguide device 100.

FIG. 1B is a perspective view schematically showing a waveguide device 100, illustrated so that the spacing between the first conductive member 110 and the second conductive member 120 is exaggerated for ease of understanding. In the actual waveguide device 100, as shown in FIG. 1A, the spacing between the first conductive member 110 and the second conductive member 120 is narrow. The first conductive member 110 is disposed so as to cover over all conductive rods 124 on the second conductive member 120. Although an example is illustrated herein where a waveguide member 122 is provided between two rows of conductive rods 124 on one side and two rows of conductive rods 124 on the other side, the number of rows is not limited to two on either side. The number of rows of conductive rods 124 may be three or more, or may only be one in some cases.

Figure 2A:
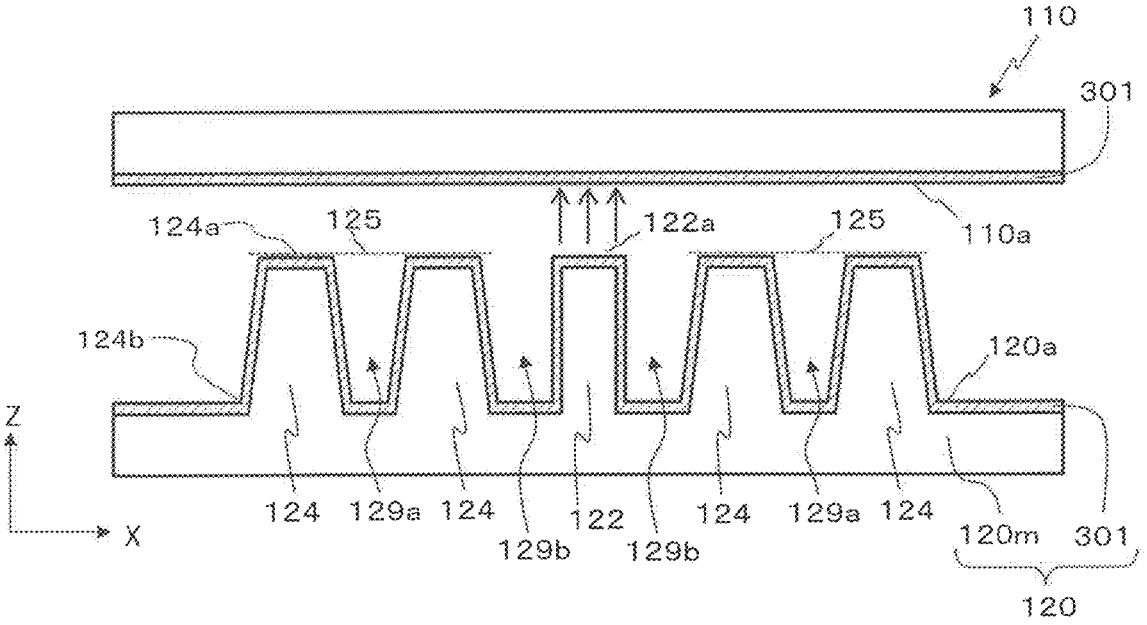
FIG. 2A is a diagram schematically showing an example construction of a cross section of the waveguide device 100 of FIG. 1 that is parallel to the XZ plane.

FIG. 2A is a diagram schematically showing the construction of a cross section of the waveguide device 100 in FIG. 1, taken parallel to the XZ plane. As shown in FIG. 2A, the first conductive member 110 has an electrically conductive surface 110*a* on the side facing the second conductive member 120. The conductive surface 110*a* has a two-dimensional expanse along a plane which is orthogonal to the axial direction (i.e., the Z direction) of the conductive rods 124 (i.e., a plane which is parallel to the XY plane). Although the conductive surface 110*a* is shown to be a smooth plane in this example, the conductive surface 110*a* does not need to be a plane, as will be described later.

The plurality of conductive rods 124 arrayed on the second conductive member 120 each have a leading end 124*a* opposing the conductive surface 110*a*. In the example shown in the figure, the leading ends 124*a* of the plurality of conductive rods 124 are on the same plane. This plane defines the surface 125 of an artificial magnetic conductor. Each conductive rod 124 does not need to be entirely electrically conductive, so long as at least the surface (the upper face and the side surface) of the rod-like structure is electrically conductive. In this example, a plating layer 301 is formed on the surface (which may be referred to as the "main surface") of an intermediate work 120*m* being made of a resin and having a plurality of rods 124 thereon, whereby electrical conductivity has been conferred to the surface of each rod 124.

Each rod according to the present disclosure typically has a columnar or rod-like structure that is solid, but it is not limited to such structures. Each rod may have a block shape whose height is smaller than whose width.

In the present specification, an "intermediate work" is meant as a work which is created during a production step of the radio frequency member. A method of producing a radio frequency member according to an example embodiment of the present disclosure includes a step of providing an intermediate work, and a step of immersing at least a portion of the intermediate work in a plating solution to form an electrically-conductive plating layer. The intermediate work has a main surface which is shaped as a plane or a curved surface and a plurality of rods extending away from the main surface. In a step of forming the plating layer, an electrically-conductive plating layer is formed on the main surface of the intermediate work and the surface of the plurality of rods. The intermediate work has a plate shape or a block shape. In the present example embodiment, the interval between the side surface of one of the plurality of rods and the side surface of another rod that is adjacent to the one rod monotonically increases away from the main surface. Such a structure provides an effect in that air voids are easier to be removed in a step of forming the plating layer, as will be described later.

In this example, the resin composing the intermediate work 120*m* is a PC/ABS resin. Herein, a PC/ABS resin means a mixture of polycarbonate and acrylonitrile butadiene styrene. For example, by using an injection molding technique, a PC/ABS resin can be molded into the shape of the intermediate work 120*m*.

The raw material for the intermediate work is not limited to a PC/ABS resin; various resins that permit plating treatment can be used. Moreover, a resin which is mainly polycarbonate, without being mixed with acrylonitrile butadiene styrene, may also be used. Otherwise, resins that permit plating treatment, e.g., engineering plastics such as polyphenylene sulfide resin, polybutylene terephthalate resin, and syndiotactic polystyrene resin (or "SPS resin"), may broadly be used as the raw material. Alternatively, a thermosetting resin such as a phenol resin may be used.

As the molding method, an injection molding technique is suitable for mass production; however, a cutting process may be applied to a raw material in plate or block form in order to process the respective features of the intermediate work into shape.

The second conductive member 120 includes the intermediate work 120*m* and the plating layer 301. In this example, the plating layer 301 extends only on a face 120*a* of the second conductive member 120 that is closer to the first conductive member 110. Alternatively, it may extend over the entire face. The surfaces of adjacent conductive rods 124 are interconnected via a conductor. In the example of FIG. 2A, where the plating layer 301 extends across the entire face 120*a*, the plating layer 301 serves to interconnect the surfaces of the conductive rods 124. The face 120*a* having the plating layer 301 formed thereon can also be regarded as a conductive surface. For the sake of distinction from the conductive surface 110*a* of the first conductive member 110, the face 120*a* may be referred to as the second conductive surface 120*a*; the face 120*a* may also be referred to as the main surface 120*a*; the conductive surface 110*a* may also be referred to as the first conductive surface 110*a*. Note that the second conductive surface 120*a* refers to a portion of the face of the second conductive member 120 (on which the plating layer 301 is formed) that opposes the first conductive surface 110*a*. The side surfaces and upper faces of the conductive rods 124 and the waveguide member 122 are not to be regarded as part of the second conductive surface 120*a*.

On the second conductive member 120, the ridge-like waveguide member 122 is provided among the plurality of conductive rods 124. More specifically, stretches of an artificial magnetic conductor are present on both sides of the waveguide member 122, such that the waveguide member 122 is sandwiched between the stretches of artificial magnetic conductor on both sides. As can be seen from FIG. 1B, the waveguide member 122 in this example is supported on the second conductive member 120, and extends linearly along the Y direction. In the example shown in the figure, the waveguide member 122 has substantially the same height and width as those of the conductive rods 124. As will be described later, however, the height and width of the waveguide member 122 may be different from those of the conductive rod 124. Unlike the conductive rods 124, the waveguide member 122 extends along a direction (which in this example is the Y direction) in which to guide electromagnetic waves along the conductive surface 110*a*. Similarly, the waveguide member 122 does not need to be entirely electrically conductive, but may at least include an electrically conductive waveguide face 122*a* opposing the first conductive surface 110*a* of the conductive member 110. In this example, the waveguide member 122 is a convex streak forming a portion of the intermediate work 120*m*, with the plating layer 301 being formed on its surface.

Thus, the intermediate work according to the present example embodiment has a ridge extending along the main surface. On its apex, the ridge has a flat upper face of a stripe shape. Side faces of the ridge are surrounded by at least some of the plurality of rods. The distance between the side surface of the ridge and the side surface of each of the rods which surround the side surface of the ridge monotonically increases away from the main surface.

In the present specification, a "stripe shape" means a shape which is defined by a single stripe, rather than a shape constituted by stripes. Not only shapes that extend linearly in one direction, but also any shape that bends or branches along the way is also encompassed by a "stripe shape". Even in the case where the waveguide face 122*a* has any portion that undergoes a change in height or width, the shape falls under the meaning of "stripe shape" so long as it includes a portion that extends in one direction as viewed from the normal direction of the waveguide face 122*a*.

On both sides of the waveguide member 122, the space between the surface 125 of each stretch of artificial magnetic conductor and the conductive surface 110*a* of the first conductive member 110 does not allow an electromagnetic wave of any frequency that is within a specific frequency band to propagate. This frequency band is called a "prohibited band". In the waveguide device according to the present disclosure, the artificial magnetic conductor is realized by an array of the plurality of conductive rods 124 and the conductive surface 110*a* being opposed to the leading ends of the conductive rods 124 via a gap. The artificial magnetic conductor is designed so that the frequency of an electromagnetic wave (signal wave) to propagate in the waveguide device 100 (which may hereinafter be referred to as the "operating frequency") is contained in the prohibited band. The prohibited band may be adjusted based on the following: the height of the conductive rods 124, i.e., the depth of each groove formed between adjacent conductive rods 124; the width of each conductive rod 124; the interval between conductive rods 124; and the size of the gap between the leading end 124*a* and the conductive surface 110*a* of each conductive rod 124.

With the above structure, along a waveguide (ridge waveguide) extending between the conductive surface 110*a* of the first conductive member 110 and the waveguide face 122*a*, a signal wave is allowed to propagate. Such a ridge waveguide may be referred to as a WRG, as was mentioned earlier.

In the example shown in FIG. 2A, each conductive rod 124 has a gradually-pointed shape such that its width or diameter decreases from a root 124*b* toward the leading end 124*a* thereof. Conversely, a gap 129*a*, which is a space between two adjacent conductive rods 124, enlarges from the root 124*b* toward the leading end 124*a*, i.e., away from the main surface 120*a*. In this example, the width (i.e., the dimension along the X direction) of the waveguide member 122 is constant. However, since any conductive rod 124 located next to the waveguide member 122 has a gradually-pointed shape, a gap 129*b* between the waveguide member 122 and that conductive rod 124 also enlarges from the root 124*b* toward the leading end 124*a* of the conductive rod 124.

Figure 2B:
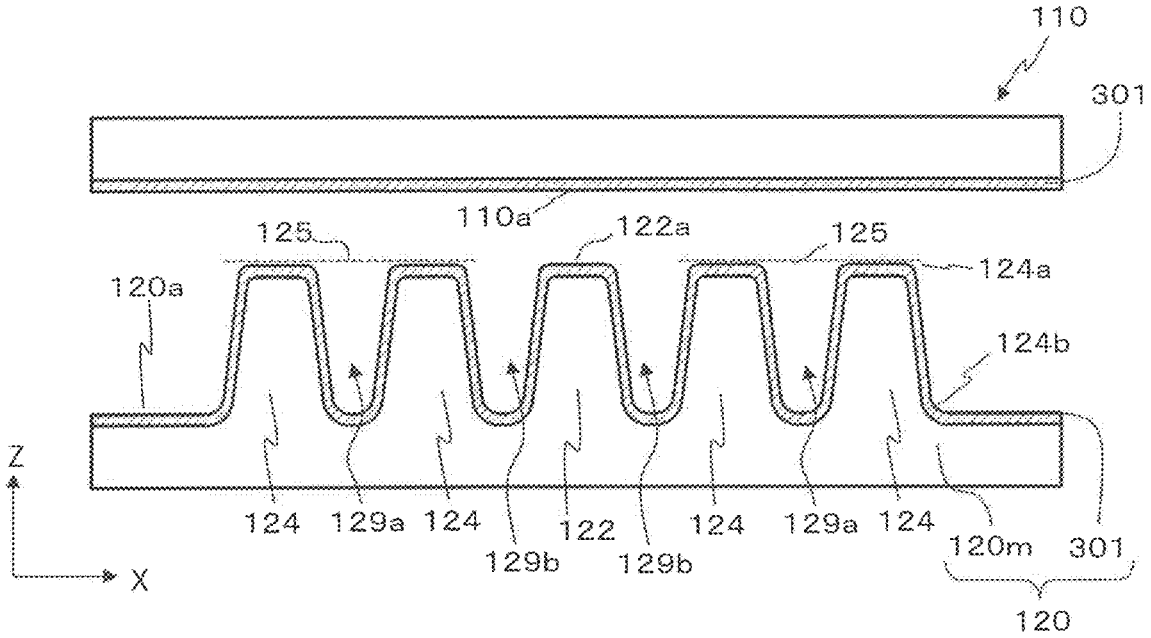
FIG. 2B is a diagram schematically showing another example construction of a cross section of the waveguide device 100 that is parallel to the XZ plane.

FIG. 2B is a diagram schematically showing another example construction of a cross section of the waveguide device 100 that is parallel to the XZ plane. In this example, not only the conductive rods 124 but also the waveguide member 122 has a gradually-pointed cross-sectional shape. The gap 129*a* between two adjacent conductive rods 124 and the gap 129*b* between the waveguide member 122 and any adjacent conductive rod 124 both enlarge from the root 124*b* toward the leading end 124*a* of the conductive rod 124. The side surface of the root 124*b* of the conductive rod 124 connects to the second conductive surface 120*a* via a curved surface. As for the waveguide member 122, too, the side surface of its root 124*b* connects to the second conductive surface 120*a* via a curved surface. This curved surface connects to the curved surface of the root of an adjacent conductive rod 124 or of the waveguide member 122. Therefore, a concave surface lies between adjacent conductive rods 124 and between the waveguide member 122 and any adjacent conductive rod 124, without a flat portion. However, such concave surfaces are opposed to the first conductive surface 110*a*, and constitute portions of the main surface 120*a* (second conductive surface). Adopting such a shape for the root 124*b* of each conductive rod 124 will improve the quality of the plating layer 301 to be formed on the intermediate work 120*m* in a subsequently-described plating step.

In the example of FIG. 2B, the leading-end face and the side surface of each conductive rod 124 are connected via a curved surface. However, the radius of curvature of the curved surface is smaller than the radius of curvature of the curved surface that connects between the root 124*b* and the main surface 120*a*. As in the example of FIG. 2A or FIG. 2C (which will be described later), this portion may be a corner rather than a curved surface.

Figure 2C:
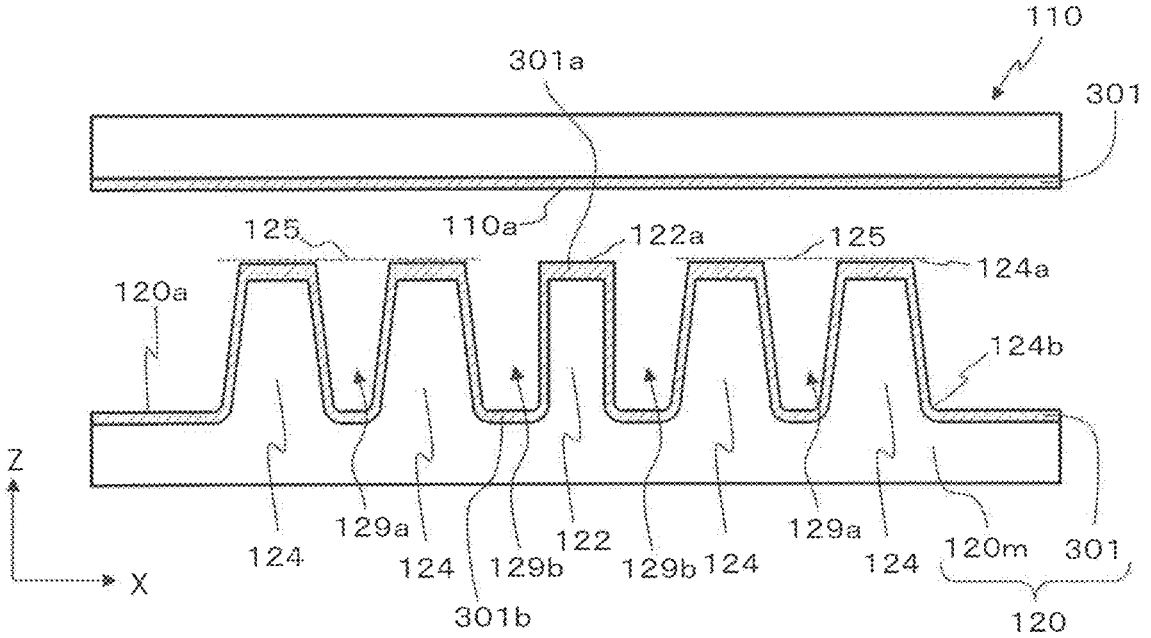
FIG. 2C is a diagram schematically showing still another example construction of a cross section of the waveguide device 100 that is parallel to the XZ plane.

FIG. 2C is a diagram schematically showing still another example construction of a cross section of the waveguide device 100 that is parallel to the XZ plane. In this example, the side surface of the root 124*b* of each conductive rod 124 connects to the second conductive surface 120*a* via a curved surface. As for the waveguide member 122, too, the side surface of its root 124*b* connects to the second conductive surface 120*a* via a curved surface. However, unlike in the example of FIG. 2B, a flat portion exists between adjacent conductive rods 124, and between the waveguide member 122 and any adjacent conductive rod 124. In the example of FIG. 2B, the radius of curvature of the curved surface of the root is a half of an interval between the roots 124*b* of adjacent conductive rods 124. On the other hand, in the example of FIG. 2C, this radius of curvature is less than a half of the interval between the roots 124*b* of adjacent conductive rods 124. Other shapes, e.g., the shape of the leading end 124*a* of each conductive rod 124 and the shape of the waveguide member 122, are identical to those in the example of FIG. 2A. Moreover, the gap 129*a* between adjacent conductive rods 124 and the gap 129*b* between the waveguide member 122 and any adjacent conductive rod 124 both enlarge from the root 124*b* toward the leading end 124*a* of the conductive rod 124. This aspect is also similar to the example of FIG. 2A.

In the examples of FIG. 2B and FIG. 2C, each of the plurality of rods of the intermediate work 120*m* has a flat upper face; however, at the root of each rod, its side surface is connected to the main surface via a first curved surface. The radius of curvature of the first curved surface is greater than the radius of curvature of a portion at which the upper face of each of the plurality of rods connects to the side surface. Furthermore, at its root, the side surface of the ridge on the intermediate work 120*m* connects to the main surface via a second curved surface. The radius of curvature of the second curved surface is greater than the radius of curvature of a portion at which the upper face of the ridge connects to the side surface of the ridge.

In the second conductive member 120 according to the present disclosure, the height of each conductive rod 124, the arraying pitch of the conductive rods 124 (i.e., the distance between the centers of adjacent conductive rods), and the height of the waveguide member 122 may be set to appropriate values depending on the application. For example, the height of the conductive rods 124 may be set to 1 mm; the arraying pitch of the conductive rods 124 may also be set to 1 mm; and the height of the waveguide member 122 may also be set to 1 mm. In the case of using the radio frequency member 120 having a structure of this size to construct a WRG waveguide device, or a radio frequency confinement device based on a waffle iron structure, the radio frequencies to be handled by such a device may be e.g. 70 GHz or more but less than 80 GHz. Depending on the application, frequencies which are considerably deviated from this frequency band may also be used.

A current to be induced in an electrical conductor by a radio wave of a frequency above 70 GHz will only exist in a range of less than 0.5 μm from the conductor surface. Accordingly, the thickness of the plating layer 301 may at least be 0.5 μm or more. However, such a thin plating layer may be disrupted by even a slight scratch or scrape in the surface of the work. The waveguide face 122*a*, which is an upper face of the waveguide member 122, is where an electric current concentrates; if the plating layer 301*a* in this portion becomes disrupted, functionality as a WRG waveguide will be lost. On the other hand, the plating layer 301*b* between the root of the waveguide member 122 and the root 124*b* of any adjacent conductive rod 124 will have hardly any current flowing therein, and is structurally a recess. Therefore, the plating layer 301*b* is unlikely to be scratched or scraped through collision with other members, etc. Therefore, the thickness of the plating layer 301*a* covering the upper face of the waveguide member 122 may be greater than that of the plating layer 301*b* existing between the root of the waveguide member 122 and the root 124*b* of any adjacent conductive rod. The thickness of the plating layer 301 may be e.g. 10 μm or more. Even if the plating layer 301 is so thick, functionality as a radio frequency member will be achieved. However, the thicker the plating layer is, the higher the production cost will be. Therefore, in the absence of some particular needs, the thickness of the plating layer may be set to e.g. 10 μm or less.

Thus, the step of forming the plating layer 301 may involve forming the electrically-conductive plating layer 301 on the side surface and upper face of the ridge of the intermediate work. Since the plating layer 301*a* covering the upper face of the ridge is a portion where a current of the highest density flows when an electromagnetic wave propagates in the WRG waveguide, and therefore it is not desirable for plating defects to occur there. While defects in the plating layer 301*b* covering the main surface of the intermediate work would also be undesirable, defects in the plating layer 301*a* covering the upper face of the ridge will exert greater influences. Such situations can be made less likely to occur by adopting a thick plating layer 301*a* on the upper face of the ridge. Note that such effects can also be attained even without selecting a gradually-pointed shape for the shapes of the ridge and conductive rods. Therefore, even when adopting a structure where the ridge and conductive rods have a constant width, the plating layer on the upper face of the ridge may be made thicker than the plating layer covering the main surface of the intermediate work.

In the radio frequency member (second conductive member 120) according to an example embodiment of the present disclosure as described with reference to FIG. 1A, FIG. 1B, FIG. 2A, FIG. 2B, and FIG. 2C, the plating layer 301 is formed on the surface of the intermediate work 120*m*. Typical dimensions of the respective features are as described above, and the thickness of the plating layer 301 to be formed over the surface is e.g. 10 μm or less. In order to obtain a radio frequency member which is configured as described above, an intermediate work which is similarly configured in shape to the above is provided. In other words, in order to form a plurality of conductive rods of gradually-pointed shape, the intermediate work shall include a plurality of rods of gradually-pointed shape. In order to form a ridge-like waveguide member, the intermediate work shall include a ridge. In the case where the roots of the conductive rods are continuous with the conductive surface via a curved surface, the rods of the intermediate work shall be configured in a similar manner.

In known literature, the width or diameter of each conductive rod composing such a ridge waveguide is constant from the root to the leading end of the rod. Alternatively, each conductive rod has a shape with increasing width or diameter from the root toward the leading end, or a mushroom shape (see WO2013/189919, or E. Rajo-Iglesias and P.-S. Kildal, "Numerical studies of bandwidth of parallel-plate cut-off realized by a bed of nails, corrugations and mushroom-type electromagnetic bandgap for use in gap waveguides", IET Microw. Antennas Propag., 2011, Vol. 5, Iss. 3, pp. 282-289). On the other hand, as has been indicated with FIG. 2A, FIG. 2B, and FIG. 2C, in the radio frequency member according to the present disclosure, the width or diameter of each conductive rod decreases from the root toward the leading end. As for the ridge-like waveguide member, its width may be constant from the root to the upper end face, but alternatively it may have a shape with decreasing width from the root toward the upper end face, similarly to the conductive rods.

Although the radio frequency member in each of the above examples is shown to include the waveguide member 122, a radio frequency member lacking the waveguide member 122 may also be constructed. Such a radio frequency member may be a member that realizes an artificial magnetic conductor including an array of the plurality of conductive rods 124, for example. An intermediate work to be used in producing such a radio frequency member shall include a plurality of rods, but no ridge. Thus, in the intermediate work, the ridge is not an essential component element.

<Plating Step>

A production method for a conductive member according to an example embodiment of the present disclosure includes a step of providing an intermediate work having a shape as aforementioned, and a step of subjecting the intermediate work to a plating treatment to form a layer of electrical conductor on its surface. Hereinafter, an example plating treatment step according to the present disclosure will be described.

Figure 3A:
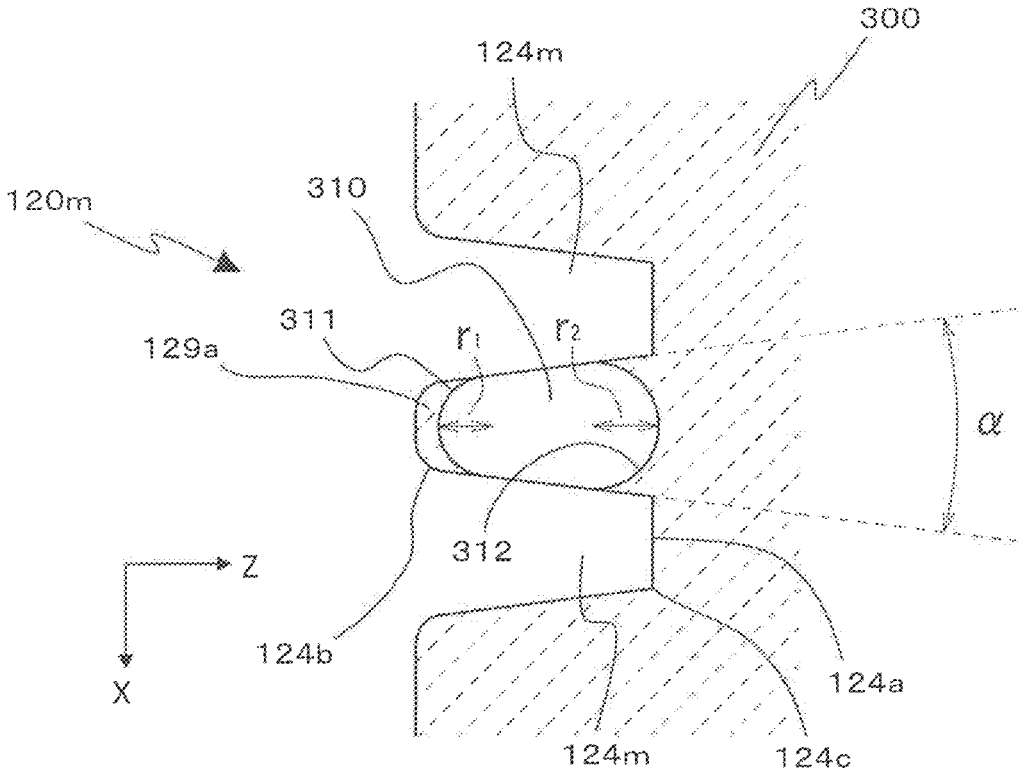
FIG. 3A is a diagram schematically showing how an air void may exist between rods when an intermediate work according to an example embodiment of the present disclosure is immersed in a plating solution.
Figure 3B:
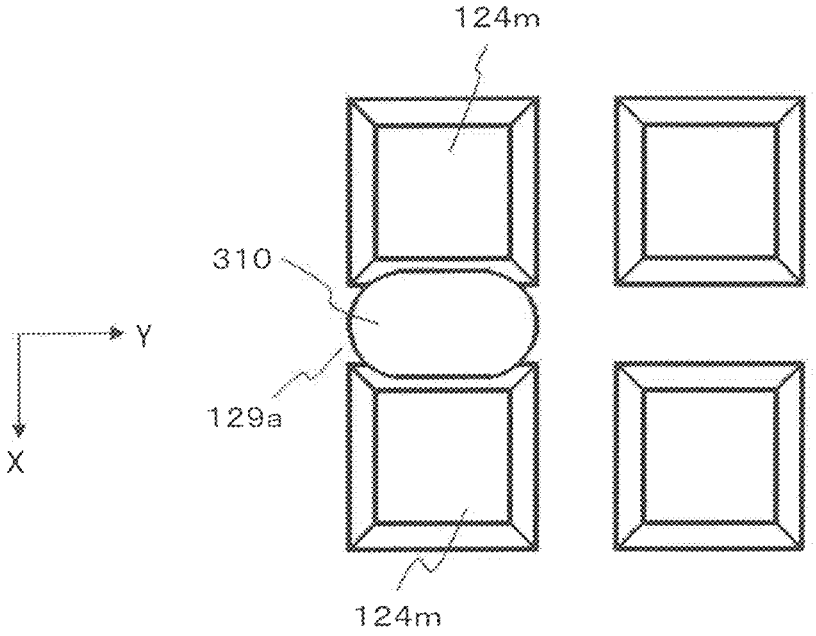
FIG. 3B is a diagram showing how the air void between rods in FIG. 3A may be situated, as viewed from the Z direction.

FIG. 3A is a diagram schematically showing the intermediate work 120*m* being immersed in a plating solution. FIG. 3B is a diagram showing the intermediate work 120*m* in FIG. 3A as viewed from the Z direction. The intermediate work 120*m* in this example is made of a PC/ABS resin. After cleaning and etching, the intermediate work 120*m* is subjected to a treatment of introducing catalytic particles of e.g. palladium (Pd) onto the resin surface. Thereafter, the intermediate work 120*m* is immersed in an electroless plating solution. Through preprocessing, a multitude of minute recesses have been formed in the surface of the intermediate work 120*m*; however, they are minute enough to be omitted from illustration. Through preprocess, the surface of the intermediate work 120*m* has been activated, and thus has acquired an improved wettability with respect to the plating solution.

Generally speaking, water or an aqueous solution does not exhibit a very high wettability with respect to resin materials. In the case where the work to be plated is made of a resin, air voids are likely to remain on the surface of the work even after immersion in a plating solution. In order to improve wettability, it is commonplace to add a surfactant to the plating solution or to a solution used in the preprocesses. Moreover, since a plating treatment generally involves a reduction reaction in an aqueous solution, a hydrogen gas is likely to be generated during the process. In other words, even if a state where the work surface is covered with the plating solution is once attained, locations may still emerge where the plating solution is not in contact with the work surface because of air voids (e.g., hydrogen gas) that may occur during the subsequent plating treatment may adhere. Irrespective of whether the air voids contain air or hydrogen, a plating layer is unlikely to be formed at locations where air voids have adhered, possibly causing defects in the plating layer. Such defects are less likely to occur when the plating solution has a high wettability with respect to the surface of the work. However, even with an improved wettability, air voids 310 may still remain between the rods 124*m*, because the intermediate work 120*m* according to the present disclosure is configured with the plurality of rods 124*m* being provided on the work surface. FIG. 3A illustrates such a state. However, as will be described below, the character of the shape of the intermediate work 120*m* according to the present disclosure makes it easier for air voids to be discharged. In the example of FIG. 3A, the entire intermediate work 120*m* has a plate shape as a whole, with the rods 124*m* being disposed on one of its faces. Furthermore, the intermediate work 120*m* of plate shape is immersed in the plating solution 300 with an attitude such that its plate plane extends along the vertical direction.

The gap 129*a* between adjacent rods 124*m* is configured so as to enlarge from the root 124*b* toward the leading end 124*a* of the rods 124*m*, by an angle whose size is denoted as α in FIG. 3A. With the gap 129*a* between rods being so configured, an air void 310 that is trapped in the gap 129*a* should vary in width between the root 124*b* side and the leading end 124*a* side of the rods 124*m*. In a portion where it is not in contact with any other member or another air void, the air void 310 creates a meniscus as it tries to resemble a spherical shape, due to surface tension of the plating solution 300. Because of the varying width of the air void 310, a radius r1 of the meniscus 311 at the root 124*b* side of the rods 124*m* is smaller than a radius r2 of the meniscus 312 at the leading end 124*a* side of the rods 124*m*.

It is known that, given a magnitude σ of surface tension, the internal pressure of an air void with a radius r becomes higher by 2σ/r than that of the surroundings. This is because the gaseous body inside the air void becomes compressed due to surface tension. In the example of FIG. 3A, the radius r1 of the meniscus 311 is smaller than the radius r2 of the meniscus 312; therefore, the pressure difference that the meniscus creates with the surroundings is greater for the meniscus 311 on the root 124*b* side. Therefore, a force that presses outward of the gap 129*a* between rods acts on the meniscus 312 at the leading end 124*a* side. As the meniscus 312 moves toward the outside, the meniscus 311 will also move toward the outside accordingly. Even after this move, the meniscus-created pressure is still greater with the inner meniscus 311. This state continues until the entire air void 310 is extruded from the gap 129*a* between rods. Thus, upon immersion of the intermediate work 120*m* in the plating solution 300, or as the air void 310 somehow becomes trapped in the gap 129*a* between rods after immersion, the air void 310 is likely to be discharged with surface tension effects. This is owing to the shape of the gap 129*a* between rods that enlarges toward the rod leading end 124*a* by the angle α.

When the intermediate work 120*m* in FIG. 3A is molded by injection molding, any parting line will be located at an edge 124*c* between the side surface and the upper end face of the rod 124*m*. In this case, microscopically, the edge 124*c* is sharper in shape. Air voids in the plating solution 300 are unlikely to adhere to locations of such sharp shape. Therefore, defects are less likely to occur in the plating layer near the leading ends of the rods 124*m*. Similar effects can also be obtained for the waveguide member 122 (which may hereinafter be also referred to as the ridge 122) shown in FIG. 2A and the like. In other words, by allowing any parting line to be located at an edge between the upper face and the side surface of the ridge 122, defects become less likely to occur in the plating layer near the upper face of the ridge.

Figure 4:
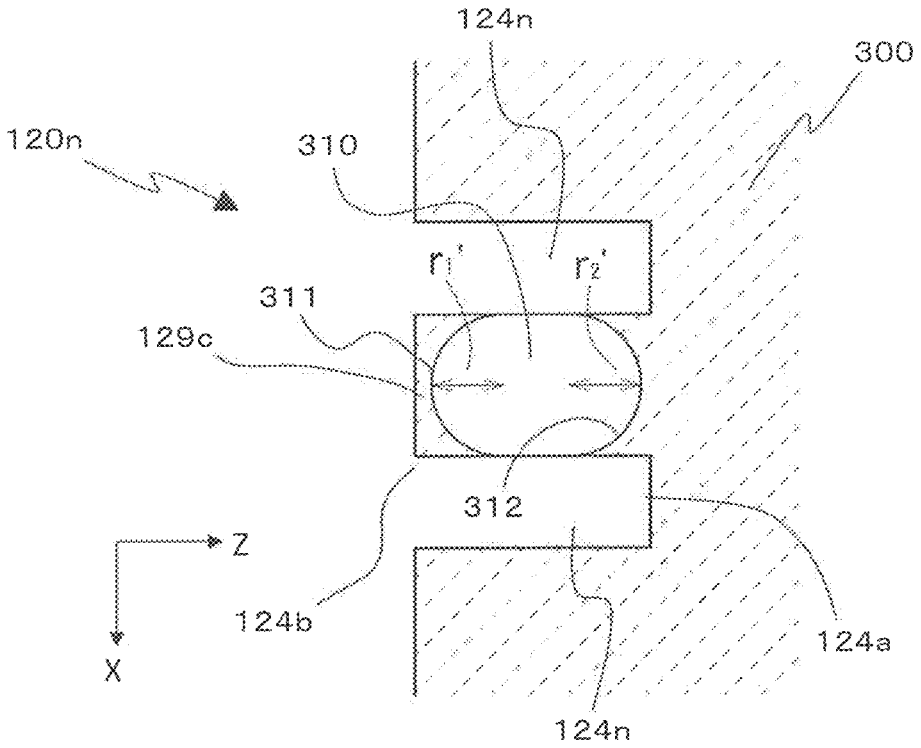
FIG. 4 is a diagram schematically showing an air void between rods when an intermediate work is immersed in a plating solution according to Comparative Example of the present disclosure.

FIG. 4 is a diagram schematically showing an intermediate work 120*n* having rods 124*n* with a constant width, being immersed in a plating solution 300. A radio frequency member which is obtained by subjecting such an intermediate work 120*n* to plating is conventionally known, in terms of shape. When the intermediate work 120*n* having a similar shape is subjected to plating in order to produce a radio frequency member of the conventionally-known shape, the intermediate work 120*n* immersed in the plating solution 300 will presumably be in a situation as illustrated in this figure. Similarly to the case of FIG. 3A, the intermediate work 120*n* has a plate shape as a whole, and is immersed in the plating solution 300 with an attitude such that its plate plane extends along the vertical direction. In FIG. 4, the gap 129*c* between adjacent rods 124*n* is constant from the root 124*b* to the leading end 124*a* of the rods. In other words, the radius r1' of the meniscus 311 and the radius r2' of the meniscus 312 are equal. Therefore, the pressure differences created by the respective meniscuses are also equal. Thus, unlike in the example embodiment shown in 3A, there is no force acting to discharge the air void 310 from the gap 129*c*. As a result, when the intermediate work is subjected to plating to obtain a radio frequency member of the conventionally-known shape, defects are likely to occur in the plating layer.

In the examples shown in FIG. 3A and FIG. 4, the gap 129*a*, 129*c* between rods 124*m*, 124*n* is open in the Z direction, which is the horizontal direction. In this state, the buoyancy acting from the plating solution 300 on the air void 310 does not work in the direction of discharging the air void 310 out of the gap 129*a*, 129*c*. If the intermediate work 120*n* were to be rotated by 90 degrees so that the gap 129*c* opened vertically upward (i.e., in the −X direction in the figure), the buoyancy acting on the air void 310 would be in a direction of discharging the air void 310 from the gap 129*c*. However, even in such a state, the air void 310 trapped in the gap 129*c* often fails to be discharged. In the case of FIG. 4, the gap 129*c* has a width of 0.5 mm; when an air void is trapped in such a small gap, the air void itself must be small. As the air void becomes smaller, the surface tension, or the adsorption force with the work surface, will exert a greater influence on the behavior of the air void. The fact that an air void becomes trapped in a narrow gap indicates that the influence of surface tension or adsorption force is already dominant; even if buoyancy is at work in such a state, the air void may not necessarily be discharged. Thus, as in the example embodiment shown in FIG. 3A, it is effective to promote discharging of air voids on the basis of surface tension, by adopting a gradually-pointed shape as the rod shape on the intermediate work 120*m*.

The condition for effectively obtaining the air void discharging effect based on surface tension is quite subject to the composition and temperature of the plating solution, the material of the intermediate work, and the methods of preprocessing such as etching. However, discharging of air voids on the basis of surface tension is likely to be effective in regions where the gap between rods is 2 mm or less. Moreover, the angle α in FIG. 3A is likely to be effective when it is 1 degree or greater. Although an air void becoming trapped in a gap between two adjacent rods has been described with reference to FIG. 3A, a similar effect can also be expected between the ridge-like waveguide member and adjacent conductive rods. The reason is that, as shown in FIG. 2A, FIG. 2B and FIG. 2C, the gap 129*b* between the ridge-like waveguide member 122 and any conductive rod 124 also has a shape that enlarges from the root 124*b* toward the leading end 124*a* of the conductive rod 124. In the respective examples, the gap between the ridge and the rods will also be similarly configured on the intermediate work 120*m*, and during a plating treatment, similar air void discharging effects to the effects which were described with reference to FIG. 3A will be attained.

In the intermediate work 120*m*, the interval between the side surface of one of the plurality of rods and the side surface of another rod that is adjacent to the one rod may be e.g. less than 2 mm. Herein, an interval between two rods means the interval between their leading ends, where the broadest interval exists. In order to enhance the air void discharging effect, the intermediate work 120*m* may be placed with an attitude such that, when immersed in the plating solution 300, the main surface extends in a direction which is parallel to the direction of gravity or which forms an angle of 45 degrees or smaller with the direction of gravity.

In the production method according to the present disclosure, various methods may be chosen as the plating method, depending on the application. For example, as an electroless plating, electroless copper plating may be selected. In one instance, a plating solution for effecting such electroless copper plating contains copper sulfate, tetrasodium ethylenediamine tetraacetate, formaldehyde, and polyoxyethylene dodecyl thioether in appropriate amounts. When performing a plating treatment, the temperature of the plating solution is maintained around 75° C. Electroless plating may be performed by using a plating solution of other compositions. After a method such as electroless plating is used to confer electrical conductivity to the surface of the intermediate work, an electrolytic plating such as electrolytic nickel plating may be performed. In one instance, the plating solution for effecting electrolytic nickel plating contains nickel sulfate, boric acid, and ammonium chloride in appropriate amounts. In the plating treatment, the temperature of the plating solution is maintained at 20 to 30° C. The current density on the intermediate work to be plated is adjusted to a value of e.g. 0.8 to 1.0 A/dm$^2$. When performing electrolytic plating, too, the air void discharging function that has been described with reference to FIG. 3A acts effectively. Therefore, when producing a radio frequency member based on an intermediate work which is configured as described in the present disclosure, defects will be suppressed even in a plating layer that is obtained through electrolytic plating.

<When Using Resin Material Having Glass Fiber Added Thereto>

Generally speaking, a resin is to be molded with various additives being added thereto. For example, in order to enhance the rigidity of the product, glass fiber, carbon fiber, or the like is added. In order to reduce the amount of expensive resin to be used, additives may added, e.g., a mineral such as silica or mica, or a carbonate such as calcium carbonate. In the production method according to the present disclosure, too, the resin to serve as the raw material may contain these additives (fillers). In particular, glass fiber provides the effect of enhancing rigidity of the radio frequency member as a product, and therefore may be added to the resin material. However, in the case where glass fiber is added to the resin material, care needs to be taken in the preprocess before the plating layer is formed.

In an etching step, the surface of the intermediate work is etched with a chemical, e.g., an acid, to increase surface roughness. Increased surface roughness will enhance the tightness of contact between the resin portion and the plating layer to be formed in a subsequent step. However, when glass fiber is added to the resin, after the etching process, the glass fiber will not dissolve but remain on the surface of the intermediate work. The plating solution has a low wettability on the surface of glass. Therefore, when glass fiber is abundantly left on the surface of the intermediate work, even if the intermediate work is immersed in the plating solution, the plating solution is unlikely to wet the surface of the intermediate work. In particular, air voids are likely to remain between rods. Moreover, a plating layer is in itself difficult to be formed on the surface of glass. For these reasons, when a resin containing glass fiber is selected, a homogeneous plating layer is unlikely to be formed.

One etching method for a resin that contains glass fiber is a method that uses hydrofluoric acid. When a polyphenylene sulfide resin having a high resistance against corrosion by chemicals is adopted, a method that uses hydrofluoric acid and nitric acid in combination is particularly effective. Since hydrofluoric acid will dissolve glass fiber, glass fiber is restrained from remaining on the surface of the intermediate work after etching. In this case, for example, a method may be used which first performs an etching with hydrofluoric acid and thereafter performs an etching with nitric acid. Otherwise, a method of etching with a mixed solution of hydrofluoric acid and nitric acid, a method that uses a mixture of a nitrate and a hydrofluoride, or the like may be employed. By adopting such etching methods, while increasing the surface roughness, glass fiber is restrained from remaining on the surface of the intermediate work, and the plating layer can achieve firm contact. In addition to glass fiber, a salt that dissolves in an acid may be added to the resin. Such a salt will dissolve during etching with the acid, thereby contributing to an enhanced surface roughness. As the acid-soluble salt, alkaline-earth metal carbonates can be used, for example, calcium carbonate being a representative substance among them. Etching methods using hydrofluoric acid are disclosed in the specification of U.S. Pat. No. 4,532,015, Japanese Patent Publication No. H2-217477, and the like, for example.

Note that an etching method that uses hydrofluoric acid and nitric acid in combination is not necessarily suitable as a method for producing microstrip lines, which have conventionally been used in producing a radio frequency circuit. An etching process that uses hydrofluoric acid and nitric acid in combination is a harsh process that may possibly cause excessively large rises and falls on the surface of the resin work to be plated. When a plating layer is formed on such a surface, although the surface of the plating layer as it is externally visible may be relatively smooth, the face of the plating layer that is on the resin side will have rugged rises and falls as it reflects the roughness of the surface of the resin work. In a microstrip line, a current flowing in the plating layer will mainly flow on the face of the plating layer that is on the resin side. When such rugged rises and falls are present on this face, electrical resistance will inevitably increase, so that the radio frequency signal propagating in the microstrip line will have a large decay.

However, the electrical resistance on the face of the plating layer that is on the resin side does not present a substantial problem in a device in which a radio frequency member that is produced by a production method according to the present disclosure is used, e.g., a WRG waveguide device or a device in which a plurality of conductive rods function as an artificial magnetic conductor. In these devices, in terms of operation principles, a current will flow not on the face of the plating layer that is on the resin side, but on the opposite, relatively smooth face of the plating layer that is on the surface side of the radio frequency member. Therefore, in a radio frequency member for constructing a WRG or the like, there will be little decrease in the performance of the radio frequency member that is ascribable to the use of a hydrofluoric acid in the etching process. On the other hand, the plating layer will attain firm contact with the resin work. Therefore, delamination of the plating layer is unlikely to occur even after temperature changes, and thus a highly-durable radio frequency member can be obtained. In reconciling the performance and durability of a radio frequency member, the shape of the rods or the ridge is not limited to the aforementioned shapes. In other words, even if the gap between adjacent rods is not configured so as to enlarge from the root toward the leading end, performance and durability can still be reconciled. So long as the plating solution can somehow be permeated among the rods, high durability will be exhibited by a radio frequency member having a plating layer which is obtained by an etching process that uses hydrofluoric acid.

<Production of Intermediate Work by Injection Molding>

The intermediate work 120*m* can be produced by various methods. As one instance, an example will be described where the intermediate work 120*m* is produced by injection molding.

Figure 5:
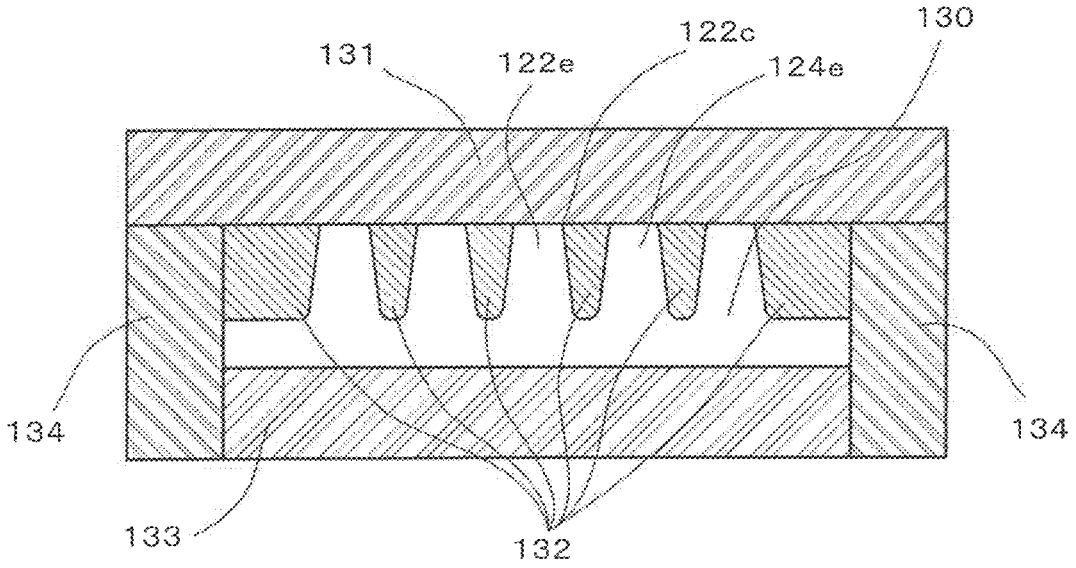
FIG. 5 is a diagram schematically showing dies used in producing an intermediate work according to an example embodiment of the present disclosure.

FIG. 5 is a diagram schematically showing example dies with which to mold the intermediate work 120*m*. In a hollow space 130 that is created by combining four dies 131, 132, 133 and 134, a resin material in a fluid state is injected and allowed to cure, whereby the intermediate work 120*m* is obtained. As for the types of resins, PC/ABS resins and the like can be used, as has already been described. A gate through which to inject the resin material is omitted from illustration in FIG. 5. Inside an outer-frame die 134 which defines the outer periphery, a side-face die(s) 132 and a bottom-face die 133 are placed. The side-face die(s) 132 has a block shape including through holes for forming the side faces of the rods and groove(s) for forming the side faces of the ridge. The inner widths of each hole and the groove(s) monotonically decrease away from the bottom-face die 133. The side-face die(s) 132 does not include portions for forming the upper faces of the rods and the upper end face of the ridge. Hollow-space portions 124*e* corresponding to the respective rods and a hollow-space portion 122*e* corresponding to the ridge have openings at their respective upper side. These openings are to be occluded by an end-face die(s) 131. An upper end 122*c* of the side surface of the hollow-space portion 122*e* corresponding to the ridge is in contact with the end-face die(s) 131. In an intermediate work 120*m* which is obtained by injecting a resin in the hollow space 130 and molding it, a minute convex streak, called a parting line, often occurs at a portion where the side surface of the ridge meets the upper face of the ridge.

When an intermediate work 120*m* is produced by using such a die, the resultant intermediate work 120*m* will have a clearly-defined corner shape at any edge portion where the upper face and the side surface of the ridge 122 meet. In a radio frequency member 120 that is produced by using such an intermediate work 120*m*, too, any edge portion will maintain a relatively clearly-defined corner shape. Thus, when the upper face of the waveguide member is flat and its edges are clearly defined, a WRG waveguide device which is made by using such a radio frequency member will permit a quick performance assessment through computer simulations. Therefore, when developing a WRG waveguide device according to any of various applications, its design can be made fast, and also its development cost can be reduced. Since the product cost during mass production will always include design cost, adopting a radio frequency member of which the upper face of the waveguide member has clearly-defined edges will also contribute to reduced product cost.

Thus, a step of providing an intermediate work in a method of producing a radio frequency member according to the present example embodiment involves providing a resin intermediate work through injection molding. The dies to be used in injection molding may include: one or more side-face dies defining an air gap having an inner peripheral surface of the same shape as the side surface of the ridge; and one or more end-face dies having a face of the same shape as the upper face of the ridge. The injection molding is performed while an end of the air gap defined by the side-face die(s) is occluded by the end-face die(s).

<Other Rod Shapes Suitable for Plating Treatment>

Figure 6A:
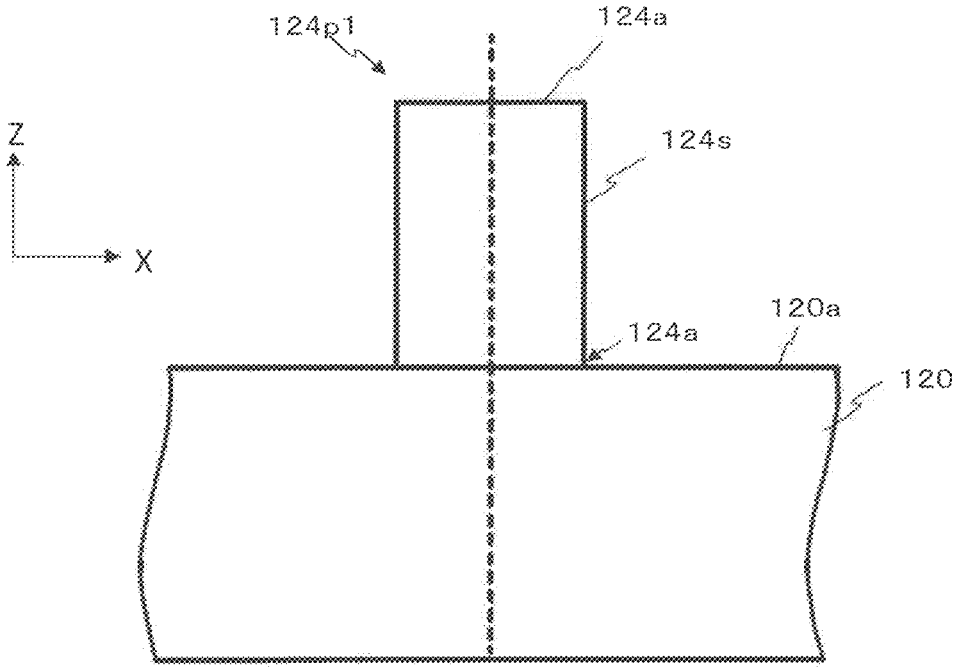
FIG. 6A is a cross-sectional view of a conductive rod 124 in still another example as taken in a plane that contains the axial direction (the Z direction).
Figure 6B:
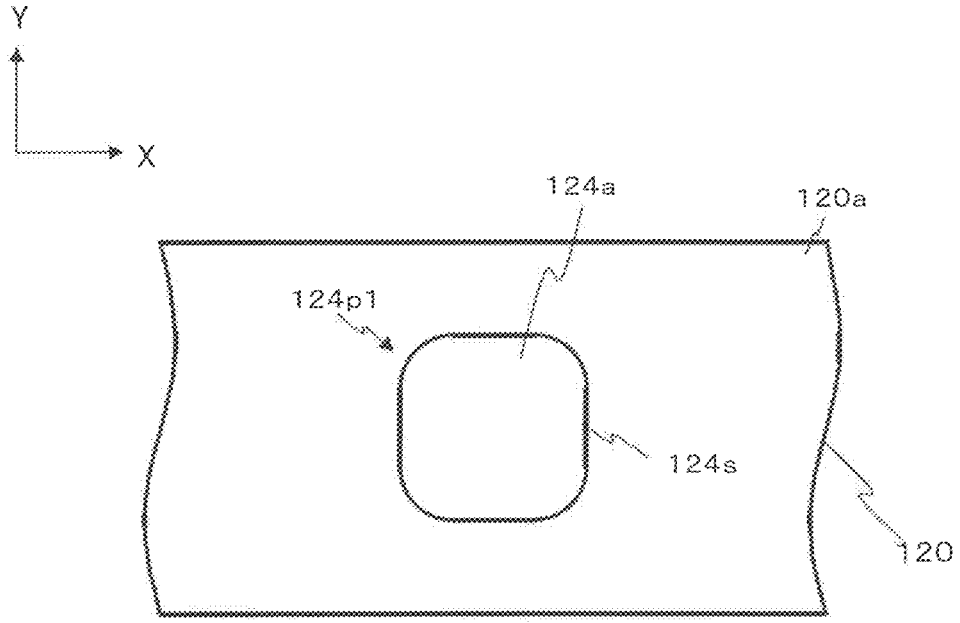
FIG. 6B is an upper plan view of the conductive rod 124 of FIG. 6A as viewed from the axial direction (the Z direction).
Figure 6C:
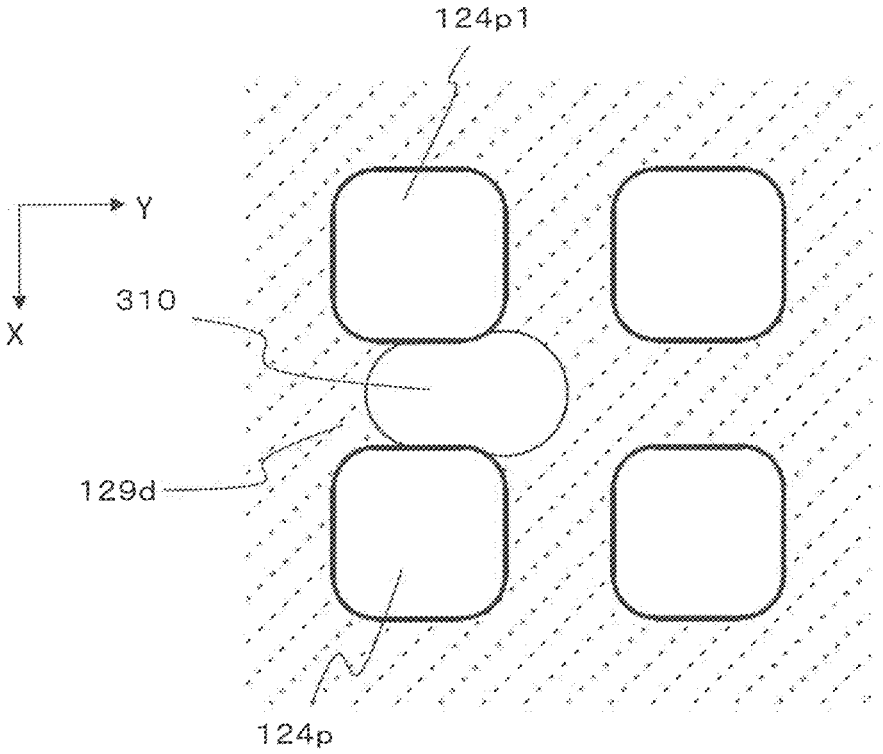
FIG. 6C is a diagram showing as viewed from the Z direction an air void between rods when the intermediate work of FIG. 6A is immersed in a plating solution, where the air void is going to but yet to be discharged.
Figure 6D:
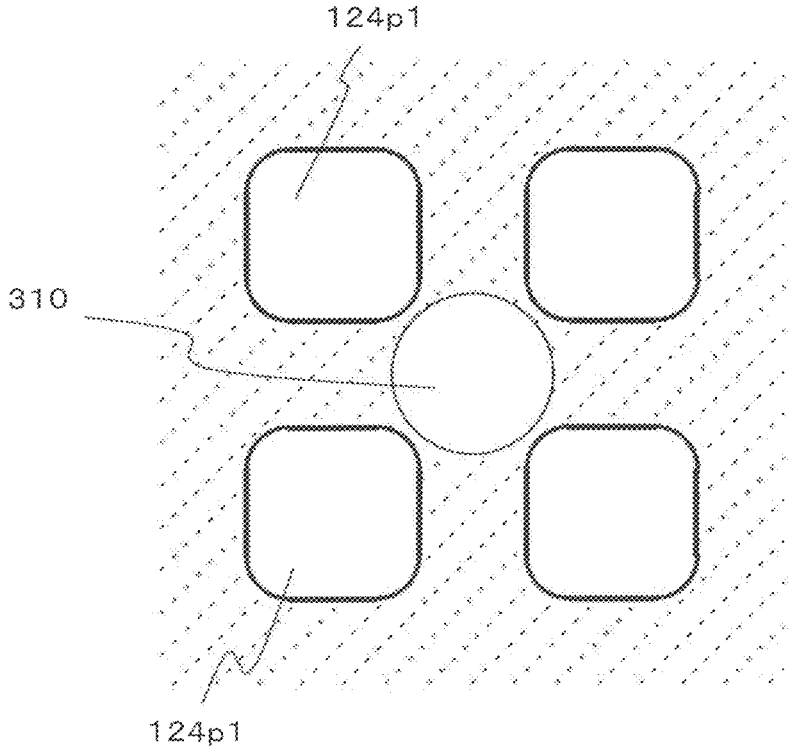
FIG. 6D is a diagram showing as viewed from the Z direction an air void between rods when the intermediate work of FIG. 6A is immersed in a plating solution, where the air void has moved to between four rods.

FIG. 6A is a cross-sectional view of an intermediate work as taken in a plane that contains the axial direction (the Z direction) of a rod 124*p*1, according to another example embodiment of the present disclosure. FIG. 6B is an upper plan view of the intermediate work shown in FIG. 6A, as viewed from the axial direction (the Z direction) of the rod 124*p*1. FIG. 6C is a diagram showing how an air void may exist among rods when the intermediate work shown in FIG. 6A is immersed in a plating solution, as viewed from the Z direction. In this example embodiment, the four side faces of the rod 124*p*1 are not tilted. However, each of the four corners of the rod 124*p*1 has had its edge removed (hereinafter expressed as "disedged"), thus presenting a curved surface. Such disedging provides an effect of promoting discharging of air voids that are trapped among rods during a plating treatment. As shown in FIG. 6C, when an air void 310 is trapped in a gap 129*d* between two adjacent rods 124*p*1, a difference in radius exists between the right and left meniscuses of the air void 310 due to the disedging. Therefore, an effect similar to that which is described in FIG. 3A acts on the air void 310 in the horizontal direction. As a result, as shown in FIG. 6D, the air void 310 is extruded into the relatively wide space among the four rods 124*p*1, ready to be discharged.

Figure 6E:
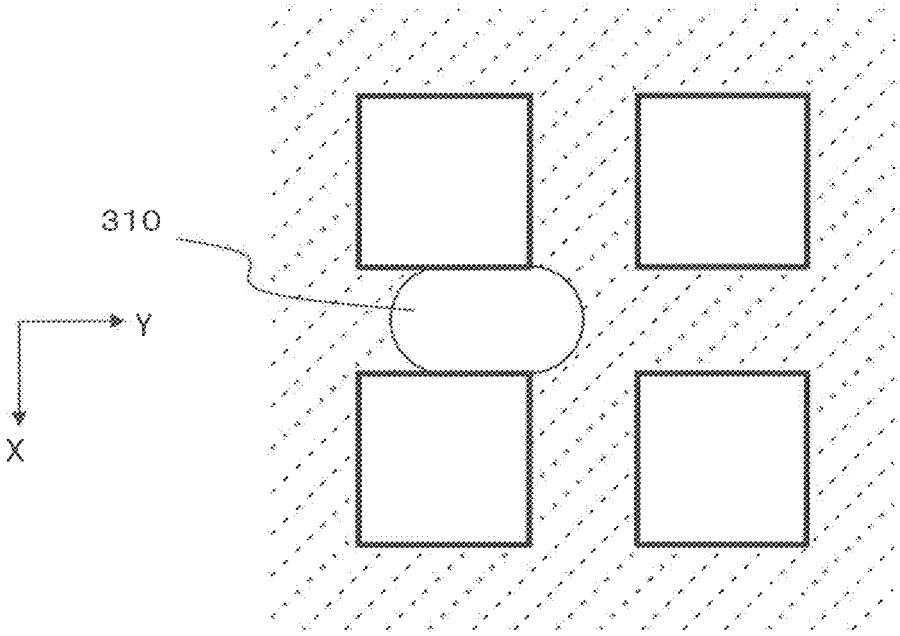
FIG. 6E is a diagram showing as viewed from the Z direction an air void between rods when the intermediate work of Comparative Example is immersed in a plating solution.

FIG. 6E is a diagram showing an air void 310 may exist in a Comparative Example where rod corners are not disedged. In this case, the right and left meniscuses of the air void 310 are equal in radius. Therefore, as compared to the example embodiment as illustrated in FIG. 6C and FIG. 6D, an effect of extruding the air void 310 into the space among the four rods is less likely to be achieved.

Figure 7:
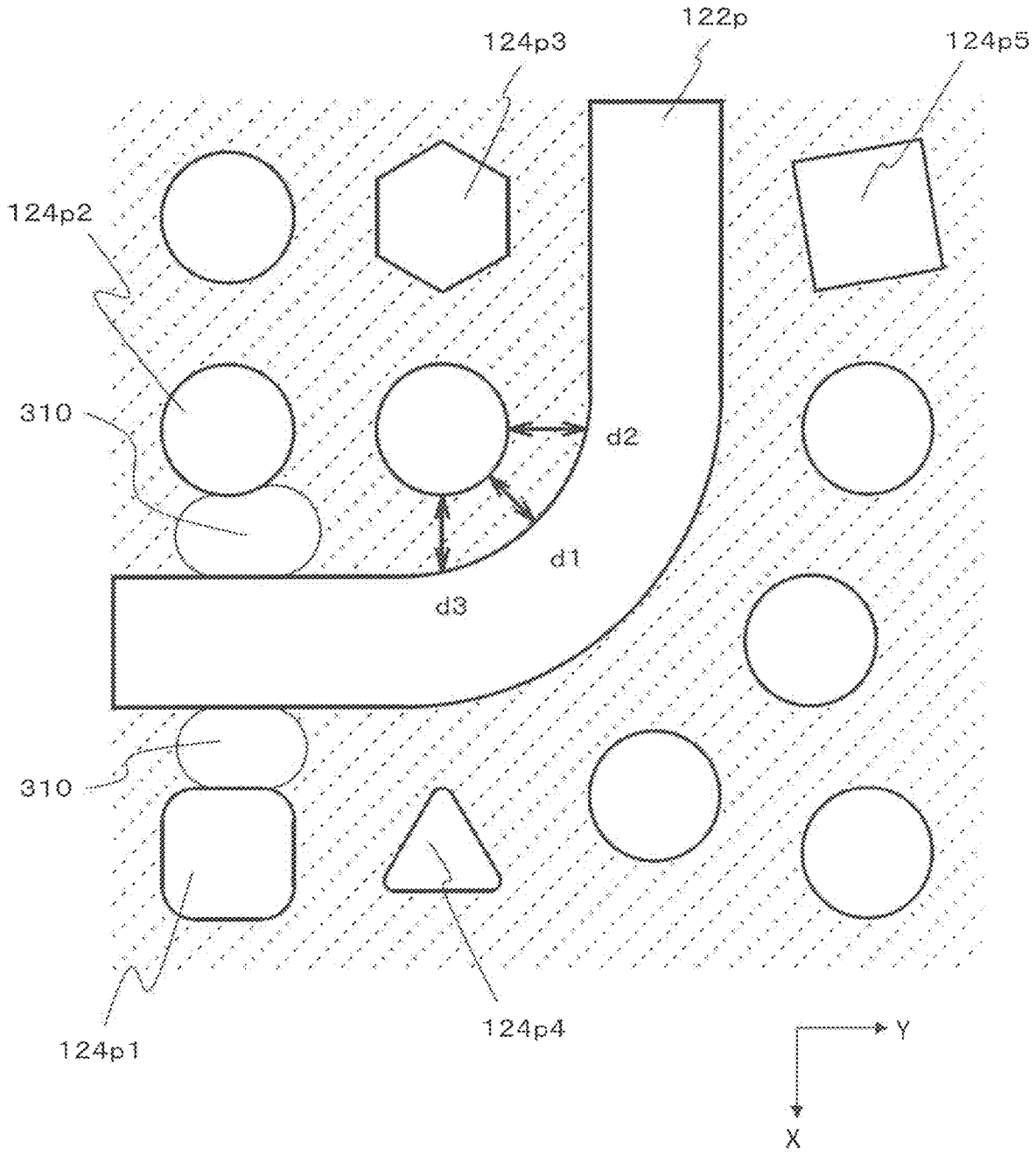
FIG. 7 is an upper plan view that describes other example rod shapes according to an example embodiment of the present disclosure and effects thereof, where the rods and ridge are viewed from the Z direction, when the intermediate work is immersed in a plating solution.

FIG. 7 is an upper plan view showing rods 124*p*2, 124*p*3, 124*p*4 and 124*p*5 as well as a ridge 122*p* surrounded by these rods being immersed in a plating solution, according to still another example embodiment of the present disclosure. The ridge 122*p* includes both of: portions each extending in the form of a straight line (referred to as "linear portions"); and a portion which is curved (referred to as a "curved portion"). The curved portion connects between the two linear portions. In the example of FIG. 7, a rod 124*p*1 that is adjacent to a linear portion of the ridge 122*p* is shaped as a prism with disedged corners. In this case, an air void 310 that is trapped between the side surfaces of the rod 124*p*1 and the ridge 122*p* is slightly less likely to be discharged than in the situation illustrated in FIG. 6C because the linearly-shaped side surface of the ridge 122*p* does not contribute much to an enlarged gap. In such cases, it is effective to adopt as the rod shape a prismatic shape which is not a quadrangular prism, e.g., a cylindrical shape (124*p*2), a hexagonal prism shape (124*p*3), or a triangular prism shape (124*p*4). Adopting such rod shapes promotes discharging of the air void 310. Moreover, even when adopting a quadrangular prism as the rod shape, the prism may be slightly rotated around the Z direction within the plane to result in a rod 124*p*5 shown in FIG. 7, which would promote discharging of the air void 310 because a region with a unidirectionally-enlarging gap is created between the side surface of the rod 124*p*5 and the side surface of the ridge 122*p*.

A rod which is shaped like the rods 124*p*2, 124*p*3, 124*p*4 and 124*p*5 provides an effect of promoting discharging of the air void 310 even if it is disposed adjacent to a curved portion of the ridge 122*p*. However, the interval between the side surface of the rod and the side surface of the ridge 122*p* needs to satisfy predetermined conditions. That is, in the portion where the side surface of the rod and the side surface of the ridge 122*p* are opposed to each other, the interval between the side surfaces of the rod and the ridge 122*p* must monotonically increase away from where the interval is shortest, along the peripheral direction of the rod. In other words, in FIG. 7, d1<d2, d3. Moreover, the side surface of the rod has a curvature which is greater than the curvature of the side surface of the ridge 122*p*. When these conditions are satisfied, air voids are likely to be discharged during a plating treatment.

Figure 8:
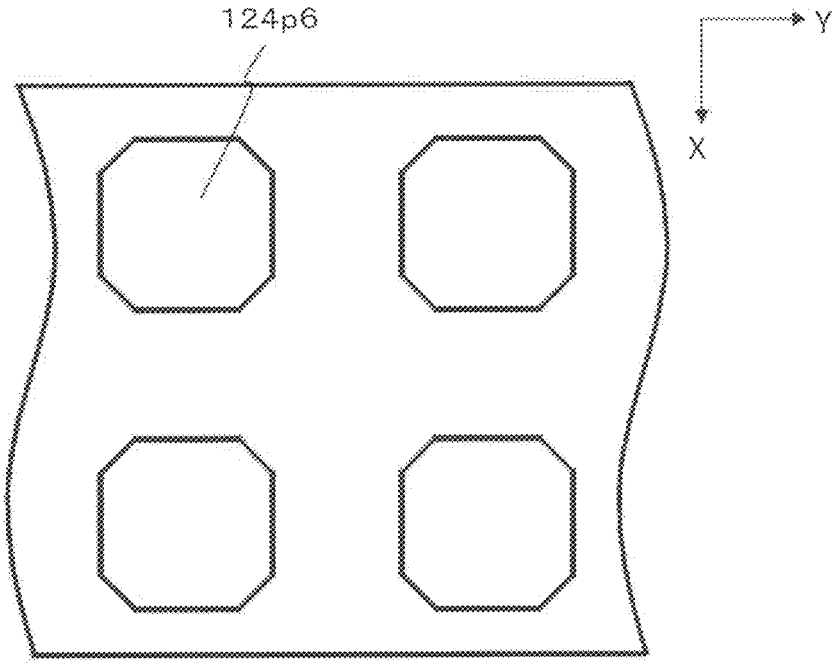
FIG. 8 is an upper plan view showing still another example rod shape according to an example embodiment of the present disclosure.

In FIGS. 6B through 6D and FIG. 7, corners of the side surface of the prism-shaped rod 124*p*1 are disedged into curved surfaces ("filleted"); however, the manner of disedging is not limited to this shape. For example, as shown in FIG. 8, a rod 124*p*6 of a shape having corners which are disedged by planes ("chamfered") may be adopted. In that case, too, the aforementioned air void discharging effect is obtained.

Thus, the intermediate work may include two linear portions each extending in the form of a straight line and a curved portion connecting between the two linear portions and being curved. The plurality of rods are distributed on both sides of the ridge. Among the plurality of rods, a rod that is the closest to the curved portion on the inside of the curved portion of the ridge may have, for example, a prismatic shape with disedged corners, a cylindrical shape, or any prismatic shape other than a quadrangular prism. The distance between the side surface of the rod that is the closest to the curved portion of the ridge and the side surface of the ridge monotonically increases away from the portion of the rod where the distance is shortest, along the peripheral direction of the rod. The curvature of the side surface of the rod that is the closest to the curved portion of the ridge is greater than the curvature of the curved portion of the ridge.

Figure 9A:
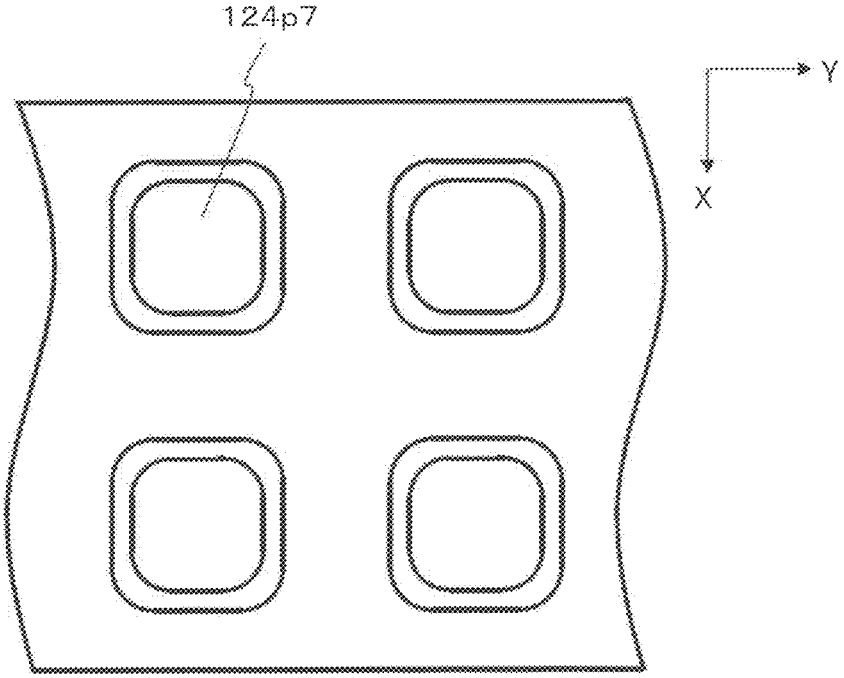
FIG. 9A is an upper plan view showing still another example rod shape according to an example embodiment of the present disclosure, where the rods are viewed from the Z direction.
Figure 9B:
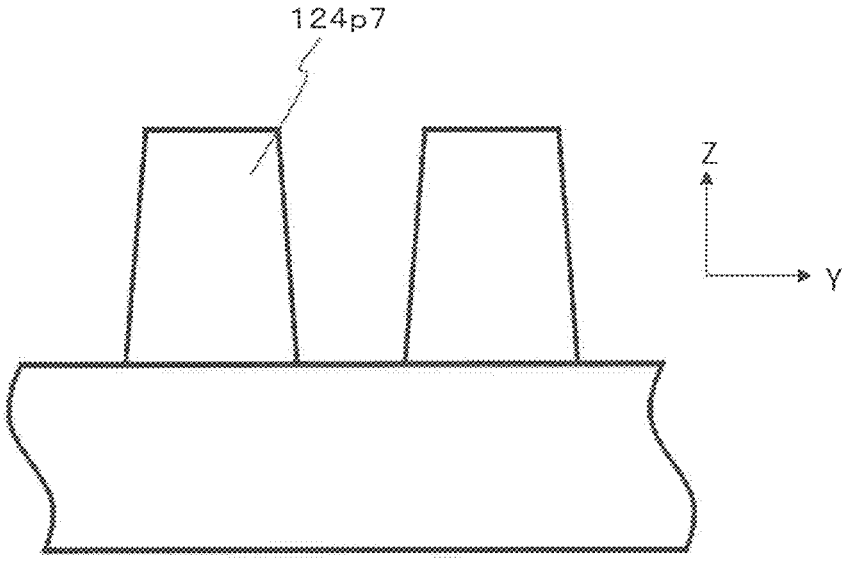
FIG. 9B is a side view showing the rods of FIG. 9A from the lateral direction (the X direction).

FIG. 9A is an upper plan view showing a rod 124*p*7 according to still another example embodiment of the present disclosure. FIG. 9B is a side view of the rod 124*p*7. Similarly to the rod 124*p*1, the rod 124*p*7 has four corners which are disedged into curved surfaces. Moreover, the rod 124*p*7 has a gradually-pointed shape such that its width or diameter decreases from the root toward the leading end. When an intermediate work having rods 124*p*7 of such shape is immersed in a plating solution, both of the effect illustrated with reference to FIG. 3A and the effect illustrated with reference to FIG. 6C can act on the air voids. Therefore, in this example, too, air voids trapped between rods are likely to be discharged.

Figure 10:
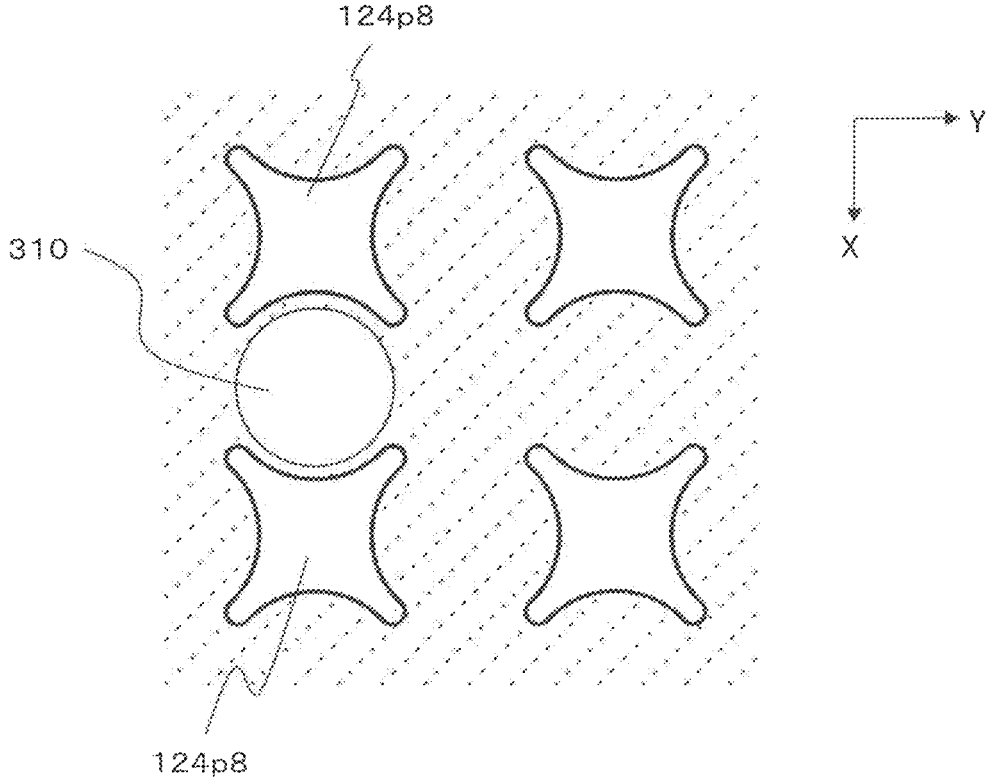
FIG. 10 is a view showing another example rod shape according to an example embodiment of the present disclosure, which is an upper plan view as viewed from the Z direction of an air void between rods when the intermediate work is immersed in a plating solution.

FIG. 10 is an upper plan view showing rods 124*p*8 according to still another example embodiment of the present disclosure. FIG. 10 illustrates the rod 124*ps*8 being immersed in a plating solution. In this example, each rod 124*p*8 has recesses on its side surface. These recesses increase the width of a space existing two adjacent rods. As a result, an air void 310 is less likely to be trapped in the region between rods. In other words, this example also reduces the likelihood of a situation where defects may occur in the plating due to air voids 310 being trapped in regions between rods, although with a different mechanism from the mechanism that has been described with reference to FIG. 3A and FIG. 6C. The examples shown in FIG. 3A and FIG. 6C rely on an air void discharging effect that utilizes nonuniformity of surface tension. On the other hand, in the example of FIG. 10, without enlarging the period with which the rods are disposed, the gap between rods is still enlarged to make it less likely for air voids to be trapped between rods.

As exemplified by the rods 124*p*8, a conductive rod which is shaped so that the side surface is recessed or dented in a plurality of places, thus leaving protrusions that stick outward between recesses, may exhibit an excellent property of blocking radio frequency signals. Such a property will be available irrespective of their production method. Therefore, conductive rods of such shape can be adopted also in a product that is made by a production method which does not involve any plating step during the production. For example, such a product may be produced by die casting, thixomolding, or a cutting process.

Figure 11A:
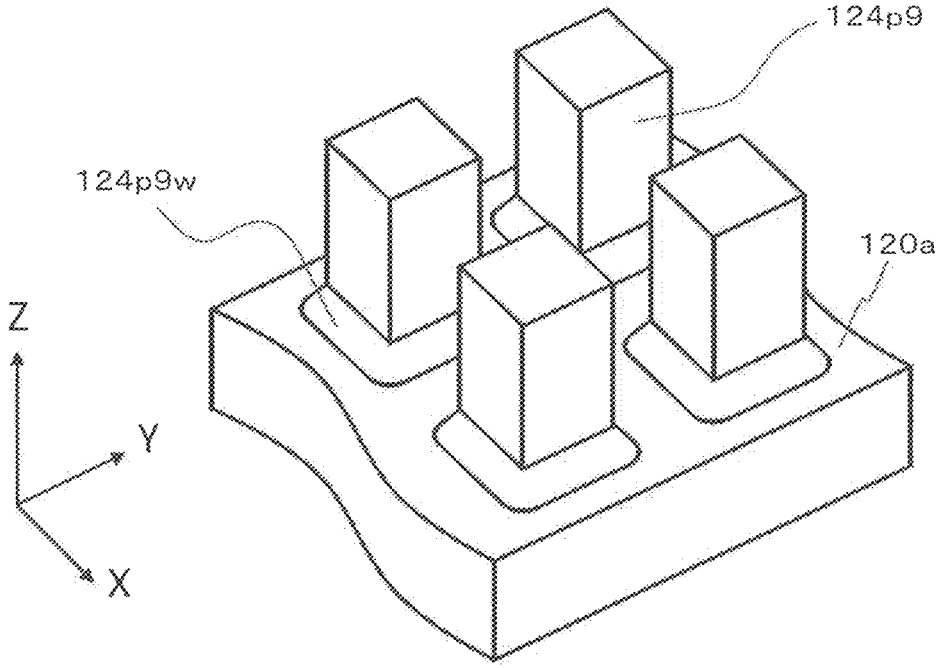
FIG. 11A is a diagram showing still another rod shape according to an example embodiment of the present disclosure, which is a perspective view showing the rods.

FIG. 11A is a perspective view schematically showing rods 124*p*9 according to still another example embodiment of the present disclosure. On the root side where it connects to the conductive surface 120*a*, each rod 124*p*9 has a swollen diameter portion 124*p*9*w*, at which its width or diameter is enlarged.

Figure 11B:
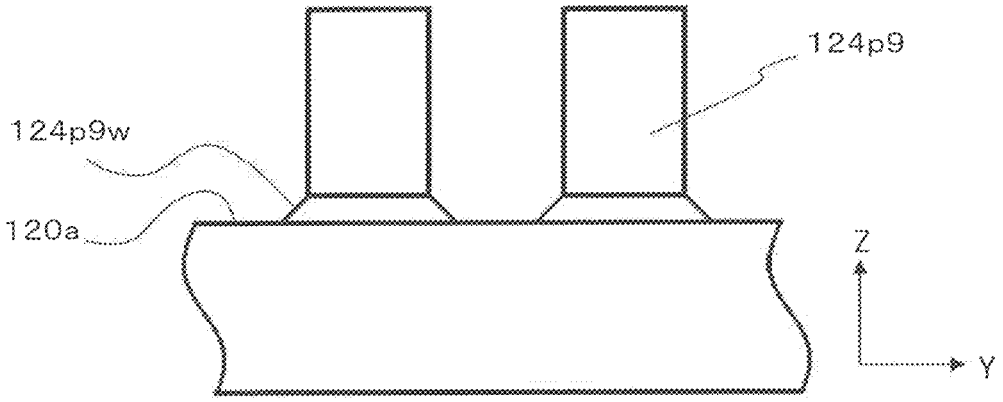
FIG. 11B is a side view showing the rods of FIG. 11A as viewed from the lateral direction (the X direction).

FIG. 11B is a schematic side view of the rods 124*p*9 as viewed from the X direction. The side surface of the swollen diameter portion 124*p*9*w* is tilted with respect to the Z direction, along which the rod 124*p*9 extends. Moreover, the diameter of the swollen diameter portion 124*p*9*w* enlarges toward the conductive surface 120*a*. In the example shown in FIG. 11A and FIG. 11B, within the side surface of the rod 124*p*9, a clearly defined boundary exists between an upright portion and the swollen diameter portion 124*p*9*w*. Alternatively, however, without any clearly defined boundary, the upright portion and the swollen diameter portion 124*p*9*w* may be connected via a smooth curved surface.

Figure 11C:
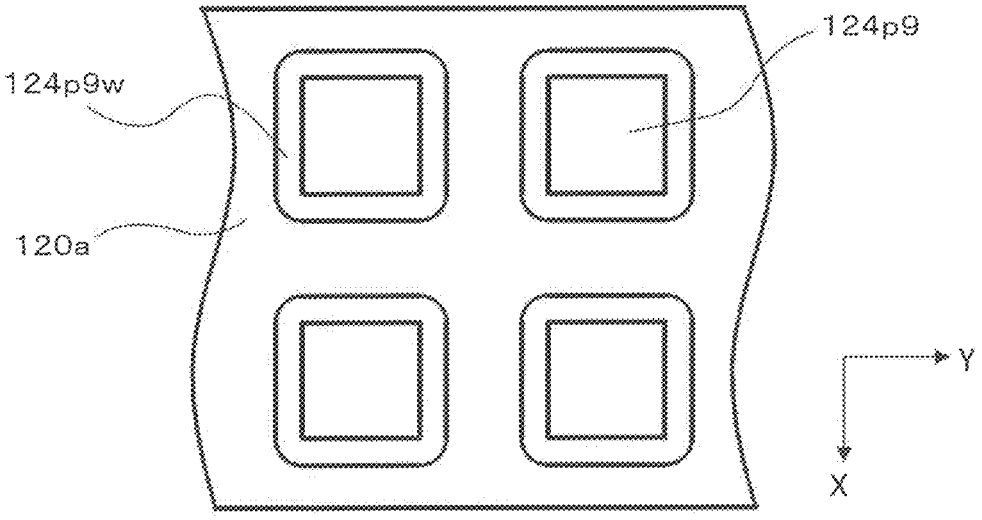
FIG. 11C is an upper plan view showing the rods of FIG. 11A as viewed from the Z direction.

FIG. 11C is a plan view schematically showing the rods 124*p*9. When each rod 124*p*9 is viewed from a perpendicular direction to the conductive surface 120*a*, the square upper face of the rod 124*p*9 and the side surface of the swollen diameter portion 124*p*9*w* in its surroundings can be seen.

As in the rods 124*p*9 according to this variant, a rod shape with the swollen diameter portion 124*p*9*w* at the root may be selected; as a result, in the plating step, air voids are less likely to be trapped especially in the portion at which the root of the rod 124*p*9 connects to the conductive surface 120*a*. Alternatively, air voids that are trapped between a plurality of rods 124*p*9 are more likely to be discharged. When there is no swollen diameter portion 124*p*9*w*, the portion at which the side surface of the rod 124*p*9 connects to the conductive surface 120*a* will present dented corners where the vertical plane and the horizontal plane meet. When immersed in a plating solution, air voids are likely to be trapped in portions of such shape. Adopting the swollen diameter portion 124*p*9*w* at the root side of the rod 124*p*92 eliminates dented corner shapes, whereby air voids become less likely to be trapped.

Figure 11D:
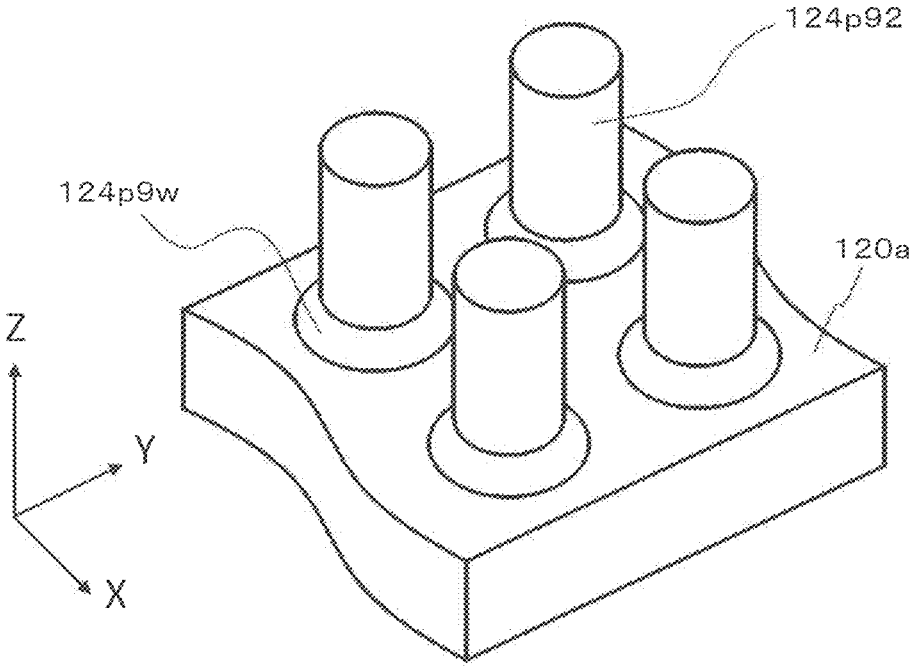
FIG. 11D is a diagram showing still another rod shape according to an example embodiment of the present disclosure, which is a perspective view showing the rods.

In the example shown in FIGS. 11A through 11C, the swollen diameter portion 124*p*9*w* and any other portion of the rod 124*p*9 present a horizontal cross-sectional shape which is square. However, this is not a limitation. The horizontal cross-sectional shape may be a circle, or a square with rounded corners. An example where the horizontal cross-sectional shape is a circle is shown in FIG. 11D. In this example, the horizontal cross-sectional shape of the rod 124*p*92 is circular in the swollen diameter portion 124*p*9*w* or in any other portion.

Figure 11E:
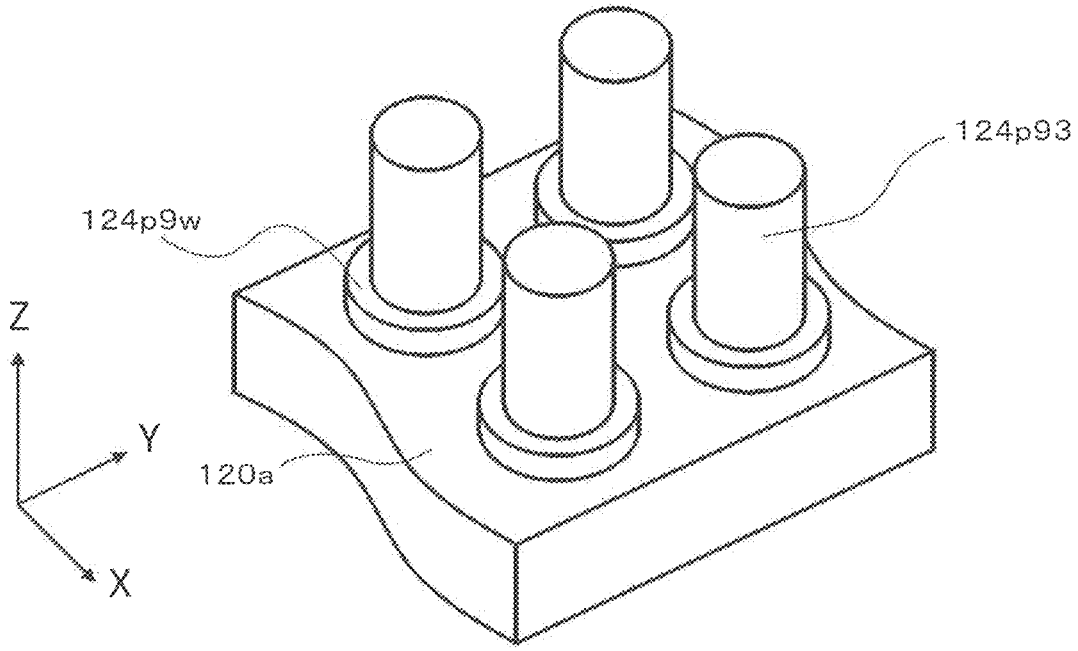
FIG. 11E is a diagram showing still another rod shape according to an example embodiment of the present disclosure, which is a perspective view showing the rods.
Figure 11F:
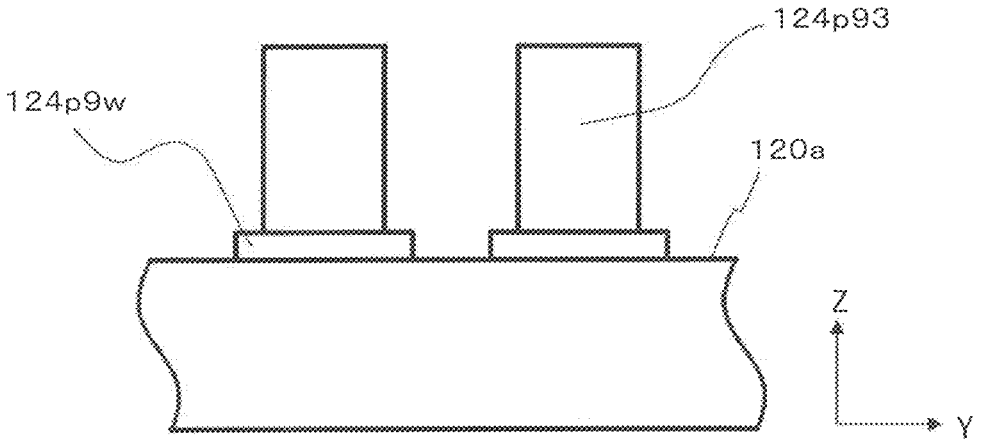
FIG. 11F is a side view showing the rods of FIG. 11E as viewed from the lateral direction (the X direction).

FIG. 11E and FIG. 11F show still another example of a rod having a horizontal cross-sectional shape which is circular. In this example, the swollen diameter portion 124*p*9*w* causes the root side of rod 124*p*93 to be stepped.

In the examples shown in FIGS. 11A through 11F, any portion of the rod other than the swollen diameter portion 124*p*9*w* has a constant width. As a result, in any portion other than the swollen diameter portion 124*p*9*w*, the gap between rods is also constant in size. However, even when the rod has the swollen diameter portion 124*p*9*w*, a gradually-pointed shape may be adopted in any portion of the rod other than the swollen diameter portion 124*p*9*w*. When such a shape is adopted, the gap between adjacent rods will enlarge from the root toward the leading end; therefore, even at portions away from the rod root, discharging of air voids during plating will be further enhanced.

A rod row that includes rods having a swollen diameter portion at its root side as illustrated by way of example in FIGS. 11A through 11F properly functions as an artificial magnetic conductor. Moreover, when any portion of the rod other than the swollen diameter portion has a gradually-pointed shape, a rod row that includes such rods will properly function as an artificial magnetic conductor.

Note that the rods having the swollen diameter portion 124*p*9*w* at the root side illustrated by way example in FIG. 11A through FIG. 11F will properly function as a radio frequency member even when they are molded out of a raw material of metal by casting, e.g., die casting technique. Therefore, a radio frequency member each of whose rods includes the swollen diameter portion 124*p*9*w* may be produced by casting using a die.

In the case where rods that lack a swollen diameter portion at the root, e.g., those shown in FIG. 4, are produced through casting, defects may often occur in that the rods may not be properly molded. On the other hand, providing a swollen diameter portion at the root of the rod can suppress such defects. One presumable reason for this is that, when the swollen diameter portion exists, the entrance of a hollow space within the die that corresponds to each rod has a widened shape, thus making it easier for the metal in fluid state to flow into such hollow spaces for the rods. Moreover, in separating the cast work from the die, the rods will be strongly stressed, which may possibly cause ruptures near the roots of the rods. However, when the rod root presents a swollen diameter portion, the widened rod width at this portion provides increased resistance to mechanical stress, thus hindering such ruptures.

An intermediate work according to an example embodiment of the present disclosure is not limited to what is made from a raw material that is solely a resin material. The intermediate work may be composed of a portion whose raw material is a resin material and a portion whose raw material is a metal material. Such an intermediate work can be produced by an insert molding technique that involves placing a metal work in a die and then injecting a resin in fluid state into the die, for example. Otherwise, a method that fixes a resin molding onto a metal work with screws or the like may be adopted. In the case where the intermediate work utilizes both of a resin material and a metal material as its raw materials, a plating treatment may be performed as necessary for places where electrical conductivity is to be conferred. In one example embodiment, a plating treatment may be performed for the resin portion(s) alone. In the case where electrical conductivity is needed also in the boundary between the resin portion(s) and the metal portion(s), both the resin portion(s) and the metal portion(s) may be subjected to a plating treatment. In that case, the entire intermediate work may be subjected to a plating treatment.

2. Characteristics of the Radio Frequency Member in the Case where Conductive Rods have Gradually-Pointed Shape As described above, by ensuring that the conductive rods of the radio frequency member have a gradually-pointed shape, or that the corners of the side surfaces of the conductive rods are disedged, defects become less likely to occur in the plating layer. However, even when there are few defects in the plating layer, if a radio frequency member having conductive rods of any such shape did not properly function when a WRG waveguide (which would be a primary application) was constructed from it, the production method described in the present disclosure would lack in technological significance.

In known literature, as has already been mentioned, each conductive rod in fact has a shape with a constant width or diameter from the root to the leading end, or alternatively a shape with increasing width or diameter from the root toward the leading end, or a mushroom shape. A gradually-pointed shape is a quite opposite shape relative to such shapes of increasing diameter and mushroom shapes, in particular.

However, the inventors have confirmed that, when a shape obtained by disedging the corners of the side surface of a prism, or shape having a circular cross section, is adopted as the conductive rod shape, a WRG waveguide that is constructed from such conductive rods and a waveguide member (ridge) properly operates. The inventors have also found that, when a WRG waveguide is constructed from a radio frequency member having gradually-pointed conductive rods, characteristics improvements may even be obtained.

Hereinafter, such a WRG waveguide will be described.

<Fundamental Construction of the Waveguide Device>

Figure 12A:
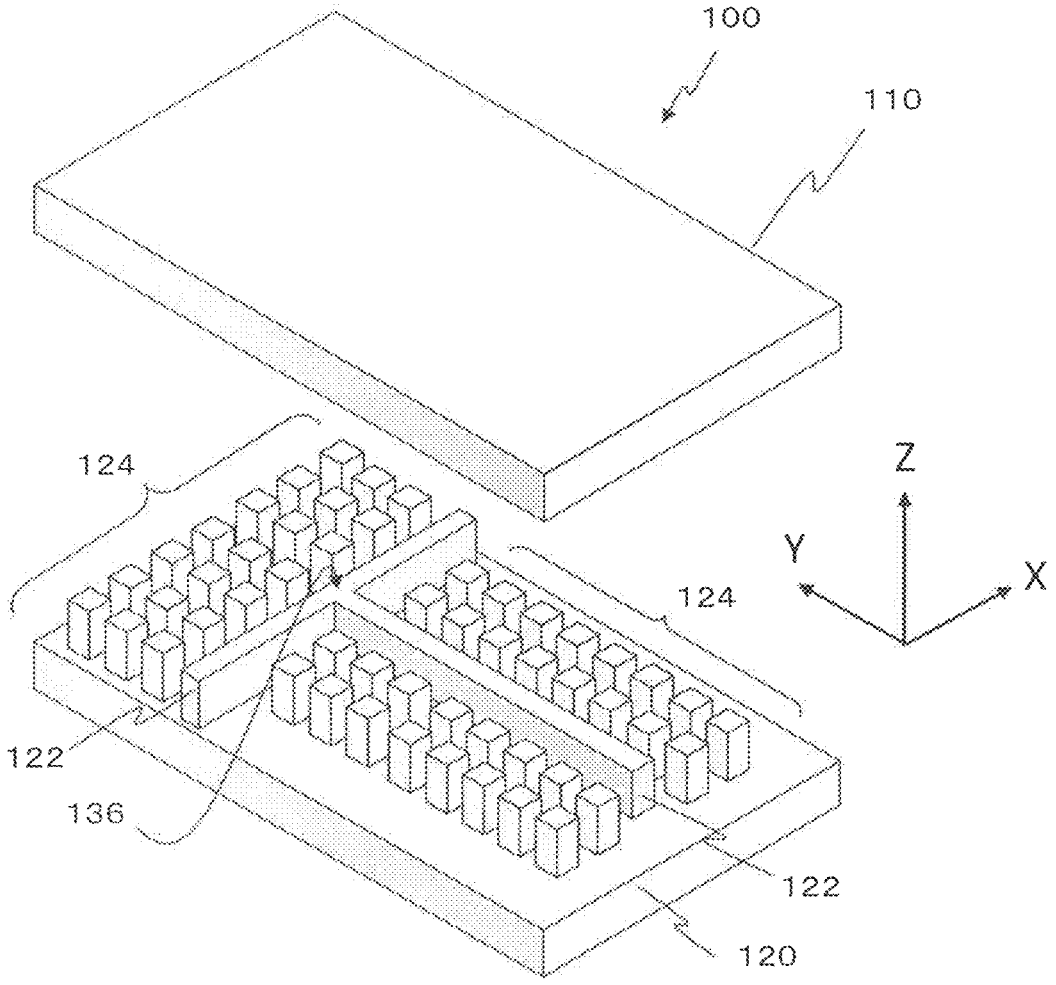
FIG. 12A is a perspective view schematically showing an example construction of a waveguide device which is constructed by using a radio frequency member according to an example embodiment of the present disclosure.
Figure 12B:
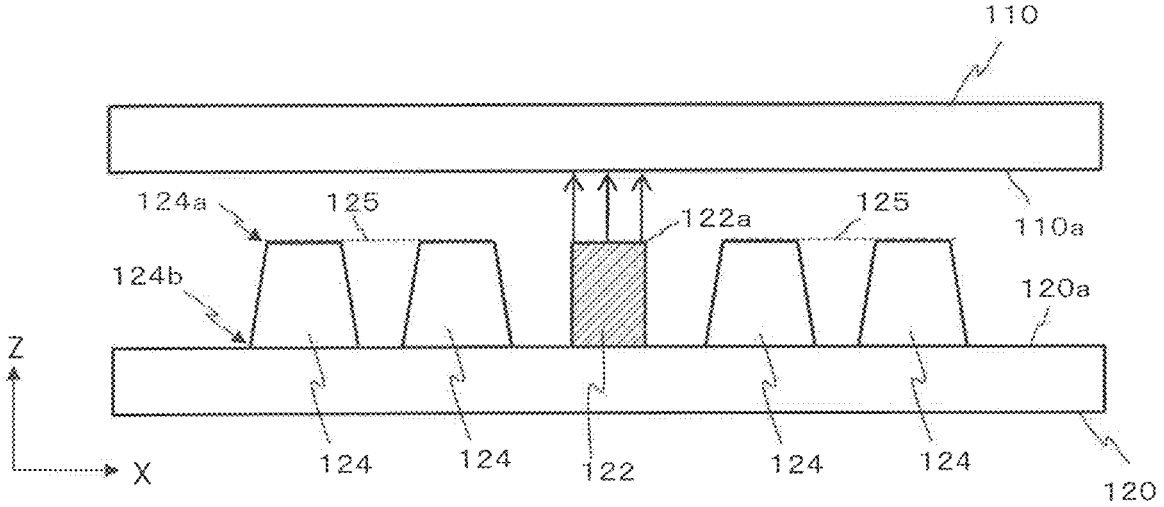
FIG. 12B is a diagram schematically showing the construction of a cross section of the waveguide device 100 that is parallel to the XZ plane.

First, see FIGS. 12A and 12B. FIG. 12A is a perspective view schematically showing an example construction for a waveguide device according to the present example embodiment. For ease of understanding, FIG. 12A exaggerates the spacing between the first electrically conductive member 110 and the second electrically conductive member 120. FIG. 12B is a diagram schematically showing the construction of the waveguide device 100 in a cross section taken parallel to the XZ plane.

As shown in FIGS. 12A and 12B, the waveguide device 100 of the present example embodiment includes: a first electrically conductive member 110 having an electrically conductive surface 110*a* which is shaped as a plane; a second electrically conductive member 120 having a plurality of electrically conductive rods 124 arrayed thereon, each having a leading end 124*a* opposing the conductive surface 110*a*; and a waveguide member 122 having an electrically conductive waveguide face 122*a* opposing the conductive surface 110*a* of the first conductive member 110. The waveguide member 122, which extends along the conductive surface 110*a*, is provided among the plurality of conductive rods 124. Stretches of an artificial magnetic conductor composed of the plurality of conductive rods 124 are present on both sides of the waveguide member 122, such that the waveguide member 122 is sandwiched between the stretches of artificial magnetic conductor on both sides. In the present example embodiment, the waveguide member 122 includes a branching portion 136 at which the direction that the waveguide member 122 extends ramifies into two or more directions. At the branching portion 136 in this example, the two branched waveguide members constitute an angle of 180 degrees, thus resulting in a shape resembling the letter "T"; hence, it may also be called a "T-branching". Another example of the branching portion 136 is a "Y-branching", where the two branched waveguide members extend in directions which are apart by an angle smaller than 180 degrees.

As described earlier, the plurality of conductive rods 124 arrayed on the second conductive member 120 each have a leading end 124*a* opposing the conductive surface 110*a*. In the example shown in the figure, the leading ends 124*a* of the conductive rods 124 are on substantially the same plane, thus defining the surface 125 of the artificial magnetic conductor.

<Fundamental Structure of Conductive Rods>

Branching Portion

In the present example embodiment, as shown in FIG. 12B, the side faces of each conductive rod 124 are tilted so that a measure of the outer shape of a cross section of each conductive rod 124 taken perpendicular to the axial direction (Z direction) monotonously decreases from the root 124*b* toward the leading end 124*a*. This enhances the degree of impedance matching at the branching portion 136 of the waveguide member 122, as has been made clear by an electromagnetic field simulation.

Figure 13A:
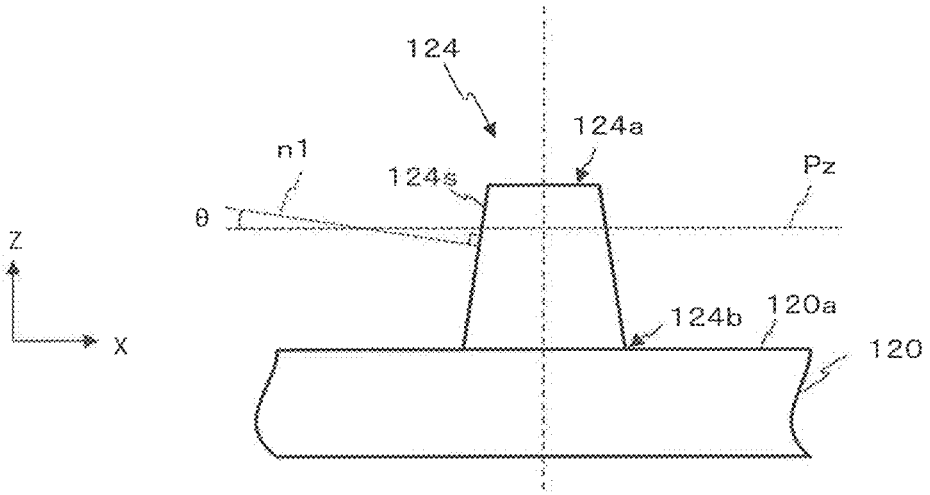
FIG. 13A is a cross-sectional view of a conductive rod 124 according to an example embodiment of the present disclosure as taken in a plane that contains the axial direction (the Z direction).
Figure 13B:
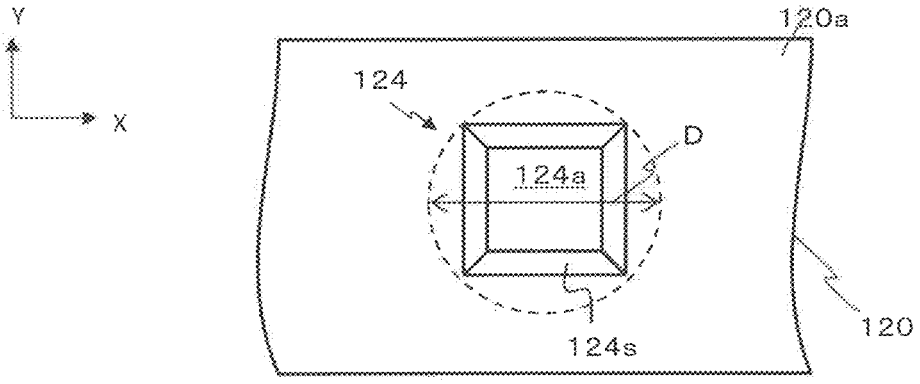
FIG. 13B is an upper plan view showing the conductive rod 124 of FIG. 8A as viewed from the axial direction (the Z direction).

FIG. 13A is a cross-sectional view of a conductive rod 124 in a plane containing the axial direction (Z direction). FIG. 13B is an upper plan view of the conductive rod 124 of FIG. 13A as viewed in the axial direction (Z direction). In this example, each conductive rod 124 has a frustum shape with square cross sections perpendicular to the axial direction (Z direction), such that the four side faces 124*s* of the conductive rod 124 are tilted with respect to the axial direction (Z direction). As shown in FIG. 13A, the angle of tilt of each side face 124*s* of each conductive rod is defined by an angle θ, which the normal n1 of the side face 124*s* constitutes with an arbitrary plane Pz that is orthogonal to the axial direction (Z direction).

The "measure of the outer shape of a cross section of the conductive rod taken perpendicular to the axial direction" is defined by the diameter of a smallest circle that is capable of containing the "outer shape of a cross section" inside. Such a circle will be a circumcircle in the case where the outer shape of a cross section is a triangle, a rectangle (including a square), or a regular polygon. In the case where the "outer shape of a cross section" is a circle or an ellipse, the "measure of the outer shape of a cross section" is the diameter of the circle or the length of the major axis of the ellipse. In the present disclosure, the "outer shape of a cross section" of a conductive rod is not limited to a shape for which a circumcircle exists. In the example shown in FIGS. 13A and 13B, the measure of the outer shape of a cross section of each conductive rod 124 taken perpendicular to the axial direction decreases from the root 124*b* of the conductive rod 124 toward the leading end 124*a*.

In the example shown in FIGS. 13A and 13B, the area of a cross section taken perpendicular to the axial direction of the conductive rod 124 is smaller at the leading end 124*a* than at the root 124*b*. As described earlier, each conductive rod 124 does not need to be entirely electrically conductive, but only the surface may be electrically conductive. Therefore, the conductive rod 124 may have a hollow structure, or include a dielectric core inside. The "area of a cross section of the conductive rod taken perpendicular to the axial direction" means the area of a region which is delineated from the exterior by the contour line of the "outer shape" of a cross section of the conductive rod taken perpendicular to the axial direction. Even if a non-electrically conductive portion is included within that region, it is irrelevant to the "area of the cross section".

Hereinafter, it will be described how use of such conductive rods 124 improves the degree of impedance matching.

The inventors have made it clear through a simulation that the construction according to the present example embodiment provides an improved degree of impedance matching over the conventional construction in which the side faces of each conductive rod 124 are not tilted. Herein, the degree of impedance matching is represented by an input reflection coefficient. The lower the input reflection coefficient is, the higher the degree of impedance matching is. The input reflection coefficient is a coefficient which represents a ratio of the intensity of a reflected wave to the intensity of an input wave which is incoming to a radio frequency line or an element.

Figure 14A:
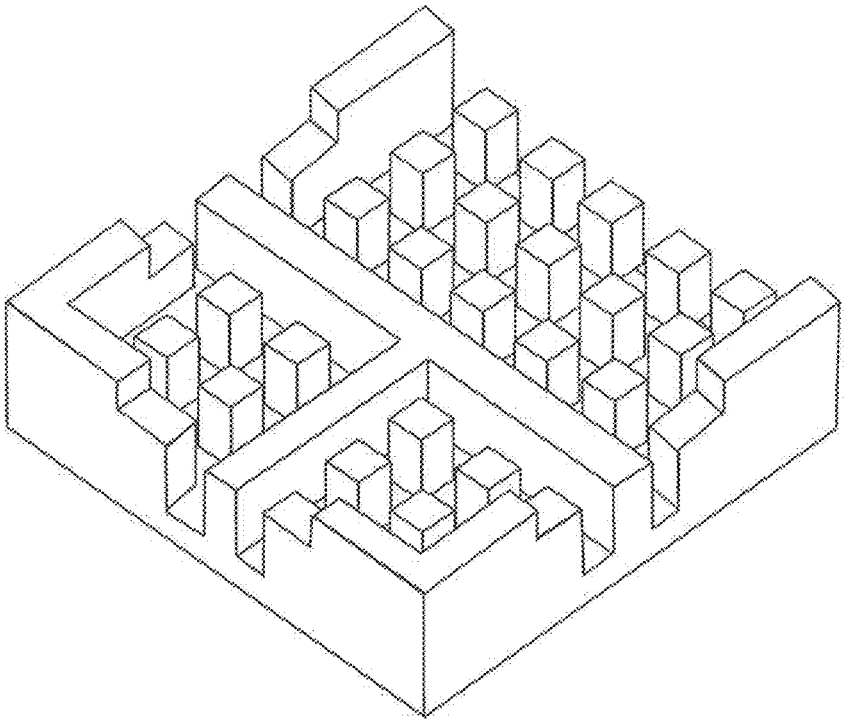
FIG. 14A is a perspective view schematically showing a conventional construction where the side faces of each conductive rod 124 are not tilted, in a construction including a branching portion.
Figure 14B:
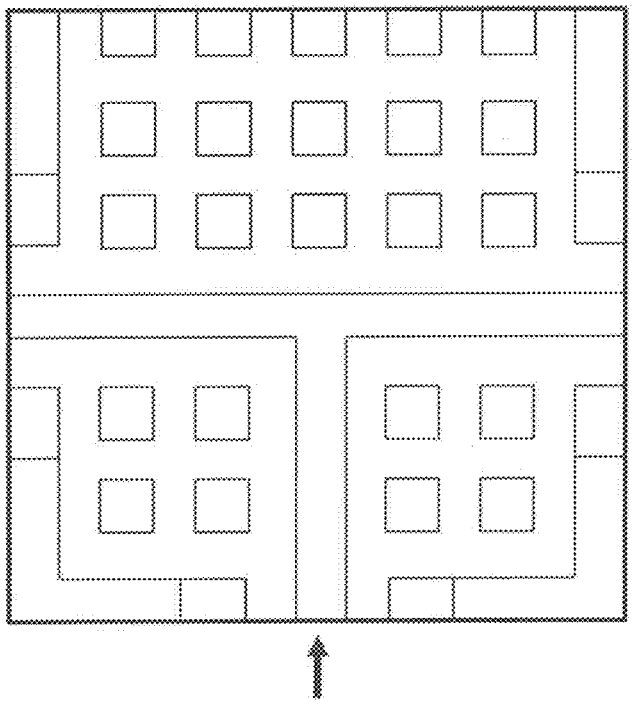
FIG. 14B is an upper plan view of the waveguide device shown in FIG. 14A.
Figure 14C:
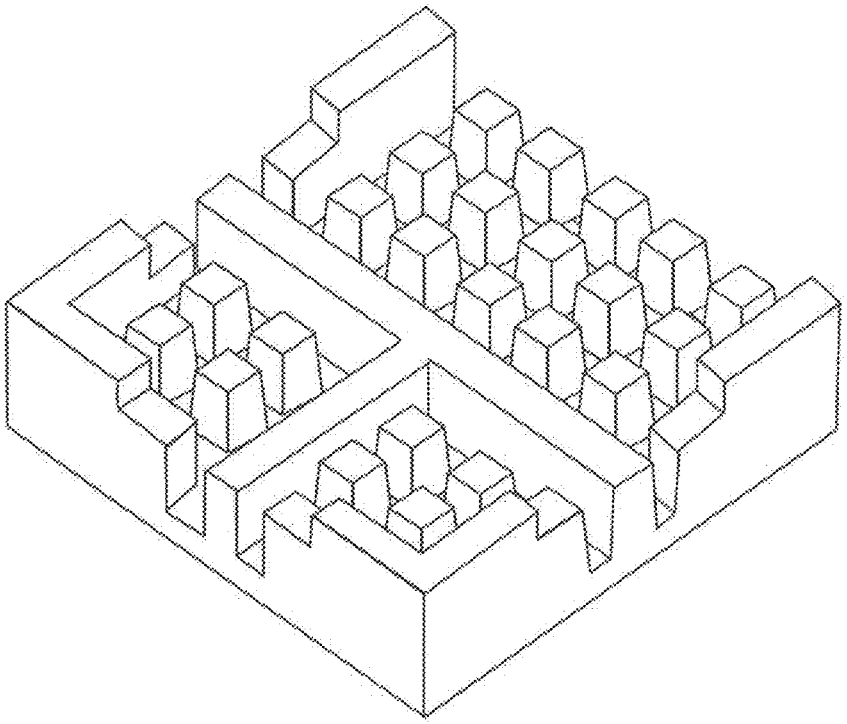
FIG. 14C is a perspective view schematically showing a construction according to an example embodiment where the side faces of each conductive rod 124 are tilted, in a construction including a branching portion.
Figure 14D:
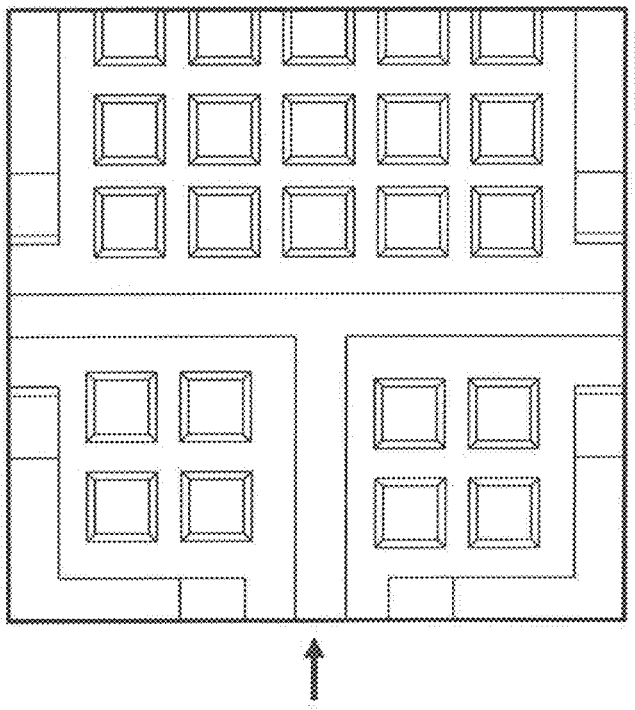
FIG. 14D is an upper plan view of the waveguide device shown in FIG. 14C.

FIGS. 14A through 14D are diagrams showing the construction of a waveguide device used in this simulation. FIG. 14A is a perspective view schematically showing a conventional construction in which the side faces of each conductive rod 124 are not tilted. FIG. 14B is an upper plan view of the waveguide device shown in FIG. 14A. FIG. 14C is a perspective view schematically showing a construction according to the present example embodiment where the side faces of each conductive rod 124 are tilted. FIG. 14D is an upper plan view of the waveguide device shown in FIG. 14C.

In this simulation, an input reflection coefficient S of the branching portion was measured with respect to a number of constructions in which the four side faces of each conductive rod 124 had different angles of tilt. In this simulation, given a frequency Fo of 74.9475 GHz, an electromagnetic wave (also referred to as an "input wave") in a frequency band centered around Fo was measured. Given a wavelength λo in free space that corresponds to Fo, an average width of each conductive rod, an average width of interspaces between rods, and the width of the waveguide member (ridge) were λo/8, while the height of each rod and the ridge was λo/4. The input wave was allowed to be incident in the orientation of an arrow shown in FIG. 14D and FIG. 14B.

Figure 15:
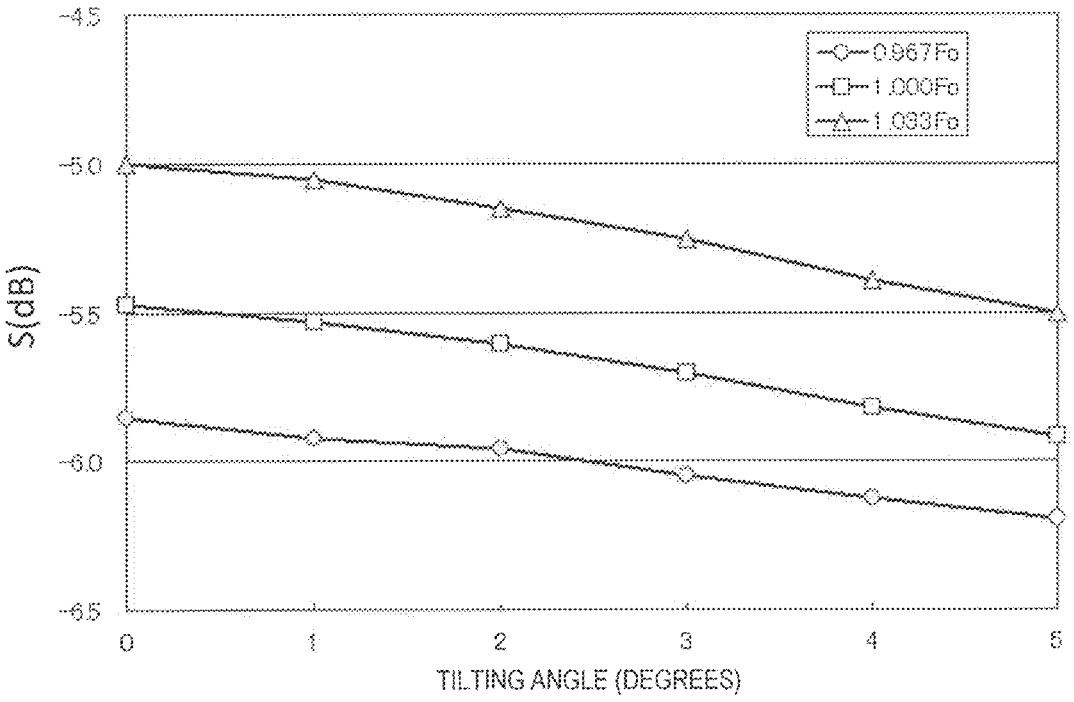
FIG. 15 is a graph showing an input reflection coefficient S for an input wave at frequencies of 0.967 Fo, 1.000 Fo and 1.033 Fo, in the respective cases where the angle of tilt θ is 0°, 1°, 2°, 3°, 4° and 5°, in a construction including a branching portion.

FIG. 15 is a graph showing results of this simulation. The graph of FIG. 15 shows an input reflection coefficient S (dB) for an input wave at frequencies of 0.967 Fo, 1.000 Fo and 1.033 Fo, in the respective cases where the angle of tilt θ is 0°, 1°, 2°, 3°, 4° and 5°.

It can be seen from FIG. 15 that, irrespective of the frequency of the input wave, the input reflection coefficient S becomes lower as the side faces of each conductive rod 124 are tilted. In other words, it was confirmed that the construction of the present example embodiment improves the degree of impedance matching.

Bend

The aforementioned effect is also achieved in the case where the waveguide member 122 includes a bend(s). A bend is a portion where a change occurs in the direction that the waveguide member 122 extends. A bend is inclusive of any portion where the direction that the waveguide member 122 extends undergoes a drastic change, a gentle change, or meanders.

Figure 16:
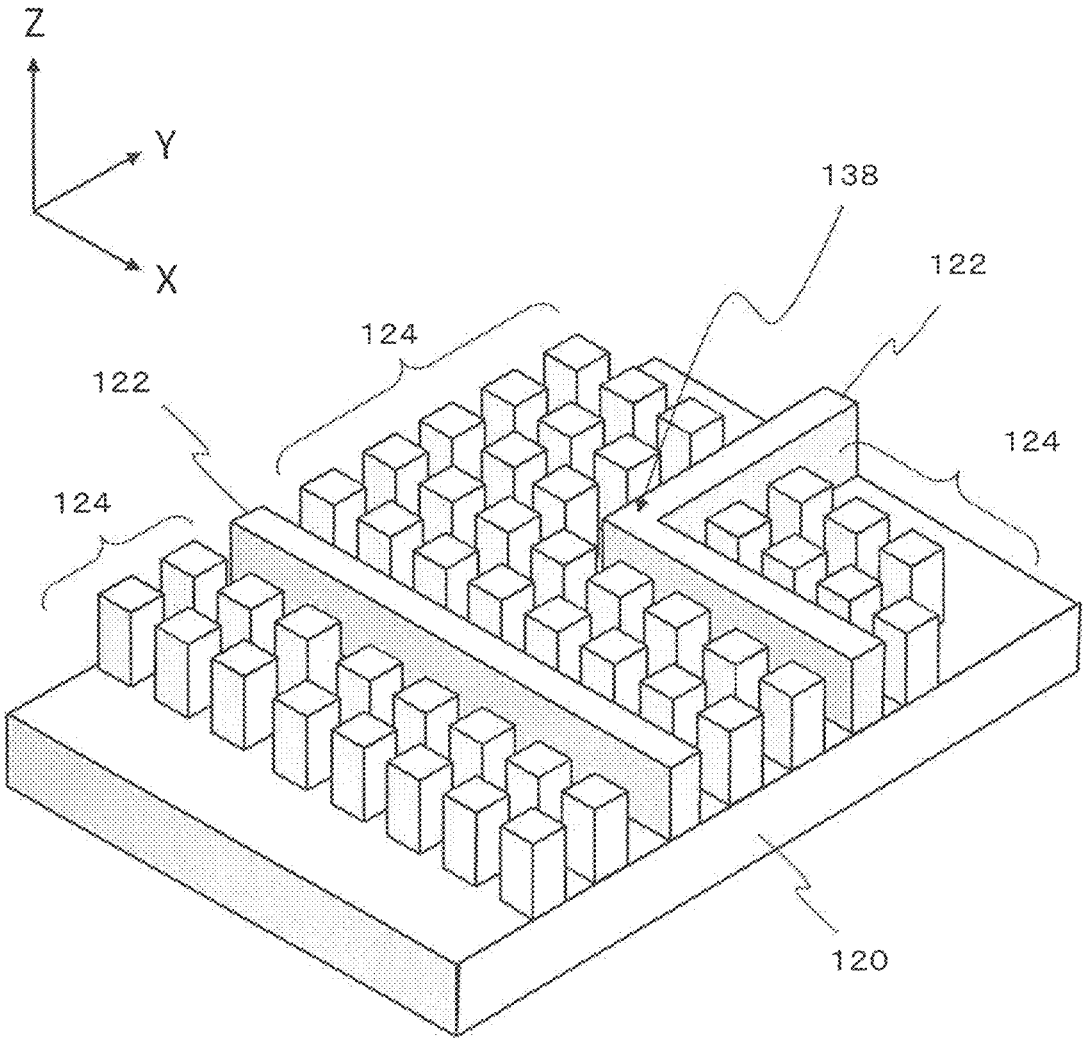
FIG. 16 is a perspective view schematically showing another example construction of a waveguide device according to another example embodiment of the present disclosure.

See FIG. 16. FIG. 16 is a perspective view schematically showing another example construction of a waveguide device according to the present example embodiment. For ease of understanding, the first conductive member 110 is omitted from illustration in FIG. 16.

The waveguide device shown in the figure includes two waveguide members 122, where one of the waveguide member 122 includes a bend 138.

By using conductive rods 124 with tilted side faces, the degree of impedance matching can also be improved at the bend 138. This will be described below.

The inventors have conducted a simulation, through which it has been made clear that a construction including a bend also improves the degree of impedance matching over that of the conventional construction in which the side faces of each conductive rod 124 are not tilted. Hereinafter, results of this simulation will be described.

Figure 17A:
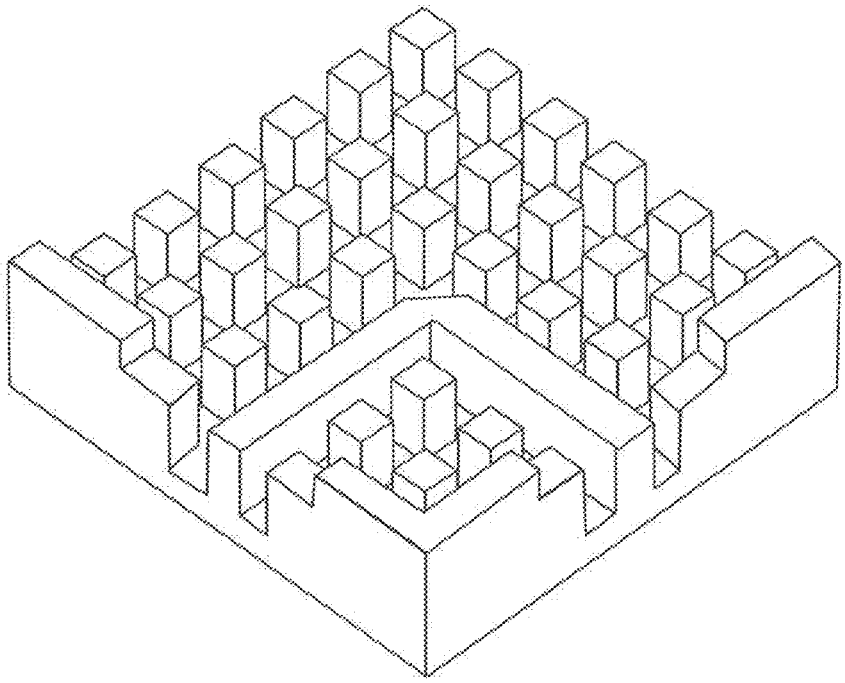
FIG. 17A is a perspective view schematically showing a conventional construction in which the side faces of each conductive rod 124 are not tilted, in a construction including a bend.
Figure 17B:
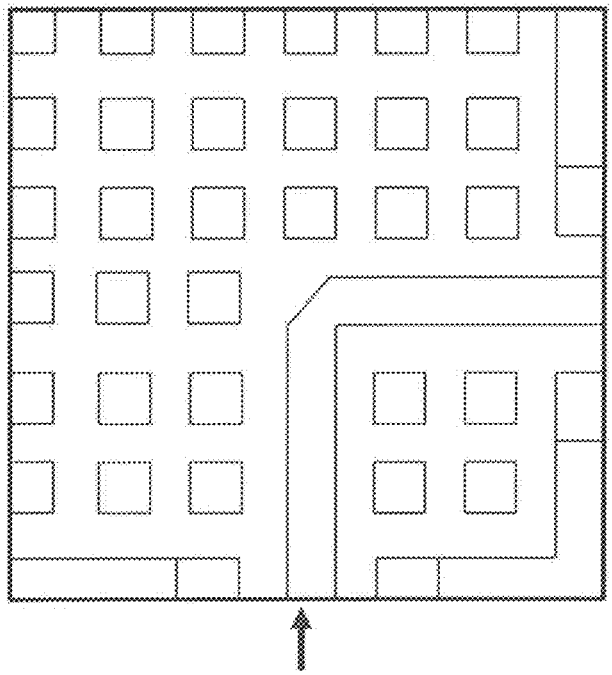
FIG. 17B is an upper plan view of the waveguide device shown in FIG. 17A.
Figure 17C:
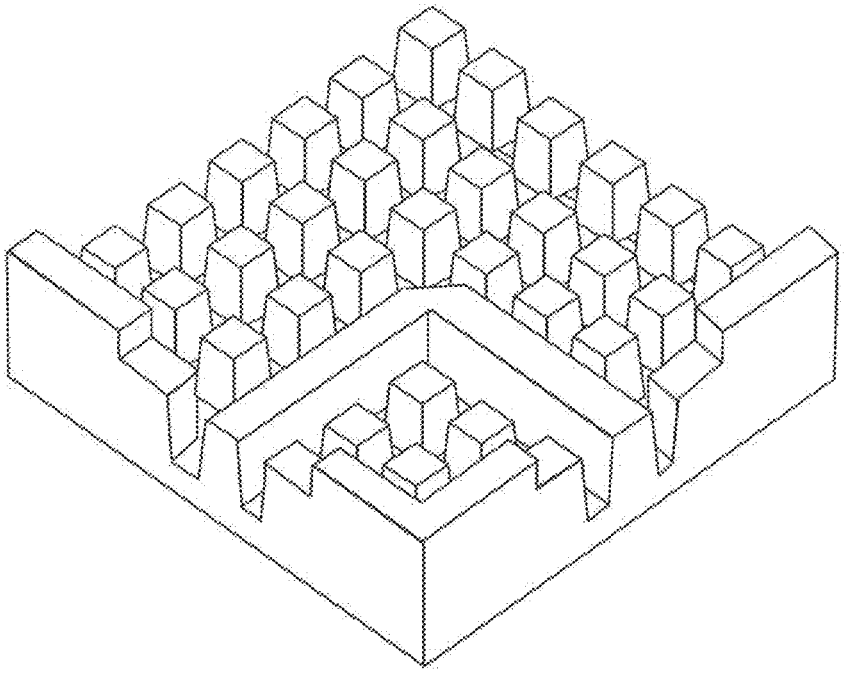
FIG. 17C is a perspective view schematically showing a construction according to an example embodiment where the side faces of each conductive rod 124 are tilted, in a construction including a bend.
Figure 17D:
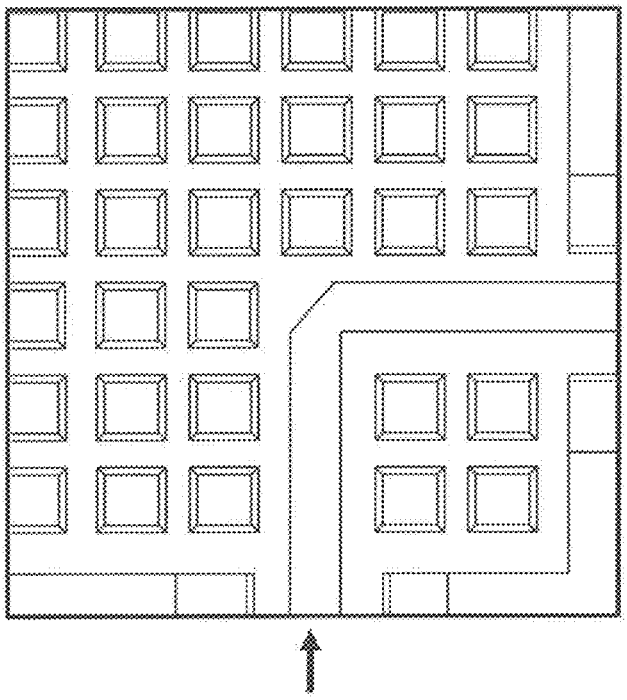
FIG. 17D is an upper plan view of the waveguide device shown in FIG. 17C.

FIGS. 17A through 17D are diagrams showing the construction of a waveguide device used in this simulation. FIG. 17A is a perspective view schematically showing a conventional construction in which the side faces of each conductive rod 124 are not tilted. FIG. 17B is an upper plan view of the waveguide device shown in FIG. 17A. FIG. 17C is a perspective view schematically showing a construction according to the present example embodiment where the side faces of each conductive rod 124 are tilted. FIG. 17D is an upper plan view of the waveguide device shown in FIG. 17C. In this simulation, the input wave is allowed to be incident in the orientation of an arrow shown in FIG. 17B and FIG. 17D, and an input reflection coefficient at the bend was measured. Otherwise, the simulation conditions were similar to the conditions in the earlier-mentioned simulation.

Figure 18:
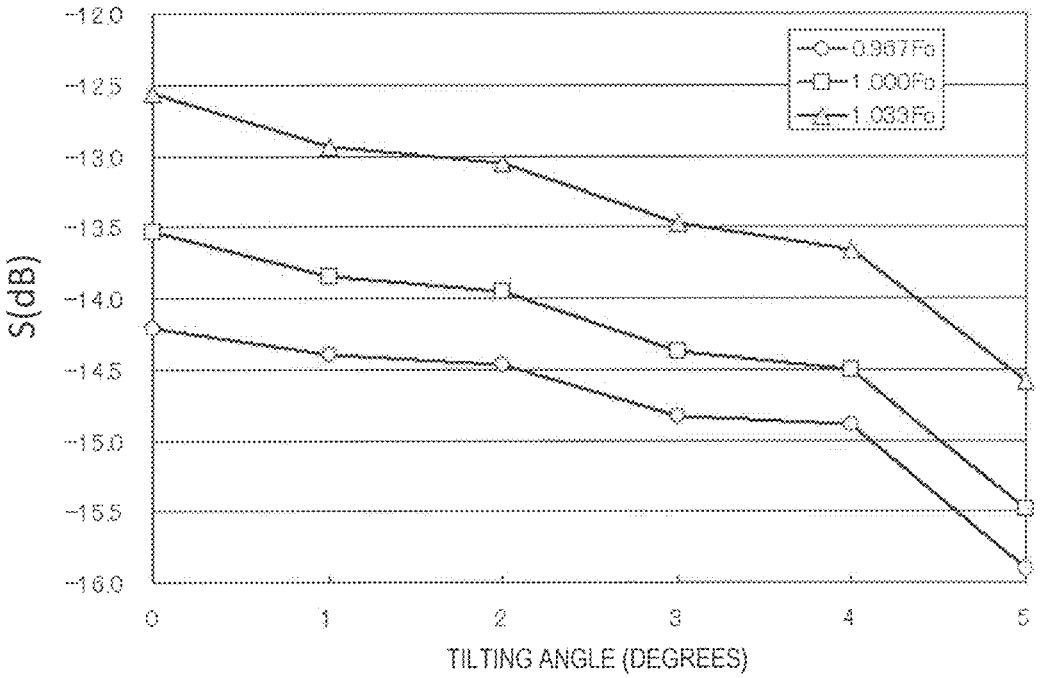
FIG. 18 is a graph showing an input reflection coefficient S for an input wave at frequencies of 0.967 Fo, 1.000 Fo and 1.033 Fo, in the respective cases where the angle of tilt θ is 0°, 1°, 2°, 3°, 4° and 5°, in a construction including a bend.

FIG. 18 is a graph showing results of this simulation. The graph of FIG. 18 shows an input reflection coefficient S (dB) for an input wave at frequencies of 0.967 Fo, 1.000 Fo and 1.033 Fo, in the respective cases where the angle of tilt θ is 0°, 1°, 2°, 3°, 4° and 5°.

It can be seen from FIG. 18 that, irrespective of the frequency of the input wave, the input reflection coefficient S becomes lower as the side faces of each conductive rod 124 are tilted. In other words, it was confirmed that the construction of the present example embodiment improves the degree of impedance matching.

Note that a branching portion and a bend may both be included in one waveguide member 122. For example, the waveguide member 122 may feature a structure combining a branching portion and a bend. Moreover, the shape (e.g., height or width) of the waveguide member 122 may undergo a local change(s) in a conventional manner, at a position near a branching portion or a bend. By thus introducing local changes in the shape of the waveguide member 122, a further improvement in the degree of impedance matching can be attained, in combination with the effect of the conductive rods 124 of the waveguide device according to the present disclosure.

<Other Structures for Conductive Rods>

Next, examples of other shapes for the conductive rods that can provide the effect according to the present disclosure will be described.

Figure 19A:
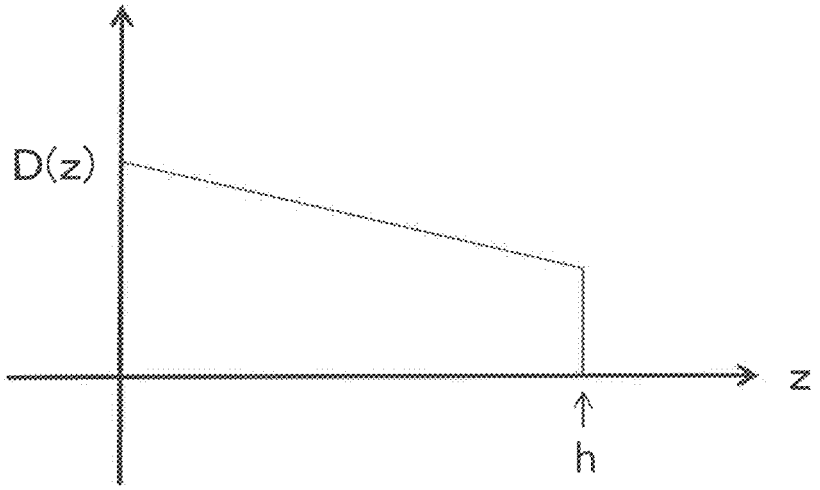
FIG. 19A is a graph showing an example of expressing a measure D of the outer shape of a cross section of a conductive rod 124 taken perpendicular to the axial direction (Z direction), as a function D(z) of distance z of the conductive rod 124 from its root 124*b*.
Figure 19B:
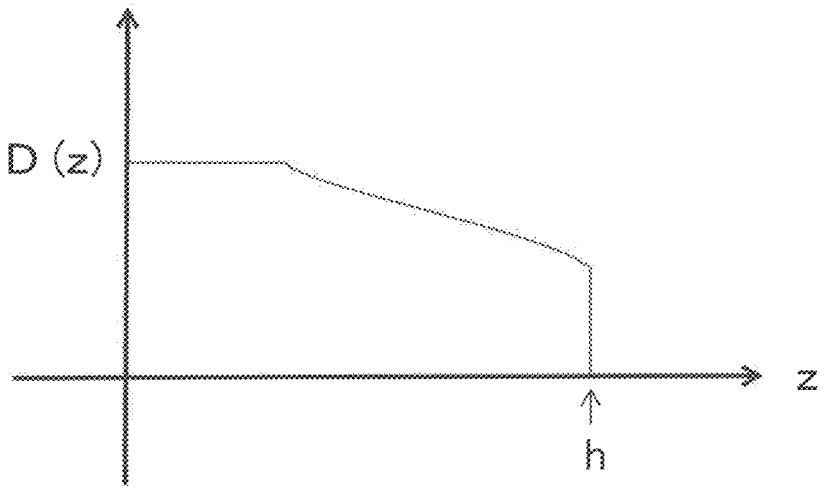
FIG. 19B is a graph representing an example embodiment where, within a specific range of z, D(z) does not change in magnitude even if z increases.

First, see FIGS. 19A and 19B. FIG. 19A is a graph showing an example of expressing a measure D of the outer shape of a cross section of a conductive rod 124 taken perpendicular to the axial direction (Z direction), as a function D(z) of distance z of the conductive rod 124 from its root 124*b*. The distance z is to be measured from the root 124*b* of each conductive rod 124, in parallel to the axial direction (Z direction) of the conductive rod 124.

FIG. 19A shows an example of a function D(z) concerning the conductive rods 124 as mentioned above. In FIG. 19A, the letter "h" means the height (i.e., size along the axial direction) of the conductive rod. D(z) has a gradient corresponding to the tilt of a side face 124*s* of each conductive rod 124. While the gradient of D(z) in the earlier-described example embodiment was uniform in each conductive rod 124, the waveguide device according to the present disclosure is not limited to such an example. The aforementioned effect will be obtained so long as D(z) monotonously decreases in response to increasing z.

In the present application, the feature that "a measure of the outer shape of a cross section of a conductive rod taken perpendicular to the axial direction monotonously decreases from its root that is in contact with the second conductive member toward its leading end" means that $D(z1) \geq D(z2)$ and $D(0) > D(h)$ hold true for any arbitrary z1 and z2 that satisfies $0 < z1 < z2 < h$. As indicated by the sign "≥" consisting of an inequality sign and an equality sign, the conductive rod may have a portion whose D(z) does not change in magnitude even if z increases. FIG. 19B represents an example where, within a specific range of z, D(z) does not change in magnitude even if z increases. The aforementioned effect can also be obtained with a conductive rod having such outer dimensions.

Figure 20A:
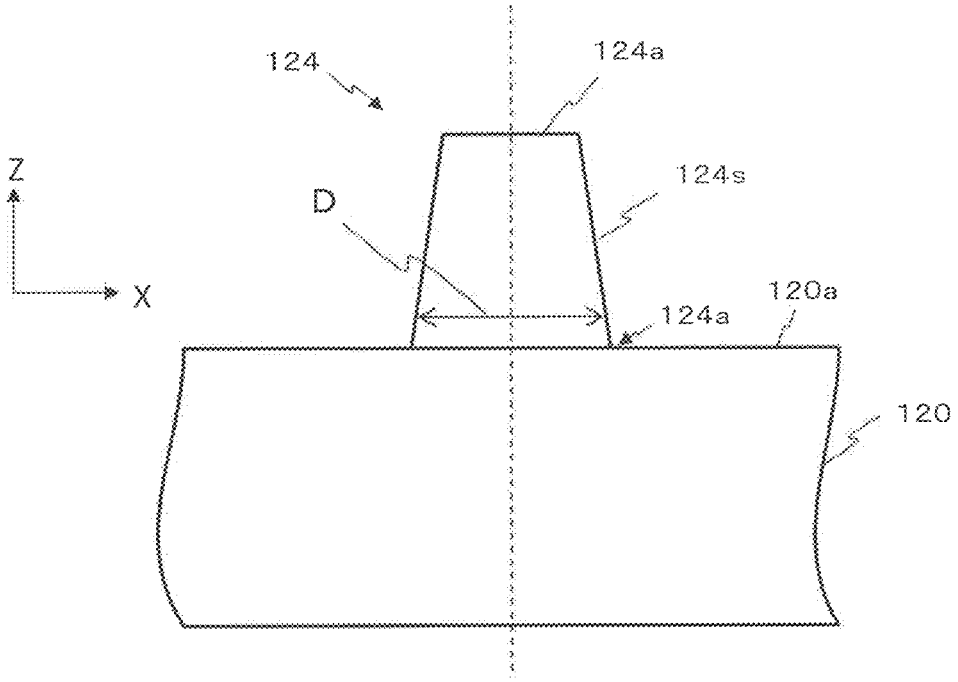
FIG. 20A is a cross-sectional view of a conductive rod 124 in a plane containing the axial direction (Z direction) in another example embodiment of the present disclosure.
Figure 20B:
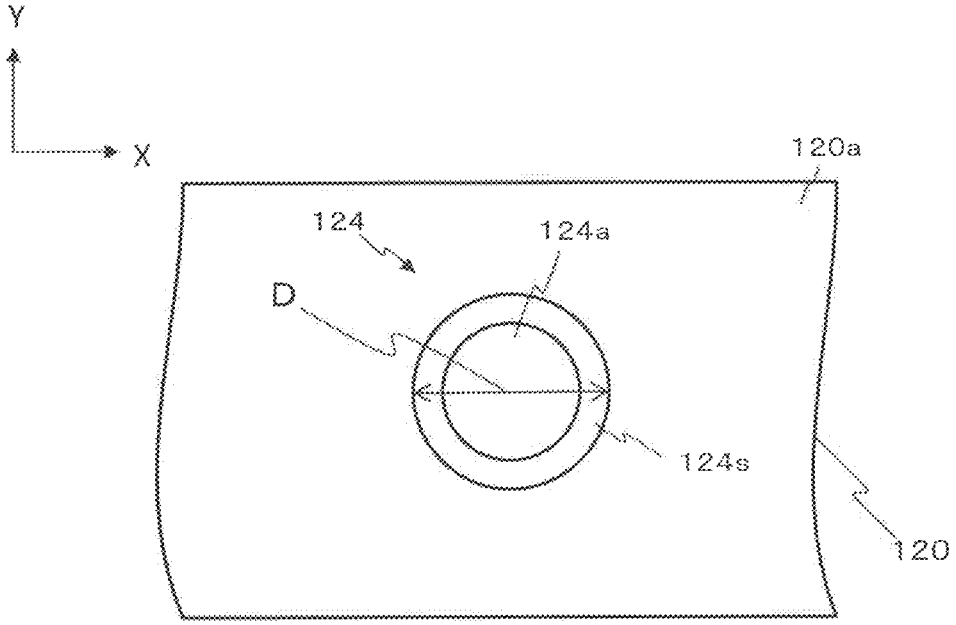
FIG. 20B is an upper plan view of the conductive rod 124 of FIG. 20A as viewed in the axial direction (Z direction).

FIG. 20A is a cross-sectional view of a conductive rod 124 in a plane containing the axial direction (Z direction) in another example. FIG. 20B is an upper plan view of the conductive rod 124 of FIG. 20A as viewed in the axial direction (Z direction). In this example, the outer shape of a cross section of the conductive rod 124 taken perpendicular to the axial direction is a circle. The "outer shape of a cross section" may also be an ellipse. In the case where the outer shape of a cross section is a circle, the "measure of the outer shape of a cross section of the conductive rod taken perpendicular to the axial direction" is equal to the diameter of the circle. In the case where the outer shape of a cross section is an ellipse, the "measure of the outer shape of a cross section of the conductive rod taken perpendicular to the axial direction" is equal to the length of the major axis of ellipse.

Thus, even when "a cross section of the conductive rod taken perpendicular to the axial direction" has a shape other than a square, the degree of impedance matching at a branching portion(s) and a bend(s) can be enhanced by tilting its side faces.

Figure 21A:
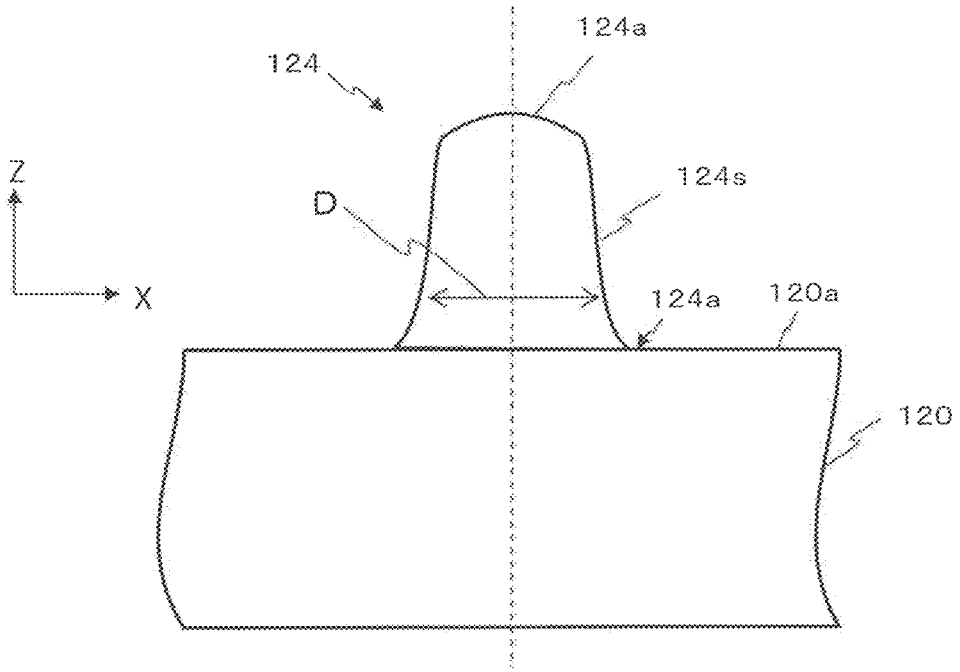
FIG. 21A is a cross-sectional view of a conductive rod 124 in a plane containing the axial direction (Z direction) in still another example.
Figure 21B:
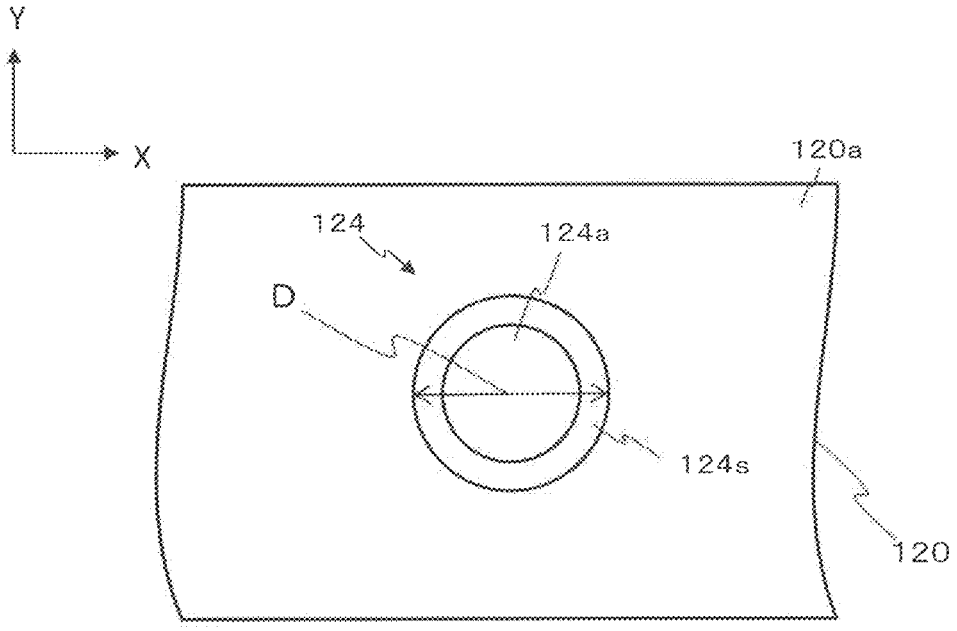
FIG. 21B is an upper plan view of the conductive rod 124 of FIG. 21A as viewed in the axial direction (Z direction).

Note that the leading end 124*a* of each conductive rod 124 does not need to be a plane; as in the example shown in FIGS. 21A and 21B, it may also be a curved surface.

Figure 22A:
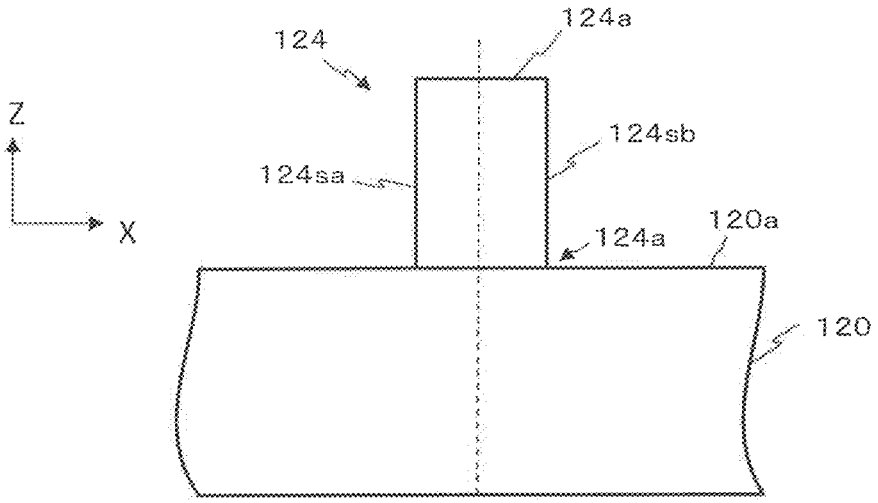
FIG. 22A is a diagram showing a cross section of a conductive rod 124 taken parallel to the XZ plane in still another example embodiment of the present invention.
Figure 22B:
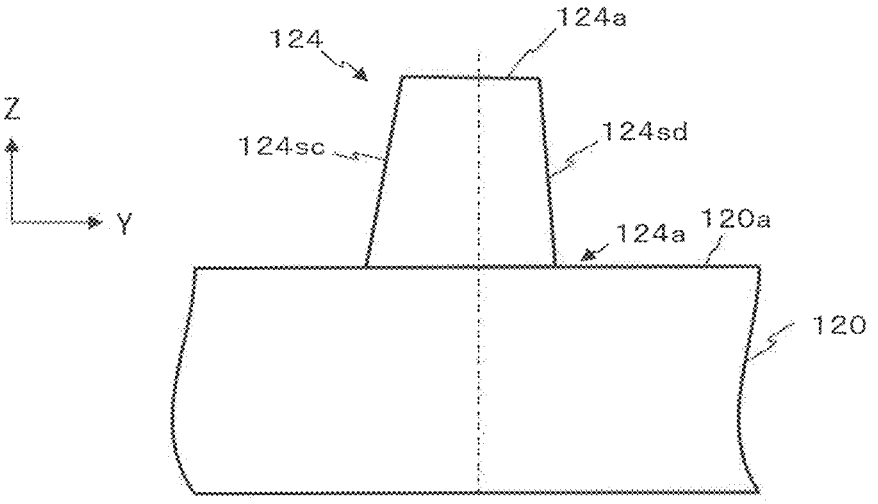
FIG. 22B is a diagram showing a cross section of the conductive rod 124 of FIG. 22A taken parallel to the YZ plane.
Figure 22C:
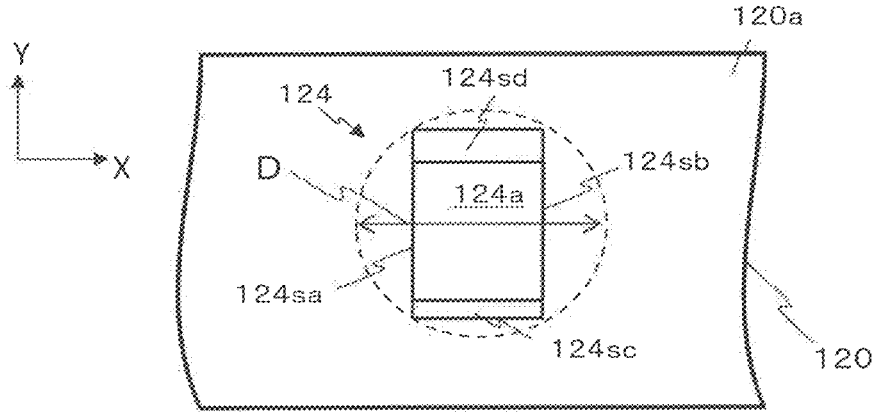
FIG. 22C is a diagram showing a cross section of the conductive rod 124 of FIG. 22A taken parallel to the XY plane.

FIGS. 22A, 22B and 22C are diagrams showing another example shape of a conductive rod 124. FIG. 22A shows a cross section of a conductive rod 124 taken parallel to the XZ plane; FIG. 22B shows a cross section of the conductive rod 124 taken parallel to the YZ plane; and FIG. 22C shows a cross section of the conductive rod 124 taken parallel to the XY plane. In this example, the outer shape of a cross section of the conductive rod 124 taken perpendicular to the axial direction is a rectangle, as shown in FIG. 22C. As shown in FIGS. 22A and 22B, among the four side faces 124*sa*, 124*sb*, 124*sc* and 124*sd* of the conductive rod 124 in this example, only the faces 124*sc* and 124*sd* are tilted; the other side faces 124*sa* and 124*sb* are not tilted.

Figure 23A:
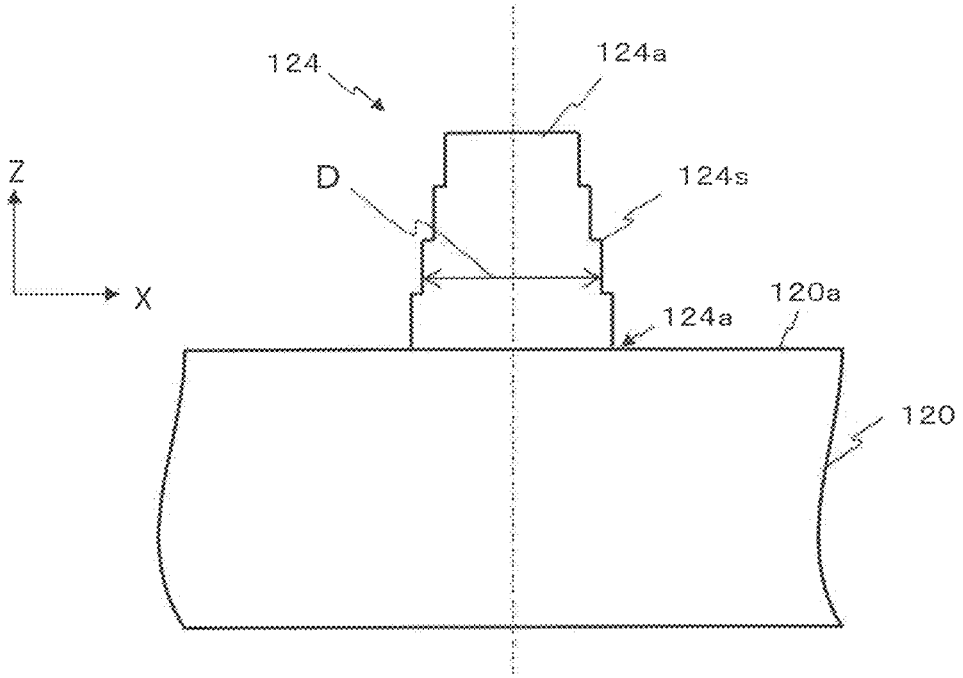
FIG. 23A is a cross-sectional view of a conductive rod 124 in a plane containing the axial direction (Z direction) in still another example embodiment of the present disclosure.
Figure 23B:
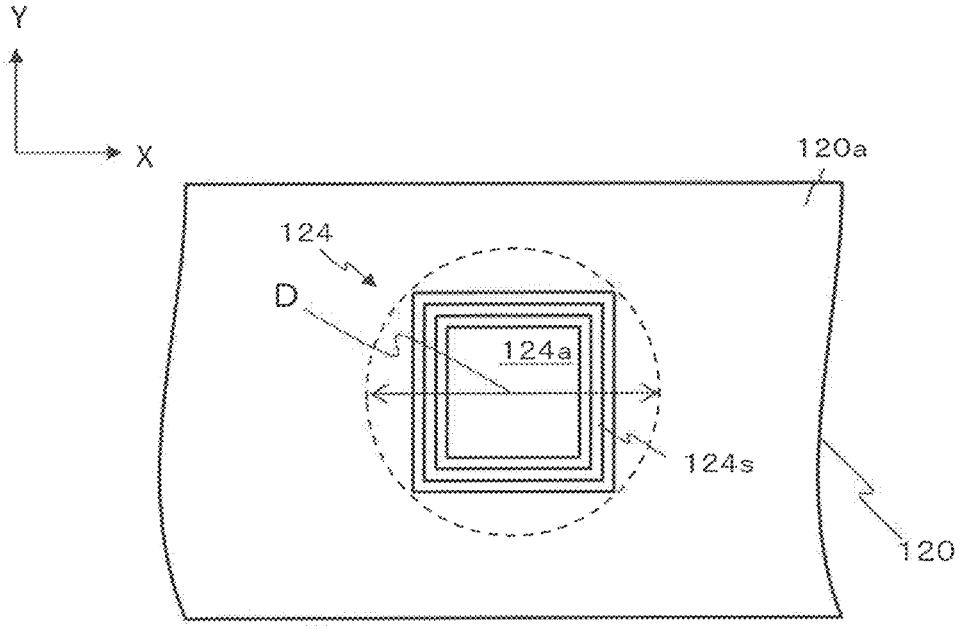
FIG. 23B is an upper plan view of the conductive rod 124 of FIG. 23A as viewed in the axial direction (Z direction).

FIG. 23A is a cross-sectional view of a conductive rod 124 in a plane containing the axial direction (Z direction) in still another example. FIG. 23B is an upper plan view of the conductive rod 124 of FIG. 23A as viewed in the axial direction (Z direction). The conductive rod 124 in this example has a stepped shape. A measure of "a cross section of the conductive rod taken perpendicular to the axial direction" undergoes drastic changes locally. In the meaning of the present application, such a shape also satisfies the feature that "a measure of the outer shape of a cross section of a conductive rod taken perpendicular to the axial direction monotonously decreases from its root that is in contact with the second conductive member toward its leading end".

Figure 24:
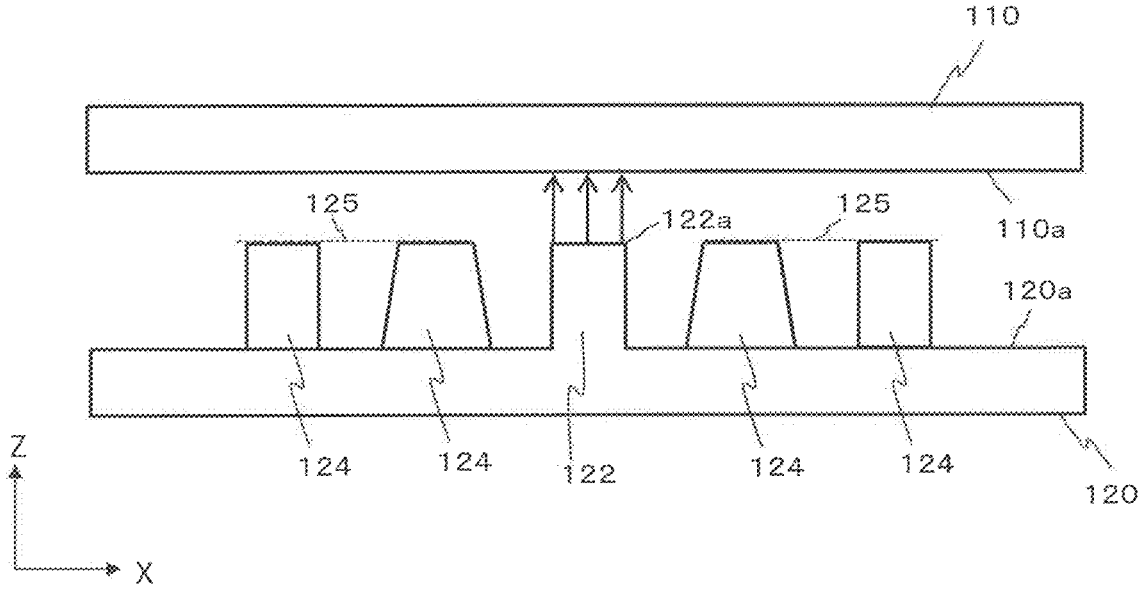
FIG. 24 is a cross-sectional view showing an example embodiment in which an earlier-described characteristic shape is imparted to only those conductive rods 124 which are adjacent to a waveguide member 122.

In the above example embodiment, the plurality of conductive rods 124 that are arrayed on the second conductive member 120 are of an identical shape. However, the waveguide device according to the present disclosure is not limited to such examples. The plurality of conductive rods 124 composing an artificial magnetic conductor may be of different shapes and/or sizes from one another. Moreover, as shown in FIG. 24, the earlier-described characteristic shape may be imparted to only those conductive rods 124 which are adjacent to the waveguide member 122. Moreover, a shape which is identical to that of a conventional conductive rod may be imparted to those conductive rods which are in any position that does not affect the degree of impedance matching at a branching portion or a bend of the waveguide member 122, while the earlier-described characteristic shape may be imparted only to those conductive rods which are in any position that affects the degree of impedance matching at a branching portion or a bend. Specifically, it suffices so long as a measure of the outer shape of a cross section of "a conductive rod that is adjacent to a branching portion or a bend" of the waveguide member 122, taken perpendicular to the axial direction, monotonously decreases from its root toward its leading end. As used herein, "a conductive rod that is adjacent to a branching portion or a bend" is defined, when there is no other intervening conductive rod between a conductive rod of interest and "a branching portion or a bend", to be that "conductive rod of interest".

<Example Dimensions, Etc., of Members>

Next, examples of the dimensions, shape, positioning, and the like of each member will be described.

The waveguide device of the present example embodiment is used for at least one of transmission and reception of electromagnetic waves of a predetermined band (referred to as the "operating frequency band"). In the present specification, $\lambda o$ denotes a representative value of wavelengths in free space (e.g., a central wavelength corresponding to a center frequency in the operating frequency band) of an electromagnetic wave (signal wave) propagating in a waveguide extending between the conductive surface 110*a* of the first conductive member 110 and the waveguide face 122*a* of the waveguide member 122. Moreover, $\lambda m$ denotes a wavelength, in free space, of an electromagnetic wave of the highest frequency in the operating frequency band.

Examples of dimensions, shapes, positioning, and the like of the respective members are as follows.

(1) Width of the Conductive Rod

The width (i.e., the size along the X direction and the Y direction) of the upper face the conductive rod 124 at its leading end may be set to less than $\lambda m/2$. Within this range, resonance of the lowest order can be prevented from occurring along the X direction and the Y direction. Since resonance may possibly occur not only in the X and Y directions but also in any diagonal direction in an X-Y cross section, the diagonal length of an X-Y cross section of the conductive rod 124 is also preferably less than $\lambda m/2$. The lower limit values for the width of the upper face of the rod and diagonal length will conform to the minimum lengths that are producible under the given manufacturing method, but is not particularly limited.

(2) Distance from the Root of the Conductive Rod to the Conductive Surface of the First Conductive Member The distance from the root 124*b* of each conductive rod 124 to the conductive surface 110*a* of the first conductive member 110 may be longer than the height of the conductive rods 124, while also being less than $\lambda m/2$. When the distance is $\lambda m/2$ or more, resonance may occur between the root 124*b* of each conductive rod 124 and the conductive surface 110*a*, thus reducing the effect of signal wave containment.

The distance from the root 124*b* of each conductive rod 124 to the conductive surface 110*a* of the first conductive member 110 corresponds to the spacing between the first conductive member 110 and the second conductive member 120. For example, when a signal wave of 76.5±0.5 GHz (which belongs to the millimeter band or the extremely high frequency band) propagates in the waveguide, the wavelength of the signal wave is in the range from 3.8934 mm to 3.9446 mm. Therefore, $\lambda m$ equals 3.8934 mm in this case, so that the spacing between the first conductive member 110 and the second conductive member 120 may be set to less than a half of 3.8934 mm. So long as the first conductive member 110 and the second conductive member 120 realize such a narrow spacing while being disposed opposite from each other, the first conductive member 110 and the second conductive member 120 do not need to be strictly parallel. Moreover, when the spacing between the first conductive member 110 and the second conductive member 120 is less than $\lambda m/2$, a whole or a part of the first conductive member 110 and/or the second conductive member 120 may be shaped as a curved surface. On the other hand, the first and second conductive members 110 and 120 each have a planar shape (i.e., the shape of their region as perpendicularly projected onto the XY plane) and a planar size (i.e., the size of their region as perpendicularly projected onto the XY plane) which may be arbitrarily designed depending on the application.

(3) Arrangement and Shape of Conductive Rods

The interspace between two adjacent conductive rods 124 among the plurality of conductive rods 124 has a width of less than $\lambda m/2$, for example. The width of the interspace between any two adjacent conductive rods 124 is defined by the shortest distance from the surface (side surface) of one of the two conductive rods 124 to the surface (side surface) of the other. In the case where two adjacent rods 124 have gradually-pointed shapes as in the present example embodiment, the interspace therebetween may advantageously be $\lambda m/2$ at the leading end where the interspace is greatest in width. This width of the interspace between rods is to be determined so that resonance of the lowest order will not occur in the regions between rods. The conditions under which resonance will occur are determined based by a combination of: the height of the conductive rods 124; the distance between any two adjacent conductive rods; and the capacitance of the air gap between the leading end 124*a* of each conductive rod 124 and the conductive surface 110*a*. Therefore, the width of the interspace between rods may be appropriately determined depending on other design parameters. Although there is no clear lower limit to the width of the interspace between rods, for manufacturing ease, it may be e.g. $\lambda m/16$ or more when an electromagnetic wave in the extremely high frequency range is to be propagated. Note that the interspace does not need to have a constant width. So long as it remains less than $\lambda m/2$, the interspace between conductive rods 124 may vary.

The arrangement of the plurality of conductive rods 124 is not limited to the illustrated example, so long as it exhibits a function of an artificial magnetic conductor. The plurality of conductive rods 124 do not need to be arranged in orthogonal rows and columns; the rows and columns may be intersecting at angles other than 90 degrees. The plurality of conductive rods 124 do not need to form a linear array along rows or columns, but may be in a dispersed arrangement which does not present any straightforward regularity. The conductive rods 124 may also vary in shape and size depending on the position on the second conductive member 120.

The surface 125 of the artificial magnetic conductor that are constituted by the leading ends 124*a* of the plurality of conductive rods 124 does not need to be a strict plane, but may be a plane with minute rises and falls, or even a curved surface. In other words, the conductive rods 124 do not need to be of uniform height, but rather the conductive rods 124 may be diverse so long as the array of conductive rods 124 is able to function as an artificial magnetic conductor.

Furthermore, each conductive rod 124 does not need to have a prismatic shape as shown in the figure, but may have a cylindrical shape, for example. Furthermore, each conductive rod 124 does not need to have a simple columnar shape. The artificial magnetic conductor may also be realized by any structure other than an array of conductive rods 124, and various artificial magnetic conductors are applicable to the waveguide device of the present disclosure. Note that, when the leading end 124*a* of each conductive rod 124 has a prismatic shape, its diagonal length is preferably less than λm/2. When the leading end 124*a* of each conductive rod 124 is shaped as an ellipse, the length of its major axis is preferably less than λm/2. Even when the leading end 124*a* has any other shape, the dimension across it is preferably less than λm/2 even at the longest position.

(4) Width of the Waveguide Face

The width of the waveguide face 122*a* of the waveguide member 122, i.e., the size of the waveguide face 122*a* along a direction which is orthogonal to the direction that the waveguide member 122 extends, may be set to less than λm/2 (e.g. λo/8). If the width of the waveguide face 122*a* is λm/2 or more, resonance will occur along the width direction, which will prevent any WRG from operating as a simple transmission line.

(5) Height of the Waveguide Member

The height (i.e., the size along the Z direction) of the waveguide member 122 is set to less than λm/2. The reason is that, if the distance is λm/2 or more, the distance between the root 124*b* of each conductive rod 124 and the conductive surface 110*a* will be λm/2 or more. Similarly, the height of the conductive rods 124 (in particular, those conductive rods 124 which are adjacent to the waveguide member 122) is also set to less than λ m/2.

(6) Distance Between the Waveguide Face and the Conductive Surface

The distance between the waveguide face 122*a* of the waveguide member 122 and the conductive surface 110*a* is set to less than λm/2. If the distance is λm/2 or more, resonance will occur between the waveguide face 122*a* and the conductive surface 110*a*, which will prevent functionality as a waveguide. In one example, the distance is λm/4 or less. In order to ensure manufacturing ease, when an electromagnetic wave in the extremely high frequency range is to propagate, the distance is preferably λm/16 or more, for example.

The lower limit of the distance between the conductive surface 110*a* and the waveguide face 122*a* and the lower limit of the distance between the conductive surface 110*a* and the leading end 124*a* of each conductive rod 124 depends on the machining precision, and also on the precision when assembling the two upper/lower conductive members 110 and 120 so as to be apart by a constant distance. When a pressing technique or an injection technique is used, the practical lower limit of the aforementioned distance is about 50 micrometers (μm). In the case of using an MEMS (Micro-Electro-Mechanical System) technique to make a product in e.g. the terahertz range, the lower limit of the aforementioned distance is about 2 to about 3 μm.

In the waveguide device 100 of the above-described construction, a signal wave of the operating frequency is unable to propagate in the space between the surface 125 of the artificial magnetic conductor and the conductive surface 110*a* of the first conductive member 110, but propagates in the space between the waveguide face 122*a* of the waveguide member 122 and the conductive surface 110*a* of the first conductive member 110. Unlike in a hollow waveguide, the width of the waveguide member 122 in such a waveguide structure does not need to be equal to or greater than a half of the wavelength of the electromagnetic wave to propagate. Moreover, the first conductive member 110 and the second conductive member 120 do not need to be interconnected by a metal wall that extends along the thickness direction (i.e., in parallel to the YZ plane).

3. Antenna Device

Hereinafter, an example application of a waveguide device incorporating a radio frequency member that is produced by the production method of the present disclosure will be described. As an example, a non-limiting illustrative example embodiment of an antenna device including such a waveguide device will be described.

Figure 25A:
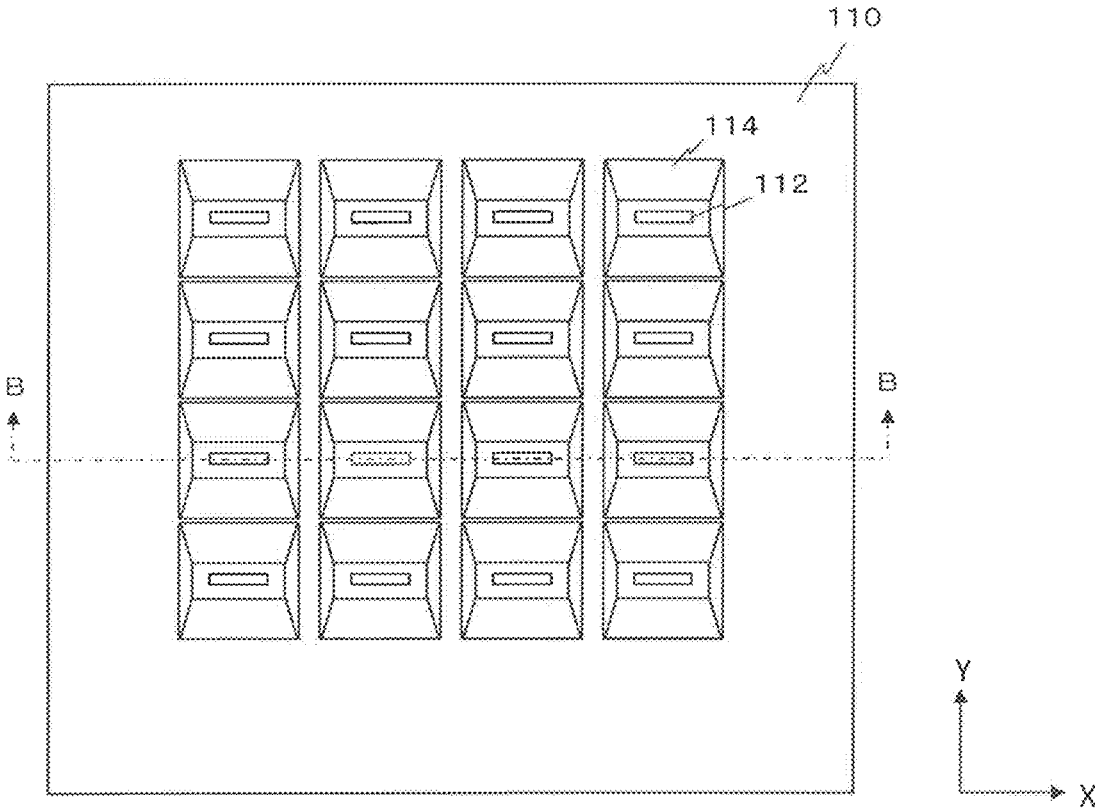
FIG. 25A is an upper plan view of an array antenna according to an example embodiment of the present disclosure as viewed in the Z direction.
Figure 25B:
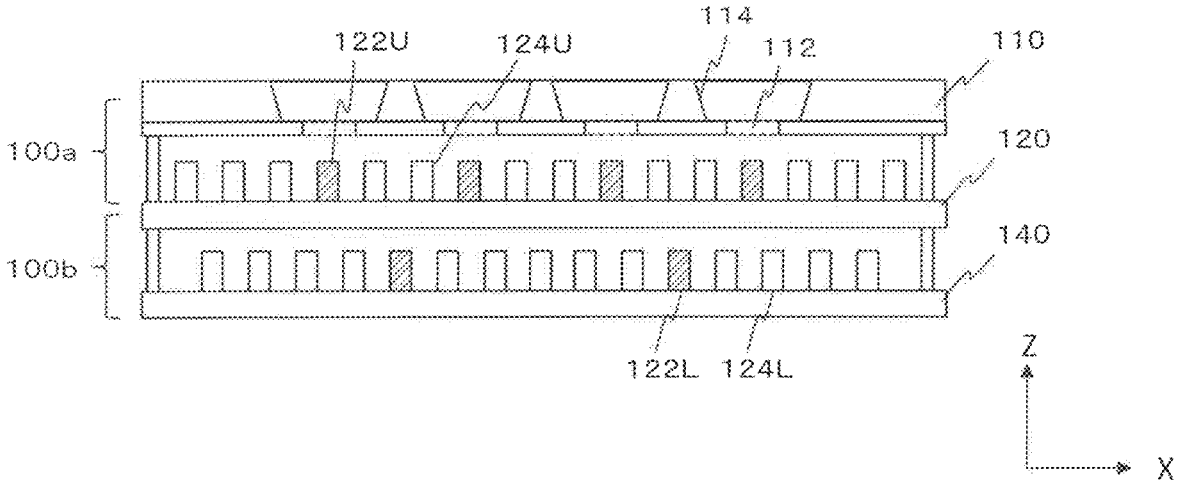
FIG. 25B is a cross-sectional view taken along line B-B in FIG. 25A.

FIG. 25A is an upper plan view of an antenna device (array antenna) including 16 slots (openings) 112 in an array of 4 rows and 4 columns, as viewed from the Z direction. FIG. 25B is a cross-sectional view taken along line B-B in FIG. 25A. In the antenna device shown in the figures, a first waveguide device 100*a* and a second waveguide device 100*b* are layered. The first waveguide device 100*a* includes waveguide members 122U that directly couple to slots 112 functioning as radiation elements (antenna elements). The second waveguide device 100*b* includes further waveguide members 122L that couple to the waveguide members 122U of the first waveguide device 100*a*. The waveguide members 122L and the conductive rods 124L of the second waveguide device 100*b* are arranged on a third conductive member 140. The second waveguide device 100*b* is basically similar in construction to the first waveguide device 100*a*.

On the first conductive member 110 in the first waveguide device 100*a*, side walls 114 surrounding each slot 112 are provided. The side walls 114 form a horn that adjusts directivity of the slot 112. The number and arrangement of slots 112 in this example are only illustrative. The orientations and shapes of the slots 112 are not limited to those of the example shown in the figures, either. It is not intended that the example shown in the figures provides any limitation as to whether the side walls 114 of each horn are tilted or not, the angles thereof, or the shape of each horn.

Figure 26:
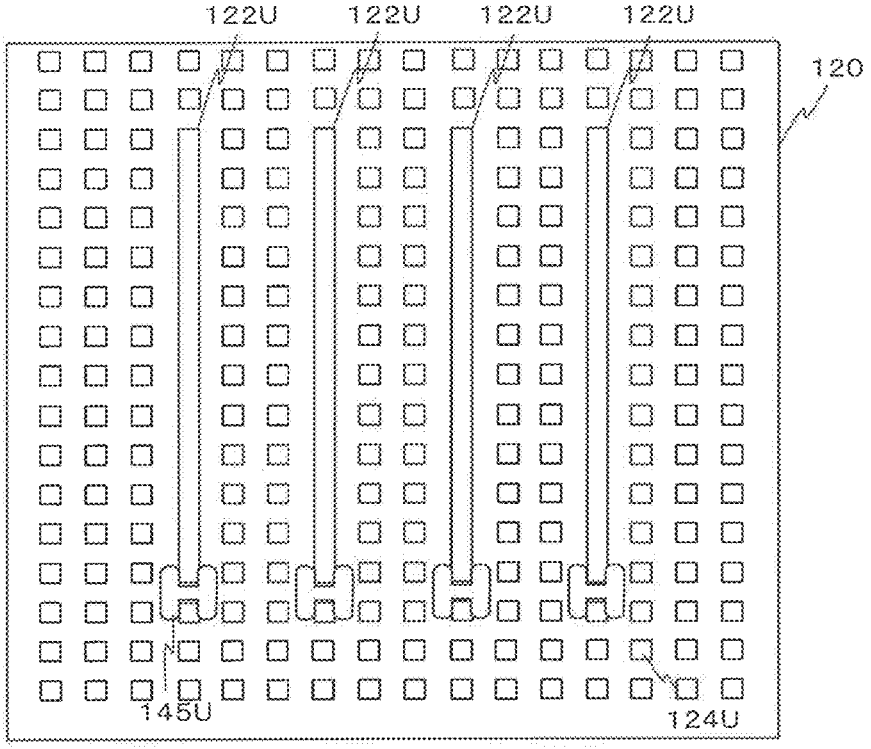
FIG. 26 is a diagram showing a planar layout of waveguide members 122 in a first waveguide device 100*a* according to an example embodiment of the present disclosure.
Figure 27:
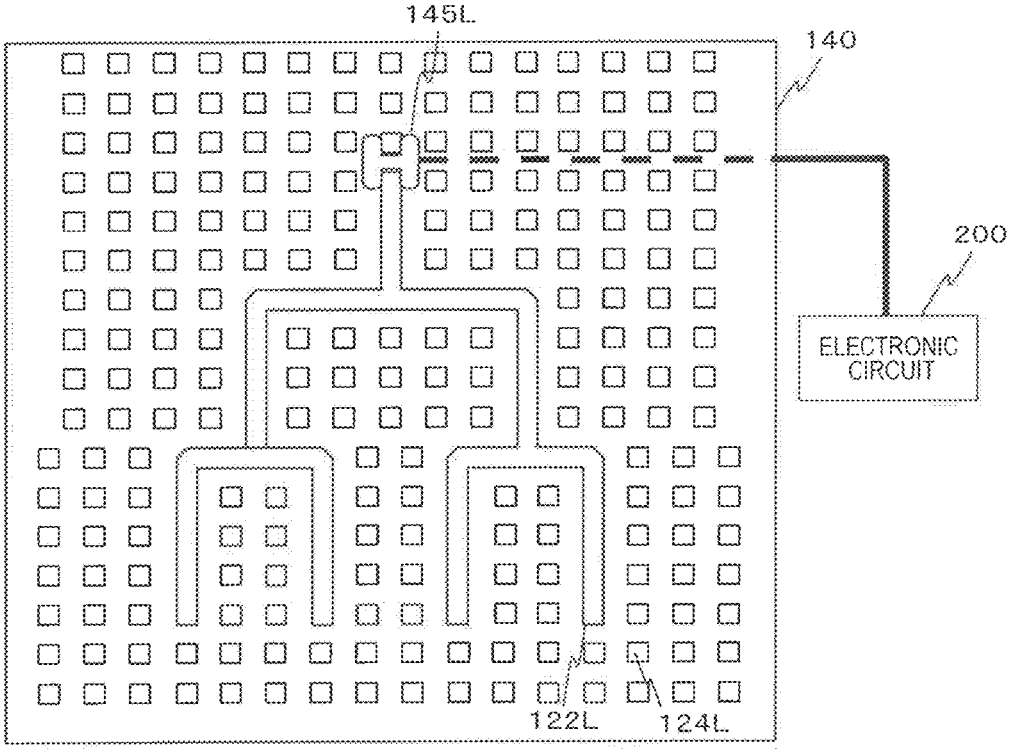
FIG. 27 is a diagram showing a planar layout of a waveguide member 122 in a second waveguide device 100*b* according to an example embodiment of the present disclosure.

FIG. 26 is a diagram showing a planar layout of waveguide members 122U in the first waveguide device 100*a*. FIG. 27 is a diagram showing a planar layout of a waveguide member 122L in the second waveguide device 100*b*. As is clear from these figures, the waveguide members 122U of the first waveguide device 100*a* extend linearly, and include no branching portions or bends; on the other hand, the waveguide members 122L of the second waveguide device 100*b* include both branching portions and bends. In terms of fundamental construction of the waveguide device, the combination of the "second conductive member 120" and the "third conductive member 140" in the second waveguide device 100*b* corresponds to the combination in the first waveguide device 100*a* of the "first conductive member 110" and the "second conductive member 120".

What is characteristic in the array antenna shown in the figures is that each conductive rod 124L has a shape as shown in FIG. 13A and FIG. 13B. As a result, the degree of impedance matching is improved at the branching portions and bends of the waveguide members 122L.

Note that the shape of each conductive rod 124L is not limited to the example shown in FIG. 13A and FIG. 13B. As mentioned earlier, the shape, size, and arraying pattern of the conductive rods 124L may be various.

The waveguide members 122U of the first waveguide device 100*a* couple to the waveguide member 122L of the second waveguide device 100*b*, through ports (openings) 145U that are provided in the second conductive member 120. Stated otherwise, an electromagnetic wave which has propagated through the waveguide member 122L of the second waveguide device 100*b* passes through a port 145U to reach a waveguide member 122U of the first waveguide device 100*a*, and propagates through the waveguide member 122U of the first waveguide device 100*a*. In this case, each slot 112 functions as an antenna element to allow an electromagnetic wave which has propagated through the waveguide to be emitted into space. Conversely, when an electromagnetic wave which has propagated in space impinges on a slot 112, the electromagnetic wave couples to the waveguide member 122U of the first waveguide device 100*a* that lies directly under that slot 112, and propagates through the waveguide member 122U of the first waveguide device 100*a*. An electromagnetic wave which has propagated through a waveguide member 122U of the first waveguide device 100*a* may also pass through a port 145U to reach the waveguide member 122L of the second waveguide device 100*b*, and propagates through the waveguide member 122L of the second waveguide device 100*b*. Via a port 145L of the third conductive member 140, the waveguide member 122L of the second waveguide device 100*b* may couple to an external waveguide device or radio frequency circuit (electronic circuit). As one example, FIG. 27 illustrates an electronic circuit 200 which is connected to the port 145L. Without being limited to a specific position, the electronic circuit 200 may be provided at any arbitrary position. The electronic circuit 200 may be provided on a circuit board which is on the rear surface side (i.e., the lower side in FIG. 25B) of the third conductive member 140, for example. Such an electronic circuit may be an MMIC (Monolithic Microwave Integrated Circuit) that generates millimeter waves, for example.

The first conductive member 110 shown in FIG. 25A may be called an "emission layer". Moreover, the entirety of the second conductive member 120, the waveguide members 122U, and the conductive rods 124U shown in FIG. 26 may be called an "excitation layer", whereas the entirety of the third conductive member 140, the waveguide member 122L, and the conductive rods 124L shown in FIG. 27 may be called a "distribution layer". Moreover, the "excitation layer" and the "distribution layer" may be collectively called a "feeding layer". Each of the "emission layer", the "excitation layer", and the "distribution layer" can be mass-produced by processing a single metal plate.

In the array antenna of this example, as can be seen from FIG. 25B, an emission layer, an excitation layer, and a distribution layer are layered, which are in plate form; therefore, a flat and low-profile flat panel antenna is realized as a whole. For example, the height (thickness) of a multi-layer structure having a cross-sectional construction as shown in FIG. 25B can be set to 10 mm or less.

With the waveguide member 122L shown in FIG. 27, the distances from the port 145L of the third conductive member 140 to the respective ports 145U (see FIG. 26) of the second conductive member 120 measured along the waveguide are all set to equal values. Therefore, a signal wave which is input to the waveguide member 122L reaches the four ports 145U of the second conductive member 120 all in the same phase, from the port 145L of the third conductive member 140. As a result, the four waveguide members 122U on the second conductive member 120 can be excited in the same phase.

It is not necessary for all slots 112 functioning as antenna elements to emit electromagnetic waves in the same phase. The network patterns of the waveguide members 122U and 122L in the excitation layer and the distribution layer may be arbitrary, and they may be arranged so that the respective waveguide members 122U and 122L independently propagate different signals.

Although the waveguide members 122U of the first waveguide device 100*a* in this example include neither a branching portion nor a bend, the waveguide device functioning as an excitation layer may also include a waveguide member having at least one of a branching portion and a bend. As mentioned earlier, it is not necessary for all conductive rods in the waveguide device to be similar in shape.

A method of producing a radio frequency member according to the present disclosure can be used for producing a WRG waveguide device, and a radio frequency member to be included in an antenna incorporating a WRG waveguide device. It can also be used for producing a radio frequency member for suppressing or blocking leakage of a radio frequency signal.

While the present disclosure has been described with respect to example embodiments thereof, it will be apparent to those skilled in the art that the disclosed disclosure may be modified in numerous ways and may assume many example embodiments other than those specifically described above. Accordingly, it is intended by the appended claims to cover all modifications of the disclosure that fall within the true spirit and scope of the disclosure.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A method of producing a radio frequency member of a radio frequency confinement device with a waffle iron structure, the radio frequency confinement device being used for a ridge waveguide device or an antenna device including such a ridge waveguide device, or used with an electric circuit including a monolithic microwave integrated circuit (MMIC), the method comprising:

providing an intermediate work of a plate shape or a block shape, the intermediate work including a main surface which is shaped as a plane or a curved surface and a plurality of rods extending away from the main surface, wherein an interval between a side surface of one of the plurality of rods and a side surface of another rod that is adjacent to the one rod monotonically increases in a direction away from the main surface; and forming an electrically-conductive plating layer on the main surface and at least the side surface of the plurality of rods by immersing at least a portion of the intermediate work in a plating solution; wherein the plurality of rods define at least a portion of the waffle iron structure; and a width of each of the plurality of rods is smaller than λm/2, where λm is a wavelength, in free space, of an electromagnetic wave having a highest frequency in an operating frequency hand of the radio frequency member.

2. The method of producing a radio frequency member of claim 1, wherein the side surface of each of the plurality of rods connects, at a root thereof, to the main surface via a first curved surface; and a radius of curvature of the first curved surface is greater than a radius of curvature of a portion at which an upper surface of each of the plurality of rods connects to the side surface.

3. The method of producing a radio frequency member of claim 1, wherein the intermediate work includes a ridge extending along the main surface;

the ridge includes an upper surface on an apex thereof, the upper surface being flat and stripe-shaped;

a side surface of the ridge is surrounded by at least some of the plurality of rods; and a distance between the side surface of the ridge and the side surface of each of the rods which surround the side surface of the ridge monotonically increases in the direction away from the main surface.

4. The method of producing a radio frequency member of claim 1, wherein the side surface of each of the plurality of rods connects, at a root thereof, to the main surface via a first curved surface;

a radius of curvature of the first curved surface is greater than a radius of curvature of a portion at which an upper surface of each of the plurality of rods connects to the side surface thereof;

the intermediate work includes a ridge extending along the main surface;

the ridge includes an upper surface on an apex thereof, the upper surface being flat and stripe-shaped;

a side surface of the ridge is surrounded by at least some of the plurality of rods; and a distance between the side surface of the ridge and the side surface of each of the rods which surround the side surface of the ridge monotonically increases in the direction away from the main surface.

5. The method of producing a radio frequency member of claim 1, wherein the intermediate work includes a ridge extending along the main surface;

the ridge includes an upper surface on an apex thereof, the upper surface being flat and stripe-shaped;

a side surface of the ridge is surrounded by at least some of the plurality of rods;

a distance between the side surface of the ridge and the side surface of each of the rods which surround the side surface of the ridge monotonically increases in the direction away from the main surface;

the side surface of the ridge connects, at a root thereof, to the main surface via a second curved surface; and a radius of curvature of the second curved surface is greater than a radius of curvature of a portion at which the upper surface of the ridge connects to the side surface of the ridge.

6. The method of producing a radio frequency member of claim 3, wherein the forming the plating layer includes forming an electrically-conductive plating layer on the side surface of the ridge and the upper surface of the ridge; and a thickness of a portion of the plating layer that covers the upper surface of the ridge is greater than a thickness of a portion of the plating layer that covers the main surface of the intermediate work located between a root of the ridge and rods that are adjacent to the ridge.

7. The method of producing a radio frequency member of claim 1, wherein the intermediate work includes a ridge extending along the main surface;

the ridge includes an upper surface on an apex thereof, the upper surface being flat and stripe-shaped;

a side surface of the ridge is surrounded by at least some of the plurality of rods;

a distance between the side surface of the ridge and the side surface of each of the rods which surround the side surface of the ridge monotonically increases in the direction away from the main surface;

the side surface of the ridge connects, at a root thereof, to the main surface via a second curved surface;

a radius of curvature of the second curved surface is greater than a radius of curvature of a portion at which the upper surface of the ridge connects to the side surface of the ridge;

the forming the plating layer includes forming an electrically-conductive plating layer on the side surface and an upper surface of the ridge; and a thickness of a portion of the plating layer that covers the upper surface of the ridge is greater than a thickness of a portion of the plating layer that covers the main surface of the intermediate work located between a root of the ridge and rods that are adjacent to the ridge.

8. The method of producing a radio frequency member of claim 1, wherein each of the plurality of rods includes a flat upper surface;

the side surface of each of the plurality of rods connects, at a root thereof, to the main surface via a first curved surface;

a radius of curvature of the first curved surface is greater than a radius of curvature of a portion at which an upper surface of each of the plurality of rods connects to the side surface;

the intermediate work includes a ridge extending along the main surface;

the ridge includes an upper surface on an apex thereof, the upper surface of the ridge being flat and stripe-shaped;

a side surface of the ridge is surrounded by at least some of the plurality of rods; and a distance between the side surface of the ridge and the side surface of each of the rods which surround the side surface of the ridge monotonically increases in the direction away from the main surface.

9. The method of producing a radio frequency member of claim 1, wherein the intermediate work is placed with an attitude such that, when immersed in the plating solution, the main surface extends in a direction which is parallel to the direction of gravity or which forms an angle of 45 degrees or smaller with the direction of gravity.

10. The method of producing a radio frequency member of claim 1, wherein the intermediate work includes a ridge extending along the main surface;

the ridge includes an upper surface on an apex thereof, the upper surface of the ridge being flat and stripe-shaped;

a side surface of the ridge is surrounded by at least some of the plurality of rods;

a distance between the side surface of the ridge and the side surface of each of the rods which surround the side surface of the ridge monotonically increases in the direction away from the main surface;

the side surface of the ridge connects, at a root thereof, to the main surface via a second curved surface;

a radius of curvature of the second curved surface is greater than a radius of curvature of a portion at which the upper surface of the ridge connects to the side surface of the ridge;

the forming the plating layer includes forming an electrically-conductive plating layer on the side surface and the upper surface of the ridge;

a thickness of a portion of the plating layer that covers the upper surface of the ridge is greater than a thickness of a portion of the plating layer that covers the main surface of the intermediate work located between the root of the ridge and rods that are adjacent to the ridge; and the intermediate work is placed with an attitude such that, when immersed in the plating solution, the main surface extends in a direction which is parallel to the direction of gravity or which forms an angle of 45 degrees or smaller with the direction of gravity.

11. The method of producing a radio frequency member of claim 8, wherein, the providing the intermediate work includes performing an injection molding to provide the intermediate work being made of a resin;

dies which are used in the injection molding include:

one or more side surface dies defining an air gap including an inner peripheral surface of a same shape as the side surface of the ridge; and one or more end surface dies including a surface of a same shape as the upper surface of the ridge; and the injection molding is performed while an end of the air gap defined by the one or more side surface dies is occluded by the one or more end surface dies.

12. The method of producing a radio frequency member of claim 1, wherein the interval between the side surface of one of the plurality of rods and the side surface of another rod that is adjacent to the one rod is less than 2 mm.

13. The method of producing a radio frequency member of claim 1, wherein the side surfaces of each of the plurality of rods is connected, at a root thereof, to the main surface via a first curved surface;

a radius of curvature of the first curved surface is greater than a radius of curvature of a portion at which an upper surface of each of the plurality of rods connects to the side surface;

the intermediate work includes a ridge extending along the main surface;

the ridge includes an upper surface on an apex thereof, the upper surface of the ridge being flat and stripe-shaped;

a side surface of the ridge is surrounded by at least some of the plurality of rods;

a distance between the side surface of the ridge and the side surface of each of the rods which surround the side surface of the ridge monotonically increases in the direction away from the main surface; and the interval between the side surface of one of the plurality of rods and the side surface of another rod that is adjacent to the one rod is less than 2 mm.

14. The method of producing a radio frequency member of claim 6, wherein an angle of contact of the plating solution with a surface of a portion of the intermediate work is greater than 0 degrees and smaller than 90 degrees.

* * * * *